US008621877B2

(12) United States Patent
Tuszkiewicz et al.

(10) Patent No.: US 8,621,877 B2
(45) Date of Patent: Jan. 7, 2014

(54) MODULAR COOLED PRODUCT MERCHANDIZING UNITS, KITS, AND METHODS OF MANUFACTURE

(75) Inventors: George A. Tuszkiewicz, Plymouth, MN (US); Mark Bedard, St. Lambert (CA)

(73) Assignee: General Mills, Inc., Minneapolis, MN (US)

( * ) Notice: Subject to any disclaimer, the term of this patent is extended or adjusted under 35 U.S.C. 154(b) by 405 days.

(21) Appl. No.: 13/117,652

(22) Filed: May 27, 2011

(65) Prior Publication Data

US 2012/0297794 A1 Nov. 29, 2012

(51) Int. Cl.
*F25D 3/12* (2006.01)

(52) U.S. Cl.
USPC ..... 62/56; 62/259.1

(58) Field of Classification Search
USPC ..... 62/3.6, 259.1, 298, 441; 312/401, 405, 312/406.2; 29/890.035, 890.039, 890.124
See application file for complete search history.

(56) References Cited

U.S. PATENT DOCUMENTS

| | | | | | |
|---|---|---|---|---|---|
| 4,558,503 | A * | 12/1985 | Wilson | 29/446 |
| 5,720,536 | A * | 2/1998 | Jenkins et al. | 312/406.2 |
| 5,819,552 | A * | 10/1998 | Lee | 62/407 |
| 5,875,599 | A * | 3/1999 | McGrath et al. | 52/586.2 |
| 6,350,000 | B1 * | 2/2002 | Van Benthem et al. | 312/236 |
| 6,460,955 | B1 * | 10/2002 | Vaughan et al. | 312/401 |
| 6,463,743 | B1 | 10/2002 | Laliberte | |
| 6,655,766 | B2 * | 12/2003 | Hodges | 312/406.2 |
| 6,695,421 | B1 * | 2/2004 | Frase et al. | 312/409 |
| 7,596,956 | B2 | 10/2009 | Lilke | |
| 7,757,510 | B2 * | 7/2010 | Rosete et al. | 62/298 |
| 8,028,394 | B2 * | 10/2011 | Takaoka | 29/527.1 |
| 8,104,853 | B2 * | 1/2012 | Kim et al. | 312/405 |
| 8,220,204 | B2 * | 7/2012 | Lee et al. | 49/463 |
| 8,287,062 | B2 * | 10/2012 | Nash et al. | 312/408 |
| 2006/0196208 | A1 | 9/2006 | Zangari et al. | |
| 2007/0193280 | A1 | 8/2007 | Tuskiewicz et al. | |
| 2009/0308084 | A1 | 12/2009 | Kreutzer et al. | |

* cited by examiner

*Primary Examiner* — Mohammad M Ali
(74) *Attorney, Agent, or Firm* — Timothy A. Czaja; Annette M. Frawley

(57) ABSTRACT

Kits for constructing a modular merchandizing unit include panels, frame members, joint pieces, and a cooling device. The frame members have a lengthwise shape defining outer and inner panel mounting assemblies and a joint capture region. The mounting assemblies include opposing legs extending from a base web to define a panel engagement region. The joint pieces each include a block core and orthogonally arranged plug assemblies projecting from faces of the core. The plug assemblies mate with the joint capture region. Construction of a unit from the kit includes the frame members retaining selected panels as paired inner and outer panels within corresponding engagement regions. The joint pieces interconnect the frame members and paired panels to form a cabinet. The cooling device is mounted the cabinet. A door assembly can also be mounted to the cabinet. Optionally, foam insulation is dispensed between the paired panels.

25 Claims, 46 Drawing Sheets

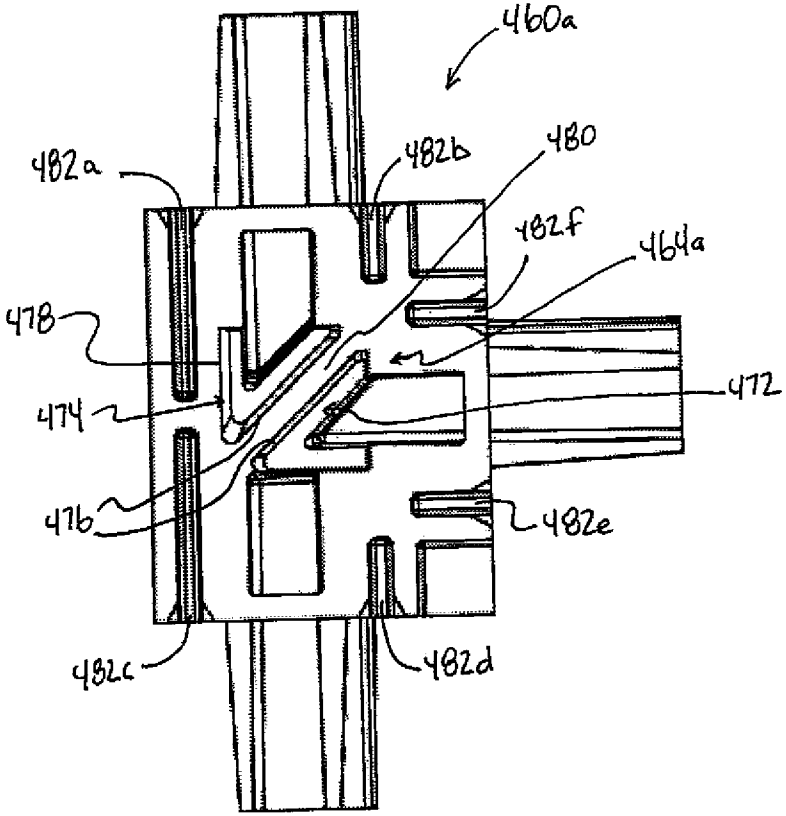
FIG. 14A
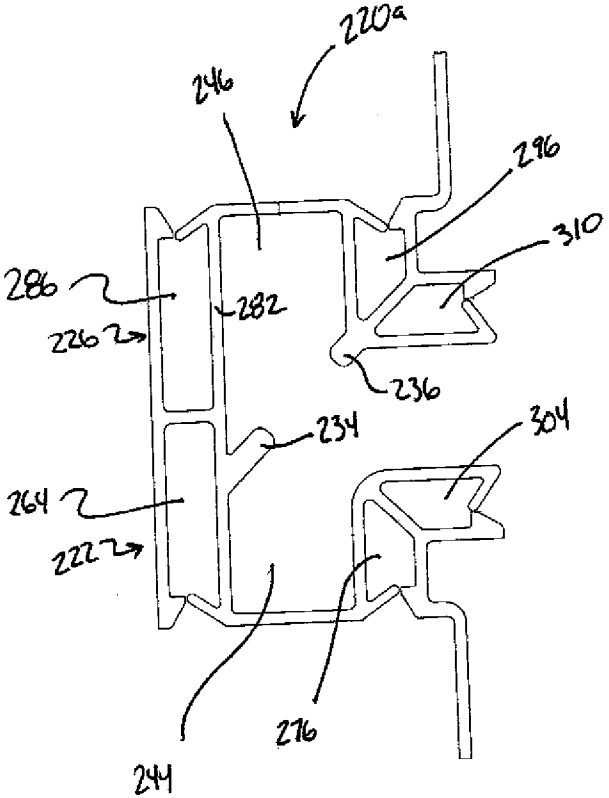

MODULAR COOLED PRODUCT MERCHANDIZING UNITS, KITS, AND METHODS OF MANUFACTURE

BACKGROUND

The present disclosure relates to cooled product merchandizing units. More particularly, it relates to modular cooled product merchandizing units assembled to a desired shape and size from a kit of parts.

Perishable and other food items are frequently displayed and sold at places of business (e.g. grocery or convenience stores, food courts, etc.). In many instances, the food items are maintained in inventory year-round and are often placed in a permanent merchandizing unit (e.g., large, glass door refrigerator or freezer). Other perishable food items are offered during promotions, and are better suited for presentation to customers in a temporary merchandizing unit. To this end, grocers and other sellers of food items have a need for temporary cooling units that are effective in safely cooling perishable food items. Similar needs arise for display of frozen food items.

One simple temporary merchandizing unit format is a disposable case containing ice packs and ice to cool the perishable items. Due to the limited cooling capacity, sellers disfavor this format. Another disincentive is the cost associated with their disposal.

As an alternative, small scale refrigerators or freezers can be employed as a temporary cooled merchandizing unit. However, this approach is disfavored due primarily to the expense and lack of portability. Compressor-based cooling units are typically fairly large and are not easily moved to different locations within a store.

More recently, thermoelectric-based temporary merchandizing units have been developed, and provide many benefits over vapor pressure refrigerators. For example, the thermoelectric cooling device can be arranged in different thermoelectric orientations as no refrigeration fluids are utilized, affording the ability to create more stylized merchandizing unit appearances. Further, thermoelectric-based systems are lighter, potentially less expensive, and have significant life spans due to a lack of moving parts.

Regardless of the type of cooling technology employed, cooled merchandizing units are conventionally available to grocers and other end users in either an upright configuration or a coffin configuration. With either style, the unit manufacturer may have several "standard" sizes available for purchase. In many instances, however, the standard styles and/or sizes are less than optimal for a particular end use application. For example, an end user may have limited floor space available for the cooled merchandizing unit; the standard styles and sizes available from the manufacturer may not exactly meet these requirements. Similarly, end users oftentimes envision uniquely shaped merchandizing units for certain products; again, the standard units available from manufacturers may not satisfy these desires.

While a manufacturer could undoubtedly design a "new" cooled merchandizing unit commensurate with a particular end user's desired style and size, the costs associated with such efforts are highly prohibitive. Designing and manufacturing/assembling a cooled merchandizing unit entails not only intensive research and development efforts, but also the costs of manufacturing tooling necessary to produce and assemble the unit's components. Typically, tooling for a powered cooled merchandizing unit is quite expensive, on the order of 250 thousand dollars. By mass producing and selling only a few "standard" unit configurations, these costs can be recouped at a per unit price that is economically viable for most end users. However, if only one or a small quantity of a particular "new" or specialized unit were to be sold, the per unit price necessary to cover the corresponding costs would well exceed what the end user is willing to pay. Oftentimes, this prevents an end user's "new" merchandizing unit vision from going any further.

In light of the above, a need exists for a modular cooled merchandizing unit, and kits and methods for manufacturing the same.

SUMMARY

Some aspects in accordance with principles of the present disclosure relate to a kit for constructing a modular cooled product merchandizing unit. The kit includes a plurality of panels, a multiplicity of extruded frame members, a multiplicity of molded joint pieces, and a cooling unit. The frame members each have a length between opposing ends and a continuous shape along the length. The shape defines an outer panel mounting assembly, an inner panel mounting assembly, and a joint capture region. The mounting assemblies each include opposing legs extending from a base web to define a panel engagement region. The mounting assemblies are arranged to retain two of the panels in a spaced apart, substantially parallel fashion. Further, the joint capture region is defined between the mounting assemblies. The joint pieces each include a block core and several plug assemblies. The block core forms first-sixth faces. First-third ones of the plug assemblies project from a respective one of the core faces, and each are configured to frictionally mate with one of the ends of a respective one of the frame members at the joint capture region thereof. With this construction, the kit is configured such that the frame members retain respective ones of the panels as paired inner and outer panels. The joint pieces interconnect the frame members and the walls to form a merchandizing cabinet. Finally, the cooling unit is mountable to a face of the cabinet (e.g., side, top, etc.), resulting in a modular cooled product merchandizing unit.

The kits of the present disclosure provide all components needed to create a cooled product merchandizing unit of virtually any size or style as desired by an end user. In this regard, the panels and the frame members can be cut to desired sizes and shapes based upon the desired end size and shape of the merchandizing unit. In some constructions, the kit further includes a source of expandable foam insulation that is dispensed between the paired inner and outer panels. In yet other embodiments, the kit includes a door assembly formed, in part, by extruded door frame members and molded door corner connectors that are configured for pivotable mounting with selected ones of the frame members of the resultant cabinet. In yet other embodiments, the multiplicity of frame members includes at least three different frame member formats, such as a corner frame member, a clip frame member, and a horizontal platform frame member. In related embodiments, the multiplicity of joint pieces includes three-way corner connectors and four-way corner connectors. The so-provided frame members and joint pieces are readily assembleable to one another (along with the panels) to define virtually any sized and shaped merchandizing unit desired.

Yet other aspects in accordance with the principles of the present disclosure relate to a method of constructing a modular cooled product merchandizing unit. The method includes receiving a multiplicity of the extruded frame members as described above. A desired size and shape of a cabinet of the merchandizing unit is determined, and selected ones of the frame members are selected based upon the determined size and shape of the cabinet. The selected frame members are assembled to one another using the joint pieces described above to form a cabinet frame. In this regard, the frame members and the joint pieces combine to demarcate the cabinet frame into a plurality of frame face regions. Panels are assembled to the inner and outer panel mounting assemblies of each of the frame members associated with at least some of the frame face regions to define closed face regions. In this regard, each of the closed face regions includes a pair of the panels maintained in a spaced apart, substantially parallel fashion. Finally, a door assembly and a cooling unit are assembled to the cabinet frame. Methods in accordance with principles of the present disclosure can be used to form either a coffin-style merchandizing unit or an upright-style merchandizing unit using the frame members and the joint pieces. In other embodiments, methods include selecting specific ones of the frame members to define a perimeter of a door opening, with the methods further including mounting of the door assembly to the door opening.

BRIEF DESCRIPTION OF THE DRAWINGS

FIGS. 14A and 14B illustrate coupling of the horizontal post frame member of FIG. 5 with the four-way corner connector of FIG. 8A;

DETAILED DESCRIPTION

Figure 1A:
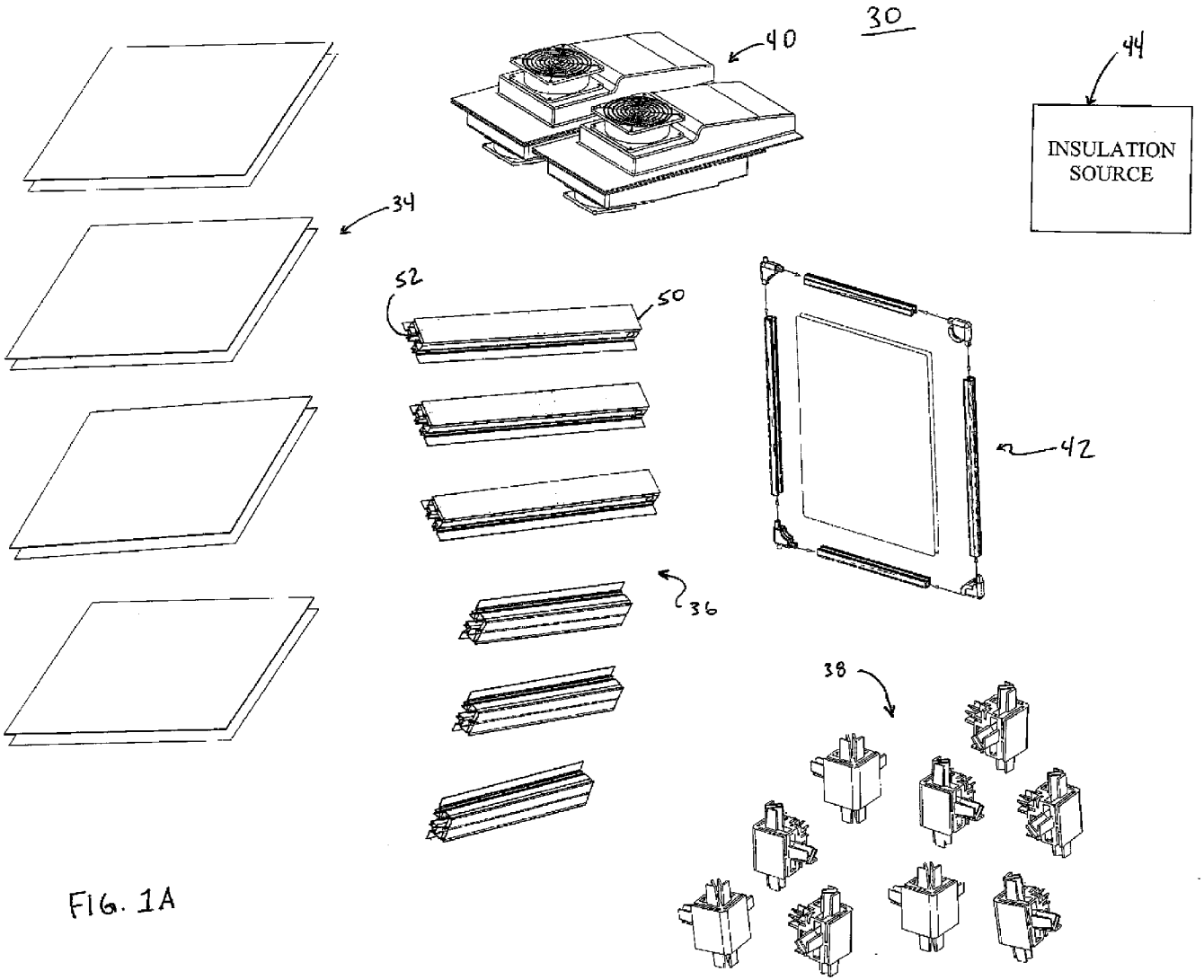
FIG. 1A is an exploded, perspective view of a kit in accordance with principles of the present disclosure for forming a modular cooled product merchandizing unit.

One embodiment of a kit 30 for constructing a modular cooled product merchandizing unit is shown in FIG. 1A. The kit 30 includes a plurality of panels 34, a multiplicity of frame members 36, a multiplicity of joint pieces 38, and a cooling unit 40. Details on the various components are provided below. In general terms, however, the frame members 36 are configured to retain respective pairs of the panels 34, and the joint pieces 38 are configured to interconnect selected ones of the frame members 36 to one another. In this regard, various ones of the frame members 36 can incorporate differing features that facilitate a desired construction format, as can the joint pieces 38. For example, certain ones of the frame members 36 can be selected to define a door opening perimeter configured to interface with an optional door assembly 42 provided with, or assembled from, the kit 30. Further, the kit 30 can include an optional source of insulation 44 (shown in block form), such as an expandable foam insulation, for dispensement between various ones of the assembled panels 34.

Figure 1B:
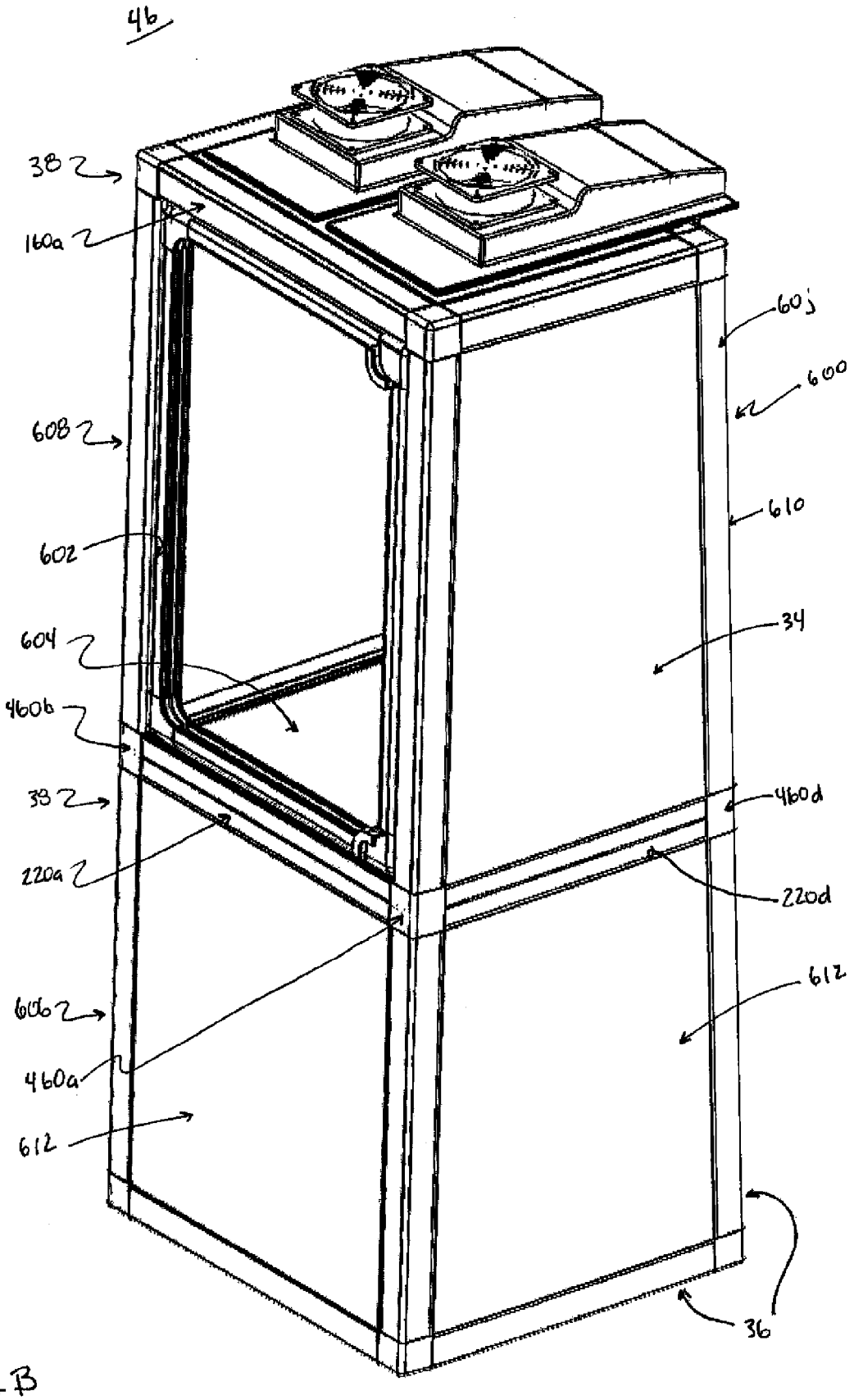
FIG. 1B is a perspective view of one example of a modular cooled product merchandizing unit constructed from the kit of FIG. 1A.
Figure 1C:
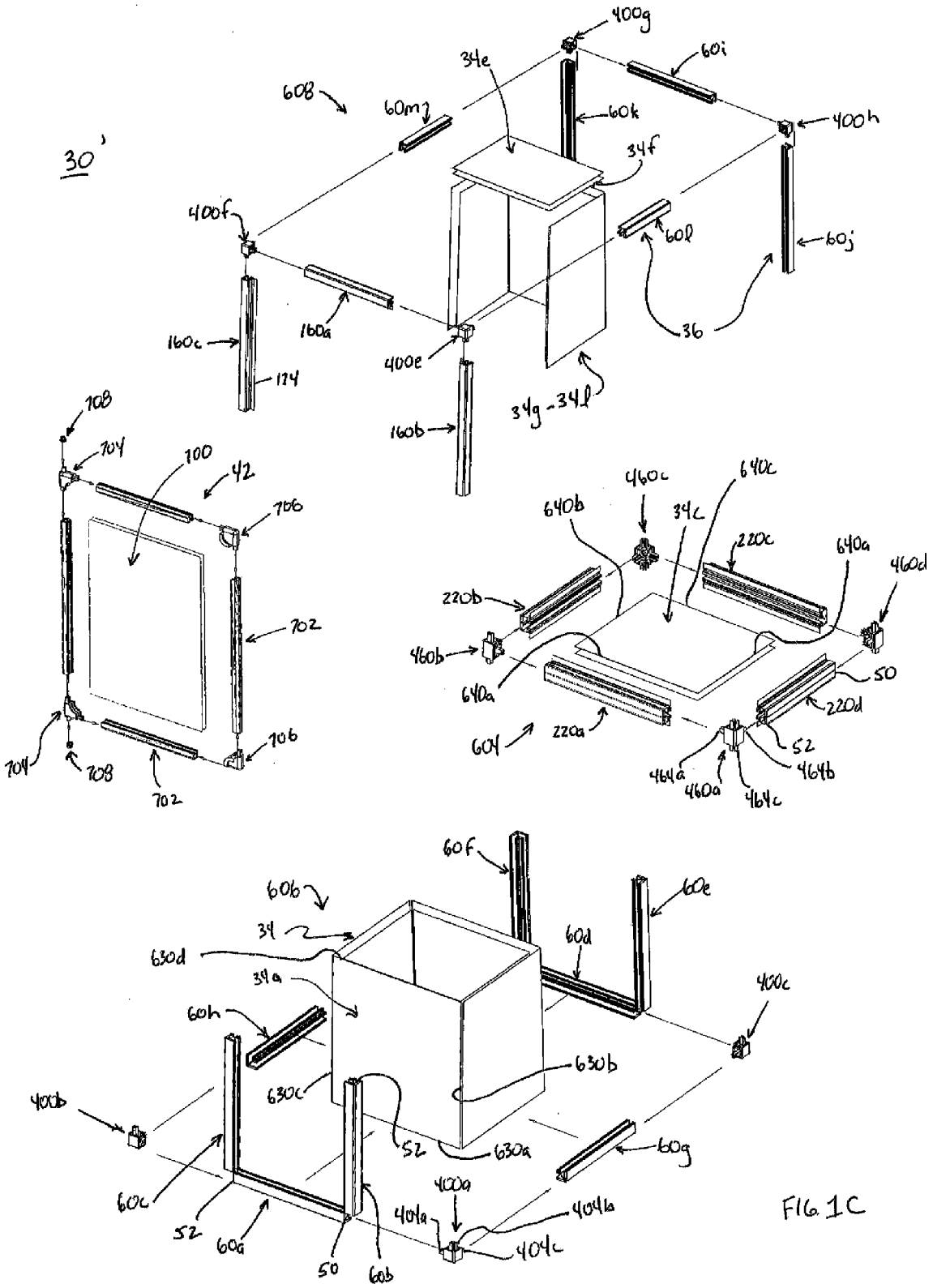
FIG. 1C is a perspective exploded view of the unit of FIG. 1B.

The kit 30 can be employed to create and construct a cooled merchandizing unit with virtually any desired style and size, and in a cost effective manner. For example, one non-limiting example of merchandizing unit 46 formed from the kit 30 is illustrated in FIG. 1B; FIG. 1C details an arrangement of various kit components 34-38 (referenced generally) in constructing the unit 46. It will be understood that the unit 46 of FIGS. 1B and 1C is but one example of a modular cooled merchandizing unit configuration available with kits of the present disclosure. While certain general design parameters are implicated by the components 34-38 (e.g., right angle-type corners and generally planar exterior faces), a plethora of different unit styles and sizes can alternatively be created. Thus, the merchandizing units envisioned by the present disclosure are modular. For ease of explanation, details of the kit components are provided below with reference to some of the specific features identified for the unit 46 of FIGS. 1B and 1C; however, the present disclosure is not limited to the unit 46 design. In more general terms, the panels 34, the frame members 36, and the joint pieces 38 are correspondingly configured to interface with one another in multiple different arrangements. While the frame members 36 and the joint pieces 38 can be provided in different formats with the kit 30, with each different format incorporates common mounting features that facilitate assembly of any one formatted frame member 36 with any one formatted joint piece 38. The panels 34, and different formats of the frame members 36 and the joint pieces 38 are described below, followed by explanations of modular unit construction.

Panels 34

With reference to FIGS. 1A-1C, the panels 34 can assume a variety of forms, and in some embodiments are formed of a cardboard, other paper-based material, plastic, metal, wood, or other rigid or semi-rigid material(s) and combinations thereof. The panels 34 can be provided with the kit 30 in a pre-cut form to the sizes and shapes generally reflected in the view of FIGS. 1B and 1C. In other embodiments, however, larger versions of the panels 34 can be provided with the kit 30, with individual ones of the panels 34 later being cut by a user to desired shapes and sizes when constructing the particular merchandizing unit 46. Regardless, the panels 34 are planar or flat, and have a uniform thickness, for example in the range of 24 pt (for paperboard-type panels) to 0.1 inch.

Frame Member Formats

The frame members 36 are extruded plastic components, for example extruded polypropylene, polyethylene, polycarbonate, polylactic acid, nylon, polyvinyl chloride, polyethylene, terephthalate, polymeric blends or hybrids, mineral-filled injection molded grade polymers, etc. As previously mentioned, the frame members 36 as provided with the kit 30 can have different formats, or can be identical. In general terms, each of the frame members 36 incorporates features for engaging and retaining at least one pair of the panels 34 in a substantially parallel arrangement (e.g., within 5° of a truly parallel arrangement), with these features being referenced as "panel mounting assemblies" below. Further, each of the frame members 36 provides a mating feature at opposing ends 50, 52 thereof (referenced for one of the frame members 36 in FIG. 1A) that facilitates connection with a corresponding feature provided with the corner pieces 38, such as "guide shoulders" and "joint capture regions" as described below. In some embodiments, the frame member formats included with the kit 30 include corner frame members, clip frame members, horizontal post frame members, and vertical post frame members. Regardless, the frame members 36, as initially provided with the kit 30, can have identical lengths selected to be longer than expected for any particular end unit design, with individual ones of the frame members 36 later being cut to desired lengths by a user during assembly. Alternatively, various ones of the frame members 36 can be pre-cut to different, standard lengths.

Corner Frame Member 60

Figure 2:
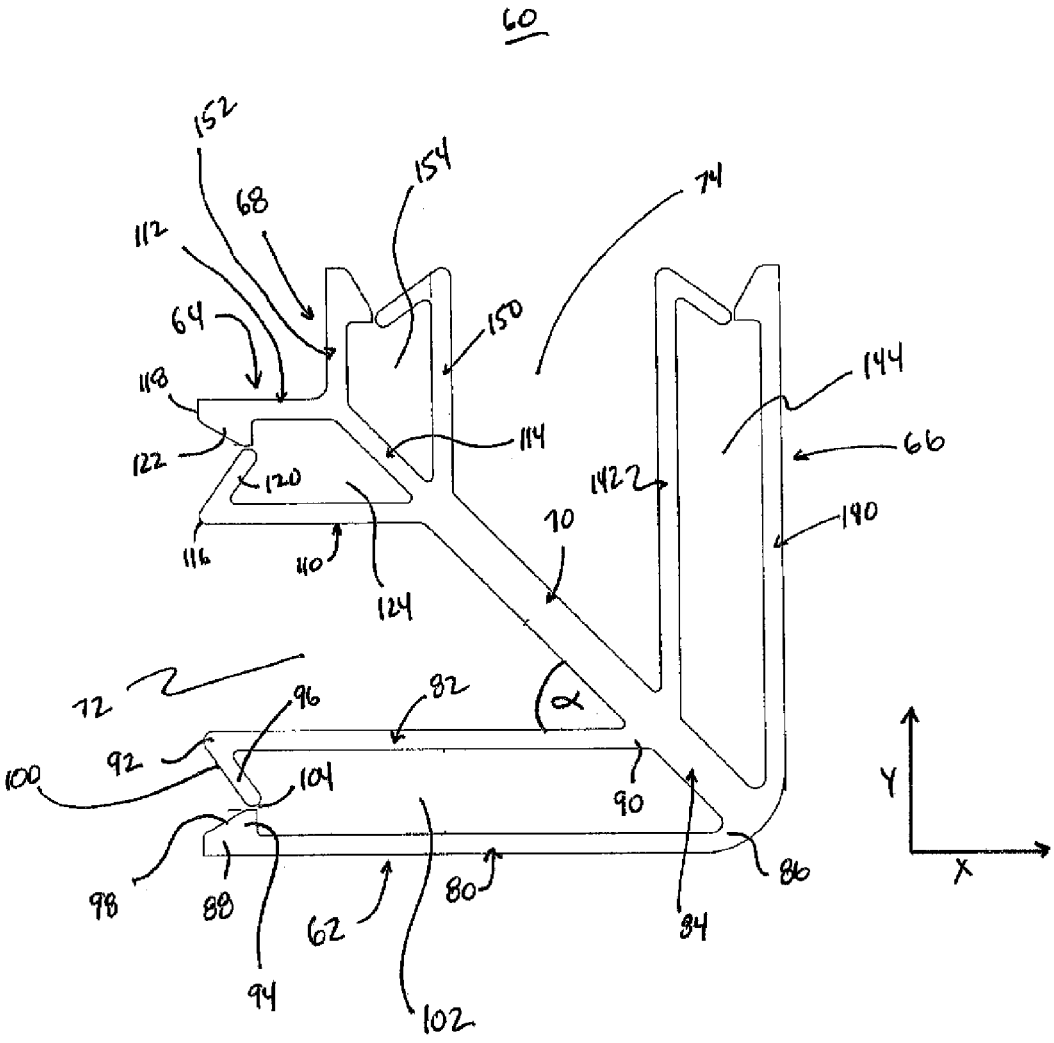
FIG. 2 is an end view of a corner frame member component useful with some embodiments of the kit of FIG. 1A.

FIG. 2 is an end view of a corner or "default" frame member 60 otherwise useful as one of the kit frame members 36 (FIG. 1A). The corner frame member 60 shape reflected in FIG. 2 is substantially uniformly defined along an entire length thereof. More particularly, the corner frame member 60 is extruded to form a first outer panel mounting assembly 62, a first inner panel mounting assembly 64, a second outer panel mounting assembly 66, and a second inner panel mounting assembly 68. The mounting assemblies 62-68 are similar in construction, and are generally configured to receive and frictionally retain a portion of a selected one of the panels 34 (FIG. 1A). A guide shoulder or web 70 interconnects the outer mounting assemblies 62, 66 with the inner mounting assemblies 64, 68. Further, a first joint capture region or gap 72 is defined between the first mounting assemblies 62, 64, and a second joint capture region 74 is defined between the second mounting assemblies 66, 68. The guide shoulder 70 and joint capture regions 72, 74 are collectively configured to interface with corresponding, common mounting features of the joint pieces 38 (FIG. 1A) as described below.

The first outer panel mounting assembly 62 includes a first or exterior leg 80, a second or interior leg 82, and an outer panel base web 84. The first leg 80 includes or defines a fixed end 86 and an opposing free end 88; the second leg 82 similarly defines a fixed end 90 and a free end 92. The fixed ends 86, 90 are attached to or contiguous with the outer panel base web 84, such that the legs 80, 82 are slightly deflectable relative to the base web 84 at a pivot point effectively established at the corresponding fixed end 86, 90. In the normal or undeflected state of FIG. 2, however, the legs 80, 82 extend in a substantially parallel fashion (e.g., within 5° of a truly parallel relationship) from the base web 84. The first leg free end 88 forms a tab 94 that projects generally transversely toward the second leg 82. The second leg free end 92 also includes or forms a tab 96 projecting generally transversely toward the first leg 80. The first leg tab 94 can be thicker than the second leg tab 96 as shown; alternatively, the tabs 94, 96 can have identical constructions. Regardless, and for reasons made clear below, an outer face 98, 100, respectively, of each of the tabs 94, 96 can have a rearward angle of extension or slope (i.e., projecting not only transversely toward the opposing leg 80, 82 but also toward the base web 84).

Figure 3A:
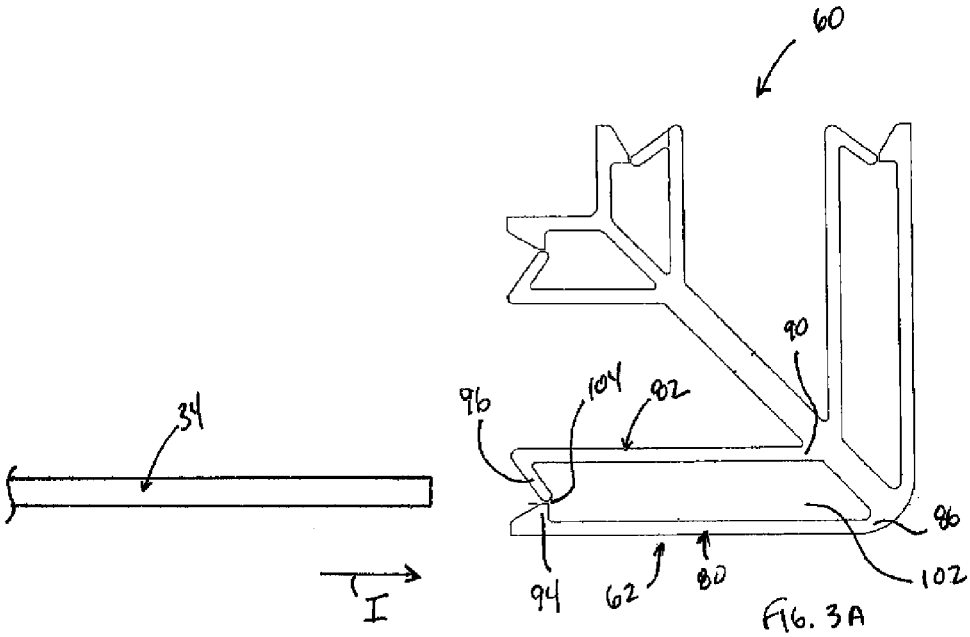
FIGS. 3A and 3B are end views illustrating assembly of a panel to the corner frame member of FIG. 2.
Figure 3B:
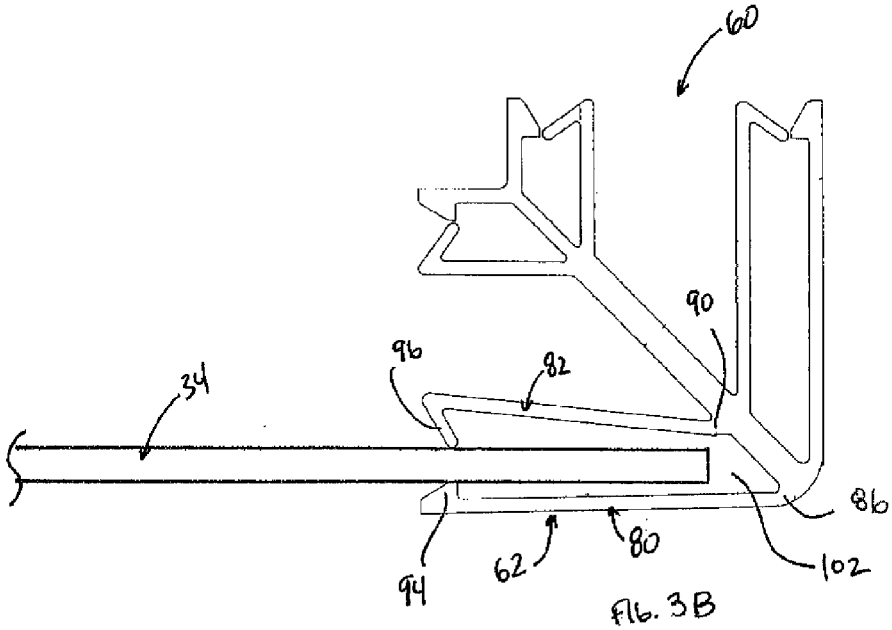

A panel engagement region 102 is defined between the legs 80, 82, terminating at the outer panel base web 84. A transverse dimension (i.e., perpendicular to the planes of the legs 80, 82) of the panel engagement region 102 is relatively uniform from the fixed ends 86, 90 toward the free ends 88, 92, and is generally commensurate with (e.g., slightly larger than) a thickness of each of the panels 34 (FIG. 1A), for example on the order of 0.25 inch. A gap 104, if any, defined between the tabs 94, 96 (in the normal or undeflected state of FIG. 2) is less than the transverse dimension of a remainder of the panel engagement region 102, and is less than the panel thickness. With additional reference to FIGS. 3A and 3B, the first outer panel mounting assembly 62 receives and retains one of the panels 34 with insertion of the panel 34 into the panel engagement region 102. The tabs 94, 96 frictionally contact and engage the panel 34, with a thickness of the panel 34 causing one or both of the legs 80, 82 to deflect transversely away from the other (effectively pivoting at the corresponding fixed end 86, 90). The sloped angle of extension associated with the tabs 94, 96 promotes insertion of the panel 34 through the gap 104 (FIG. 3A) and into the panel engagement region 102 in the insertion direction I (FIG. 3A). However, the tabs 94, 96 frictionally resist removal of the panel 34 from the panel engagement region 102.

Returning to FIG. 2, the first inner panel mounting assembly 64 is, in many respects, identical to the first outer panel mounting assembly 62 described above. For example, a first or exterior leg 110 and a second or interior leg 112 extend from an inner panel base web 114 in a substantially parallel fashion (e.g., within 5° of a truly parallel relationship) in the normal or undeflected state shown. The legs 110, 112 each terminate at a free end 116, 118, respectively, that forms a corresponding tab 120, 122. Further, a panel engagement region 124 is defined between the legs 110, 112. The inner panel mounting assembly 64 is thus configured to receive and retain an edge portion one of the panels 34 (FIG. 1A) as described above.

The legs 80, 82 of the first outer panel mounting assembly 62 are substantially parallel (e.g., within 5° of a truly parallel relationship) with the legs 110, 112 of the first inner panel mounting assembly 64 in the normal or undeflected state, such that a panel inserted into the panel engagement region 124 of the inner panel mounting assembly 64 will be retained in a substantially parallel arrangement (e.g., with 5° of a truly parallel arrangement) with a panel captured by the first outer panel mounting assembly 62. The corner frame member 60 can be dimensioned such that the free ends 88, 92, 116, 118 of the first outer and inner panel mounting assembly legs 80, 82, 110, 112 are substantially coplanar. With embodiments in which the guide shoulder 70 extends at an angle α of less than 90° from the first outer panel mounting assembly legs 80, 82, then, a length of the inner mounting assembly panel legs 110, 112 (i.e., dimension parallel with the X axis labeled in FIG. 2) is less than those of the outer panel mounting assembly legs 80, 82. In some embodiments, the extension angle α is approximately 45°.

The first joint capture region 72 is defined as a transverse gap between the first outer and inner panel mounting assemblies 62, 64, and in particular between the interior leg 82 of the outer panel mounting assembly 62 and the exterior leg 110 of the inner panel mounting assembly 64. For reasons made clear below, the joint capture region 72 is transversely dimensioned in accordance with a corresponding, common feature of the joint pieces 38 (FIG. 1A) to facilitate coupling of one of the joint pieces 38 with the corner frame member 60.

The second outer panel mounting assembly 66 can be identical to the first outer panel mounting assembly 62, and includes a first or exterior leg 140 and a second or interior leg 142 extending from the outer panel base web 84 to form a panel engagement region 144 commensurate with the above descriptions. The legs 140, 142 of the second outer panel mounting assembly 66 are substantially perpendicular with the first outer panel mounting assembly legs 80, 82 (e.g., within 5° of a truly perpendicular relationship in the undeflected state). Similarly, the second inner panel mounting assembly 68 can be identical to the first inner panel mounting assembly 64, and includes first and second legs 150, 152 projecting from the inner panel base web 124 to form a panel engagement region 154 commensurate with the above descriptions. The second inner panel mounting assembly legs 150, 152 are substantially perpendicular with the legs 110, 112 of the first inner panel mounting assembly 64 in the undeflected state. With this arrangement, the second outer and inner panel mounting assemblies 66, 68 can receive and retain two of the panels 34 (FIG. 1A) in a substantially parallel manner (e.g., within 5 degrees of a truly parallel relationship) alone or when coupled with other components such as joint pieces 38 and other frame members 36. Finally, the second joint capture region 74 is defined as a transverse gap between the legs 142, 150 of the mounting assemblies 66, 68.

The corner frame member 60 can be symmetrical relative to a central plane of the guide shoulder web 70, with the inner and outer panel base webs 84, 114 being aligned with the guide shoulder 70. Regardless, a thickness of the guide shoulder 70 and angle relative to the panel mounting assemblies 62-68 corresponds with an engagement feature commonly provided with the joint pieces 38 (FIG. 1A) as described below.

The extruded shape of the corner frame member 60 is uniformly maintained along an entire length of the corner frame member 60. In other words, the above described features exist at both of the opposing ends 50, 52 (FIG. 1A) of the corner frame member 60, as well as along a length thereof Clip Frame Member 160

Figure 4:
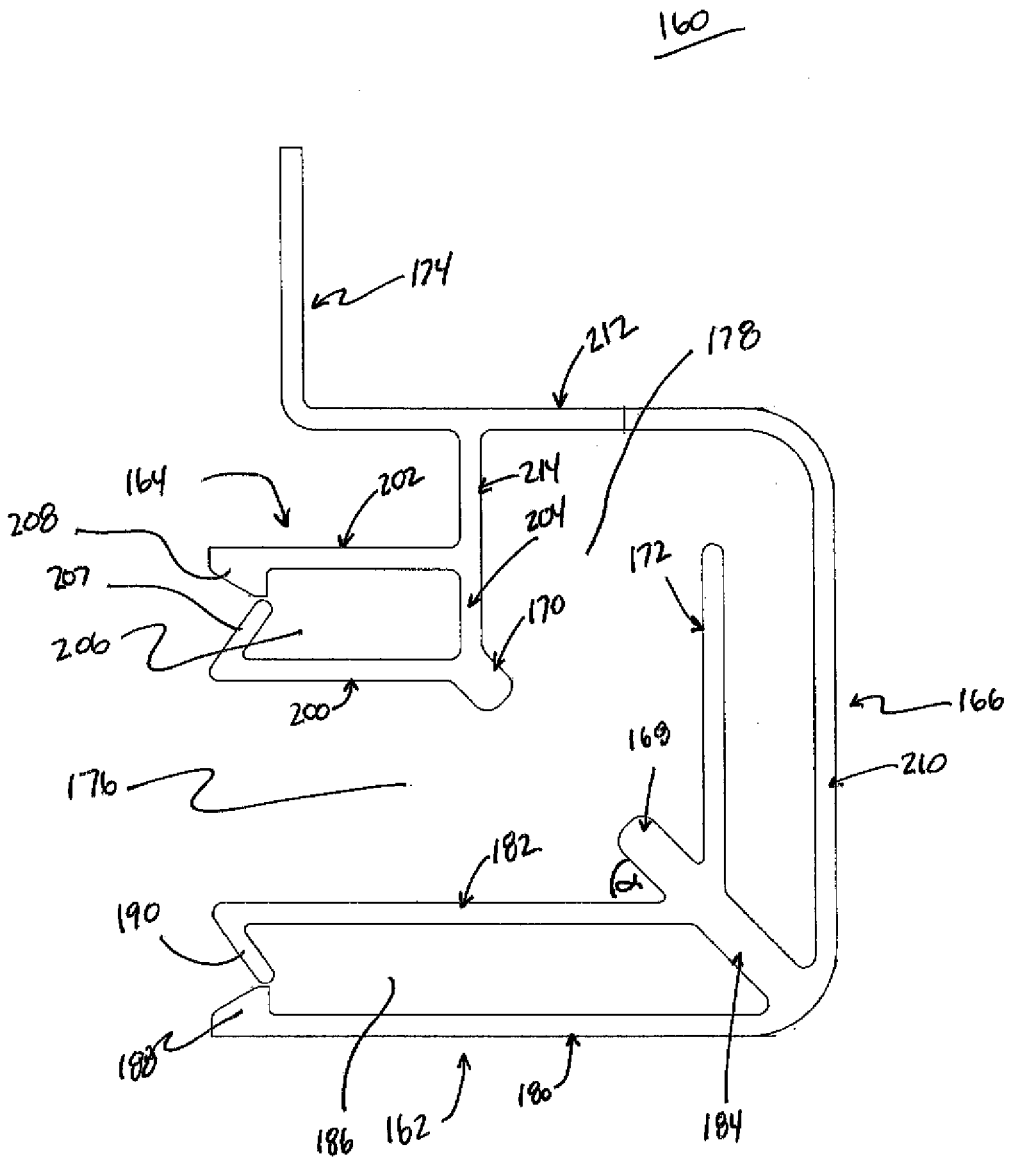
FIG. 4 is an end view of a clip frame member useful with some embodiments of the kit of FIG. 1A.

Returning to FIG. 1A, and with additional reference to FIG. 4, another frame member configuration useful with the kits 30 of the present disclosure is an extruded clip frame member 160. In some respects, the clip frame member 160 is akin to the corner frame member 60 (FIG. 2), and includes an outer panel mounting assembly 162 and an inner panel mounting assembly 164. In addition, the clip frame member 160 includes a connection web 166, first and second guide shoulders 168, 170, a support web 172, and a flange 174. Finally, first and second joint capture regions or gaps 176, 178 are formed.

The outer panel mounting assembly 162 can be identical to the first outer panel mounting assembly 62 (FIG. 2) described above with respect to the corner frame member 60 (FIG. 2), and includes a first or exterior leg 180 and a second or interior leg 182 projecting in a substantially parallel fashion (in the normal or undeflected state of FIG. 4) from an outer panel base web 184. As with previous embodiments, a transverse spacing between the legs 180, 182 defines a panel engagement region 186, with one or both of the legs 180, 182 optionally forming a sloped, inwardly projecting tab 188, 190, respectively, that is sized and arranged to receive and frictionally capture an edge portion of one of the panels 34 (FIG. 1A) within the engagement region 186.

The inner panel mounting assembly 164 can be identical to the first inner panel mounting assembly 64 (FIG. 2) described above with respect to the corner frame member 60 (FIG. 2), and includes first and second legs 200, 202 extending in a substantially parallel manner (in the undeflected state) from an inner panel base web 204. Once again, a transverse spacing between the legs 200, 202 establishes a panel engagement region 206, with one or both of the legs 200, 202 optionally forming a sloped, inwardly projecting tab 207, 208 at a free end thereof.

The inner and outer mounting assemblies 162, 164 are arranged relative to one another to receive and retain two of the panels 34 (FIG. 1A) in a substantially parallel fashion (e.g., within 5° of truly parallel relationship) either alone or when the clip frame member 160 is coupled with other components such as the joint pieces 38 (FIG. 1A). That is to say, the legs 180, 182, 200, 202 are substantially parallel with one another (in at least the normal or undeflected state of FIG. 4). Finally, the first joint capture region 176 is defined as a transverse gap between the second leg 182 of the outer panel mounting assembly 162 and the inner panel mounting assembly first leg 200. The joint capture region 176 is sized in accordance with a common mounting feature provided with the joint pieces 38 (FIG. 1A) as described below.

The connection web 166 interconnects the outer panel mounting assembly 162 with the inner panel mounting assembly 164, and establishes the substantially parallel relationship therebetween. For example, the connection web 166 includes a first segment 210 extending from the outer panel base web 184 in a direction substantially perpendicular with the outer panel mounting assembly legs 180, 182. A second segment 212 extends horizontally (relative to the orientation of FIG. 4) from the first segment 210, with the second segment 212 being substantially perpendicular to the first segment 210. The flange 174 extends from the second segment 212 opposite the first segment 210 in a direction away from the inner panel mounting assembly 164 (e.g., substantially perpendicular to the first segment 210). Finally, a third segment 214 extends from the second segment 212 at a location spatially between the flange 174 and the first segment 210. As shown, the third segment 214 projects toward the outer panel mounting assembly 162, and locates the inner panel mounting assembly 164 so as to establish the first joint capture region 176 described above.

The first guide shoulder 168 is akin to the guide shoulder 70 (FIG. 2) described above with respect to the corner frame member 60 (FIG. 2), and extends inwardly from the outer panel mounting assembly 162. In particular, relative to the planes established by the outer panel mounting assembly legs 180, 182, projection of the first guide shoulder 168 forms the angle $\alpha$ described above that can be on the order of 45°. A thickness of the first retention shoulder 168 corresponds with a common mounting feature provided with the joint pieces 38 (FIG. 1A) as described below. The second guide shoulder 170 projects outwardly from the inner panel mounting assembly 164, and is aligned with the first guide shoulder 168. While the guide shoulders 168, 170 can be spaced from one another as shown, in other constructions, a homogenous web can be employed (e.g., akin to the singular guide shoulder 70 of FIG. 2).

The support web 172 extends from the outer panel base web 184 in a direction substantially perpendicular with the outer panel mounting assembly legs 180, 182. The support web 172 provides a surface for interfacing with a common mounting feature provided with the joint pieces 38 (FIG. 1A). A transverse gap between the support web 172 and the third segment 214 of the connection web 166 defines the second joint capture region 178. In other embodiments, the support web 172 can be omitted.

The flange 174 extends from the connection web 166 in a direction opposite the outer and inner mounting assemblies 162, 164, and is laterally offset from a common plane established by the free ends of the legs 180, 182, 200, 202. As described below, the flange 174 provides a bearing surface against which the door assembly 42 (FIG. 1A), or other components of the assembled cooled product merchandizing unit 46 (FIG. 1B), can be selectively received.

The extruded format of the clip frame member 160 establishes each of the features described above at the opposing ends (e.g., the ends 50, 52 identified in FIG. 1A), as well as along an entire length thereof. That is to say, the clip frame member 160 shape reflected in FIG. 4 is substantially uniformly defined along an entire length thereof.

Horizontal Post Frame Member 220

Figure 5:
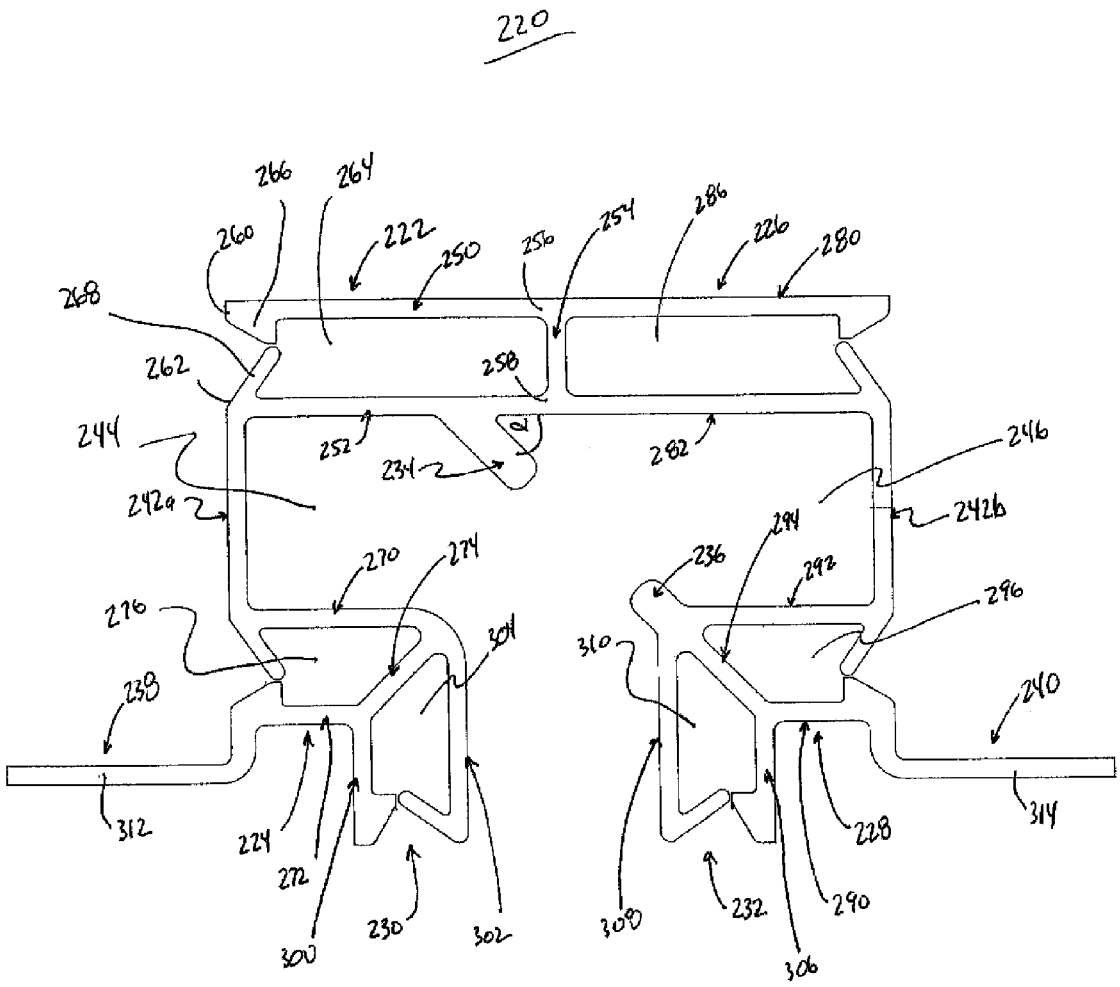
FIG. 5 is an end view of a horizontal post frame member useful with some embodiments of the kit of FIG. 1A.

With reference to FIGS. 1A and 5, a horizontal post frame member 220 can be included as one or more of the frame members 36 of the kit 30. The horizontal post frame member 220 is extruded to form or define a first outer panel mounting assembly 222, a first inner panel mounting assembly 224, a second outer panel mounting assembly 226, a second inner panel mounting assembly 228, a first platform mounting assembly 230, and a second platform mounting assembly 232. In addition, first and second guide shoulders 234, 236 are provided, as are first and second flanges 238, 240. Finally, a first connection web 242*a* interconnects the first panel mounting assemblies 222, 224 to generate a first joint capture region 244; similarly, a second connection web 242*b* interconnects the second panel mounting assemblies 226, 228 to generate a second joint capture region 246.

The first outer panel mounting assembly 222 is akin to the panel mounting assemblies previously described, and includes a first or exterior leg 250 and a second or interior leg 252 extending from an outer panel base web 254. With this construction, then, each of the legs 250, 252 has a fixed end 256, 258 and a free end 260, 262, respectively. In the normal or undeflected state of FIG. 5, the legs 250, 252 are substantially parallel (e.g., within 5° of a truly parallel relationship) in extension from the corresponding fixed end 256, 258, and are laterally spaced from one another to define a panel engagement region 264. Inwardly angled or sloped retention tabs 266, 268 are optionally formed at the corresponding free ends 260, 262, respectively, and can assume any of the forms previously described. As with previous embodiments, the panel engagement region 264 is sized in accordance with (e.g., slightly greater than) a thickness of the panels 34 (FIG. 1A), with the retention tabs 266, 268 serving to frictionally retain an edge portion of a selected one of the panels 34 within the engagement region 264 (along with deflection of one or both of the legs 250, 252).

The first inner panel mounting assembly 224 is akin to previous embodiments and includes a first leg 270 and a second leg 272 extending in a spaced apart, substantially parallel fashion (in the undeflected state shown) from a first inner panel base web 274. A transverse spacing between the legs 270, 272 establishes a panel engagement region 276 sized to selectively receive and retain one of the panels 34 (FIG. 1A) commensurate with previous descriptions.

The first connection web 242*a* interconnects the first outer and inner panel mounting assemblies 222, 224 to establish the first joint capture region 244 as a transverse gap between the interior leg 252 of the first outer panel mounting assembly 222 and the exterior leg 270 of the first inner panel mounting assembly 224. The first joint capture region 244 is sized to receive a corresponding fastener commonly provided with the joint pieces 38 (FIG. 1A). Further, the first connection web 242*a* arranges the legs 250, 252, 270, 272 to be substantially parallel (e.g., within 5° of a truly parallel relationship) in the normal or undeflected state of FIG. 5. With this construction, two of the panels 34 (FIG. 1A) can be retained by the first outer and inner panel mounting assemblies 222, 224 in a substantially parallel manner by the horizontal post frame member 220 alone, or when combined with other components such as one of the joint pieces 38.

The second outer panel mounting assembly 226 can be identical to the first outer panel mounting assembly 222, and includes first and second legs 280, 282 extending from the outer panel base web 254. The legs 280, 282 are substantially parallel in the undeflected state and combine to define a panel engagement region 286 commensurate with previous descriptions. In this regard, the legs 280, 282 of the second outer panel mounting assembly 226 project from the base web 254 in a direction opposite the first outer panel mounting assembly legs 250, 252, with the exterior legs 250, 280 being aligned with one another, and the interior legs 252, 282 being aligned with one another.

The second inner panel mounting assembly 228 can be identical to the first inner panel mounting assembly 224, and includes first and second legs 290, 292 extending from a second inner panel base web 294 in a substantially parallel fashion in the undeflected state to define a panel engagement region 296 commensurate with previous descriptions. As shown, the second inner panel mounting assembly legs 290, 292 can be substantially coplanar with the first inner panel mounting assembly legs 270, 272, and can also be substantially parallel with the second outer panel mounting assembly legs 280, 282.

The second connection web 242*b* connects the second outer and inner panel mounting assemblies 226, 228, and establishes the second joint capture region 246 therebetween. Further, the second connection web 242*b* arranges the second panel mounting assembly legs 280, 282, 290, 292 to be substantially parallel (in the normal or undeflected state of FIG. 5). Thus, two of the panels 34 (FIG. 1) can be retained by the second outer and inner panel mounting assemblies 226, 228 in a substantially parallel manner by the horizontal post frame member 220 alone, or when combined with other components such as one of the joint pieces 38 (FIG. 1A).

The first platform mounting assembly 230 is formed adjacent the first inner panel mounting assembly 224, and includes first and second legs 300, 302 extending from the first inner panel base web 274 to define a panel engagement region 304. The second platform mounting assembly 232 is identical to the first platform mounting assembly 230, but is formed adjacent the second inner panel mounting assembly 228. Thus, the second platform mounting assembly 232 includes first and second legs 306, 308 extending from the second panel base web 294 to define a panel engagement region 310. As with the panel mounting assembly legs described above, the platform mounting assemblies 230, 232 are constructed to receive and retain a respective one of the panels 34 (FIG. 1A) via the corresponding panel engagement region 304, 310. In the normal or undeflected state of FIG. 5, then, the first platform mounting assembly legs 300, 302 are substantially parallel with one another (e.g., within 5° of a truly parallel relationship), as are the legs 306, 308 of the second platform mounting assembly 232. Further, the platform mounting assembly legs 300, 302, 306, 308 are arranged substantially perpendicular relative to the legs of the panel mounting assemblies 222-228 in the normal or undeflected state of FIG. 5.

The first guide shoulder 234 projects inwardly from the interior leg 252 of the first outer panel mounting assembly 222 at the extension angle $\alpha$ (relative to the plane of the interior leg 252). As with previous embodiments, the extension angle $\alpha$ can be on the order of 45°. The second guide shoulder 236 projects outwardly from the exterior leg 290 of the second inner panel mounting assembly 228, and is aligned with the first guide shoulder 234. The guide shoulders 234, 236 are sized and shaped for attachment to a mounting feature commonly provided with the joint pieces 38 (FIG. 1A). In other embodiments, the guide shoulders 234, 236 can be formed as a single, homogenous structure.

The first flange 238 projects outwardly from the interior leg 272 of the first inner panel mounting assembly 224 in a direction opposite the first platform mounting assembly 230. The first flange 238 forms a flange body 312 that is substantially parallel with the first inner panel mounting assembly legs 270, 272 in the normal or undeflected stated of FIG. 5. The flange body 312 is offset from the first inner panel mounting assembly 224 in a direction opposite the first outer panel mounting assembly 222, and extends outwardly beyond the first connection web 242*a*. Similarly, the second flange 240 projects outwardly from the interior leg 292 of the second inner panel mounting assembly 238 in a direction opposite the second platform mounting assembly 232. The second flange 240 includes a flange body 314 that is arranged relative to the second inner panel mounting assembly 228 in a manner identical to the above descriptions of the first flange 238 relative to the first inner panel mounting assembly 224. For reasons made clear below, the flange bodies 312, 314 provide a bearing surface against which other components of the cooled merchandizing unit 46 (FIG. 1B) can selectively abut.

The extruded format of the horizontal post frame member 220 establishes the above-described features along an entire length of the horizontal post frame member 220, including at the opposing ends thereof (e.g., at the ends 50, 52 identified in FIG. 1A). That is to say, the horizontal post frame member 220 shape reflected in FIG. 5 is substantially uniformly defined along an entire length thereof.

Vertical Post Frame Member 320

Figure 6:
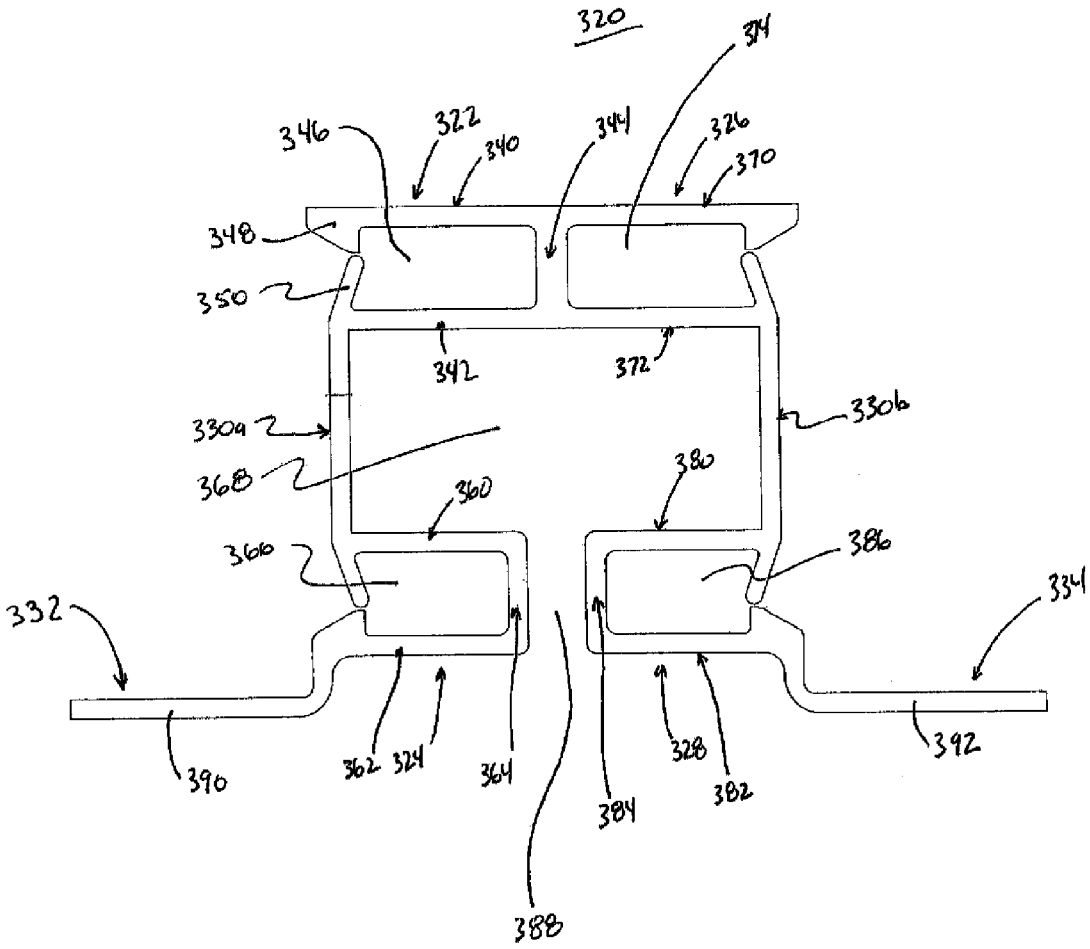
FIG. 6 is an end view of a vertical post frame member useful with some embodiments of the kit of FIG. 1A.

FIG. 6 illustrates a vertical post frame member 320 optionally included with the frame members 36 (FIG. 1A) of the kits 30 (FIG. 1A) of the present disclosure. The vertical frame post 320 is akin to the horizontal post frame member 220 (FIG. 5) described above and includes a first outer panel mounting assembly 322, a first inner panel mounting assembly 324, a second outer panel mounting assembly 326, and a second inner panel mounting assembly 328. A first connection web 330*a* extends between and connects the first outer and inner panel mounting assemblies 322, 324, whereas a second connection web 330*b* extends between and connects the second panel mounting assemblies 326, 328. Finally, the vertical post member 320 forms first and second flanges 332, 334.

As with previous embodiments, the first outer panel mounting assembly 322 includes first and second legs 340, 342 projecting from an outer panel base web 344. In the normal or undeflected state of FIG. 6, the legs 340, 342 are substantially parallel (e.g., within 5° of a truly parallel relationship), and a transverse spacing therebetween forms a panel engagement region 346. A sloped, inwardly projecting tab 348, 350 are optionally formed at a free end, respectively, of one or both of the legs 340, 342, with the tabs 348, 350 configured to frictionally engage an edge portion of one of the panels 34 (FIG. 1A) inserted into the panel engagement region 346.

The first inner panel mounting assembly 324 is akin to previous embodiments, and includes first and second legs 360, 362 extending in a spaced apart, substantially parallel fashion (in the undeflected state) from a first inner panel base web 364. A panel engagement region 366 is established between the opposing legs 360, 362, and is sized and shaped to receive an edge portion one of the panels 34 (FIG. 1A).

The first connection web 330*a* interconnects the first panel mounting assemblies 322, 324 such that the legs 340, 342, 360, 362 are substantially parallel (in the normal or undeflected state of FIG. 6). Thus, a panel assembled to the first outer panel mounting assembly 322 will be substantially parallel with a panel assembled to the first inner panel mounting assembly 324. Further, the first connection web 330*a* establishes a portion of a first joint capture region 368 as a transverse gap between the interior leg 342 of the first outer panel mounting assembly 322 and the exterior leg 360 of the first inner panel mounting assembly 324. The first joint capture region 368 is sized to receive a mounting feature commonly provided with the joint pieces 38 (FIG. 1A), including an optional tee connector, as described below.

The second outer and inner panel mounting assemblies 326, 328 are mirror images of the first panel mounting assemblies 322, 324, respectively. The second outer panel mounting assembly 326 includes first and second legs 370, 372 extending in a substantially parallel fashion (in the undeflected state) from the outer panel base web 344 in a direction opposite the legs 340, 342 of the first outer panel mounting assembly 322 to establish a panel engagement region 374. As shown, the first and second outer panel mounting assembly exterior legs 340, 370 are substantially co-planar in the normal or undeflected state of FIG. 6, as are the interior legs 342, 372. The second inner panel mounting assembly 328 includes first and second legs 380, 382 extending in a substantially parallel fashion (in the undeflected state) from a second inner panel base web 384 to establish a panel engagement region 386. The second connection web 330*b* arranges the second outer and inner panel mounting assemblies 326, 328 to receive and retain two of the panels 34 (FIG. 1A) in a spaced apart, substantially parallel fashion consistent with previous explanations.

The inner panel mounting assemblies 324, 328 are configured and arranged, via the connection webs 330*a*, 330*b*, to define a second joint capture region 388 as a lateral gap between the inner panel base webs 364, 384. The second joint capture region 388 is open to the first joint capture region 368 and is configured to receive a mounting feature provided with an optional tee connector (not shown) as described below. In other embodiments, the second joint capture region 388 can be omitted.

The first flange 332 projects outwardly from the interior leg 362 of the first inner panel mounting assembly 324 in a direction opposite the first inner panel base web 364. The first flange 332 forms a flange body 390 that is substantially parallel (e.g., within 5° of a truly parallel relationship) with the first inner panel mounting assembly legs 360, 362 in the normal or undeflected state of FIG. 6. The flange body 390 is offset from the first inner panel mounting assembly 324 in a direction opposite the first outer panel mounting assembly 322, and extends outwardly beyond the first connection web 330*a*. Similarly, the second flange 334 projects outwardly from the interior leg 382 of the second inner panel mounting assembly 328 in a direction opposite the second inner panel base web 384. The second flange 334 includes a flange body 392 that is arranged relative to the second inner panel mounting assembly 328 in a manner identical to the above descriptions of the first flange 332 relative to the first inner panel mounting assembly 324. The flange bodies 390, 392 are substantially coplanar, and provide a bearing surface against which other components of the merchandizing unit 46 (FIG. 1B) can selectively abut.

The extruded form of the vertical post frame member 320 establishes each of the above-described features along an entire length of the frame member 320, including at the opposing ends thereof (e.g., at the ends 50, 52 identified in FIG. 1A). That is to say, the vertical post frame member 320 shape reflected in FIG. 6 is substantially uniformly defined along an entire length thereof Joint Piece Formats As implicated by the above explanations and FIG. 1C, each of the frame member 36 formats (it being understood that the vertical post frame member 320 is not utilized with the construction of FIGS. 1B and 1C) are configured to retain at least two of the panels 34 in a spaced apart, side-by-side arrangement. The joint pieces 38 serve to interconnect individual ones of the frame members 36 via common mounting features. The joint pieces 38 can include three-way corner connectors, four-way corner connectors, three-way tee connectors, and/or four-way tee connectors as described below.

Three-Way Corner Connector 400

Figure 7B:
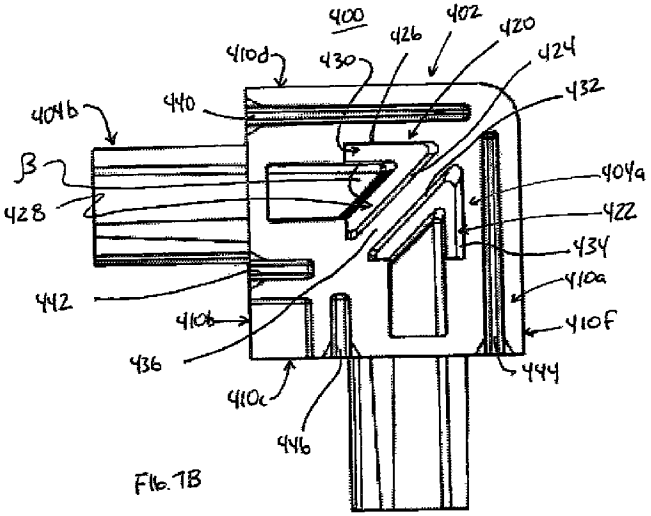
FIGS. 7B and 7C are opposing side views of the connector of FIG. 7A.
Figure 7A:
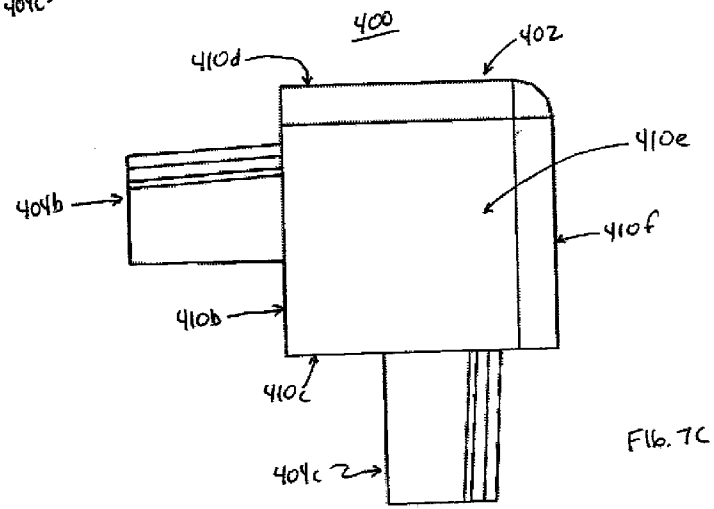
FIG. 7A is an interior perspective view of a three-way corner connector useful with some embodiments of the kit of FIG. 1A.
Figure 7C:
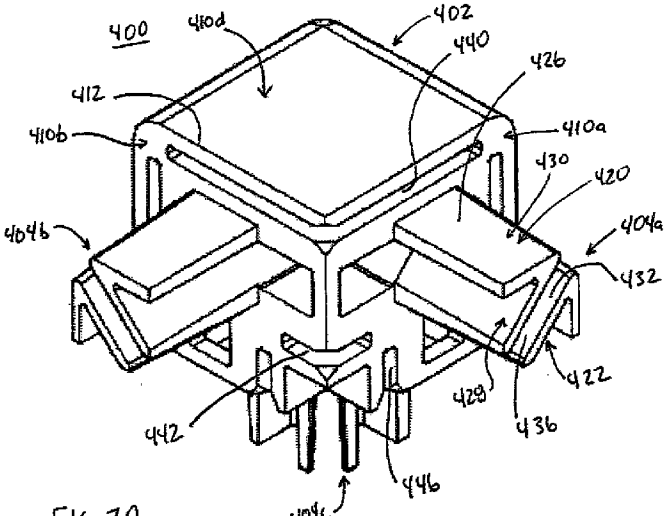

FIGS. 7A-7C illustrate one embodiment of a three-way corner connector 400 useful as some of the joint pieces 38 (FIG. 1A) provided with the kit 30 (FIG. 1A). The three-way corner connector 400 generally includes a block or cube-shaped core 402 and a plurality of plug assemblies 404. The block core 402 establishes orthogonal planes of extension of the plug assemblies 404 relative to one another, with the plug assemblies 404, in turn, being configured for coupling with a corresponding feature commonly provided with each of the frame member formats 36 (FIG. 1A) as described below. The three-way corner connector 400 is a homogenous, injection molded plastic structure in some embodiments, although other manufacturing techniques are also acceptable. Regardless, the three-way corner connector 400 is rigid and structurally robust.

The block core 402 is a cube-shaped body, forming first-sixth faces 410*a*-410*f*. The faces 410*a*-410*f* are substantially flat or planar. Adjacent ones of the faces 410*a*-410*f* are substantially orthogonal to one another (e.g., major planes of adjacent faces 410*a*-410*f* are within 5° of a truly orthogonal arrangement), with an intersection of an adjacent two of the faces 410*a*-410*f* establishing a corner 412 (one of which is identified in FIG. 7A). For reasons made clear below, the first-third faces 410*a*-410*c* can be described as providing interior surfaces of the three-way corner connector 400 during use, while the fourth-sixth faces 410*d*-410*f* serve as exterior surfaces.

The plug assemblies 404*a*-404*c* are identical, each extending from a respective one of the first-third faces 410*a*-410*c*. Due to the substantially orthogonal relationship of the first-third faces 410*a*-410*c*, then, a direction of extension of the plug assemblies 404*a*-404*c* are substantially perpendicular to one another (e.g., extension of the first plug assembly 404*a* from the first face 410*a* is substantially orthogonal relative to extension of the second plug assembly 404*b* from the second face 410*b*, as well as relative to extension of the third plug assembly 404*c* from the third face 410*c*). With this in mind, the following description of the first plug assembly 404*a* applies equally to the remaining plug assemblies 404*b*, 404*c*.

The first plug assembly 404*a* includes first and second prong bodies 420, 422 projecting from the first face 410*a*. The prong bodies 420, 422 are laterally spaced from one another, and can be identical. The first prong body 420 defines first and second engagement surfaces 424, 426. The engagement surfaces 424, 426 can be formed by discrete fingers 428, 430, respectively. Alternatively, the plug body 420 can be entirely solid. As identified for the first prong body 420 in FIG. 7B, relative to a plane parallel with the first face 410*a* (or perpendicular to the direction of extension of the prong bodies 420, 422 from the first face 410*a*), the first and second engagement surfaces 424, 426 extend from a point of intersection at an angle β. The extension angle β can be on the order of 45°, with the second engagement surface 426 being substantially parallel with the fourth face 410*d* of the block core 402. The second prong body 422 similarly defines first and second engagement surfaces 432, 434, with the second engagement surface 434 being substantially parallel with the sixth face 410*f*. The prong bodies 420, 422 are arranged such that the first engagement surfaces 424, 432 are substantially parallel with one another, and form a channel 436 therebetween. The channel 436 is sized to receive and frictionally retain a guide shoulder provided with the frame members 36 (FIG. 1A). For example, and with additional reference to FIG. 2, a width of the engagement channel 436 corresponds with a thickness of the guide shoulder 70 such that mounting of the three-way corner connector 400 with the corner frame member 60 (or any of the other frame member formats described above) includes inserting the guide shoulder 70 into the channel 436. The first engagement surfaces 424, 432 frictionally lock the guide shoulder 70 within the channel 436.

Returning to FIGS. 7A-7C, in addition to coupling with the frame members 36 (FIG. 1A) via the plug assemblies 404*a*-404*c*, the corner connector 400 is, in some embodiments, configured to accommodate the various panels 34 (FIG. 1A) carried by the frame members 36. For example, each of the interior faces 410*a*-410*c* forms first-fourth slots 440-446. The slots 440-446 are defined as depressions into the corresponding face 410*a*-410*c*, and have a width approximating (e.g., slightly greater than) a thickness of the panels 34. Further, the slots 440-446 are arranged and oriented relative to the corresponding plug assembly 404*a*-404*c* so as to receive a corresponding one of the panels 34 otherwise maintained by to the frame member 36 coupled to the plug assembly 404*a*-404*c*. With reference to the first face 410*a* shown in FIG. 7B, the first slot 440 is located between the first plug assembly 404*a* and the fourth face 410*d*. The second slot 442 is located between the first plug assembly 404*a* and the third face 410*c*. Further, both of the first and second slots 440, 442 extend to, and are open at, the second face 410*b*. The first and second slots 440, 442 are substantially parallel with one another, and establish an angular relationship with the channel 436 equal to the extension angle β (e.g., 45°). With this construction, and with additional reference to the angled frame member 60 of FIG. 2, mounting of the three-way corner connector 400 to the corner frame member 60, and in particular insertion of the guide shoulder 70 into the channel 436, aligns the first slot 440 with the panel engagement region 102 of the first outer panel mounting assembly 62, and the second slot 442 with the panel engagement region 102 of the first inner panel mounting assembly 64. As a result, a first panel (not shown) otherwise assembled to the first outer panel mounting assembly 62 can nest within the first slot 440, and a second panel (not shown) assembled to the first inner panel mounting assembly 64 will nest within the second slot 442. The third and fourth slots 444, 446 establish a similar relationship relative to the second outer and inner panel mounting assemblies 66, 68. Thus, the third and fourth slots 444, 446 are orthogonally arranged relative to the first and second slots 440, 442. The slots 440-446 in the second and third faces 410*b*, 410*c* are similarly arranged. Finally, and as best reflected in FIG. 7A, the so-defined slots 440-446 can be continuous across or open relative to adjacent faces 410*a*-410*c*. For example, the first slot 440 is formed by, and open relative to, the first and second faces 410*a*, 410*b*.

Four-Way Corner Connector 460

Figures 8A, 8B, 8C:
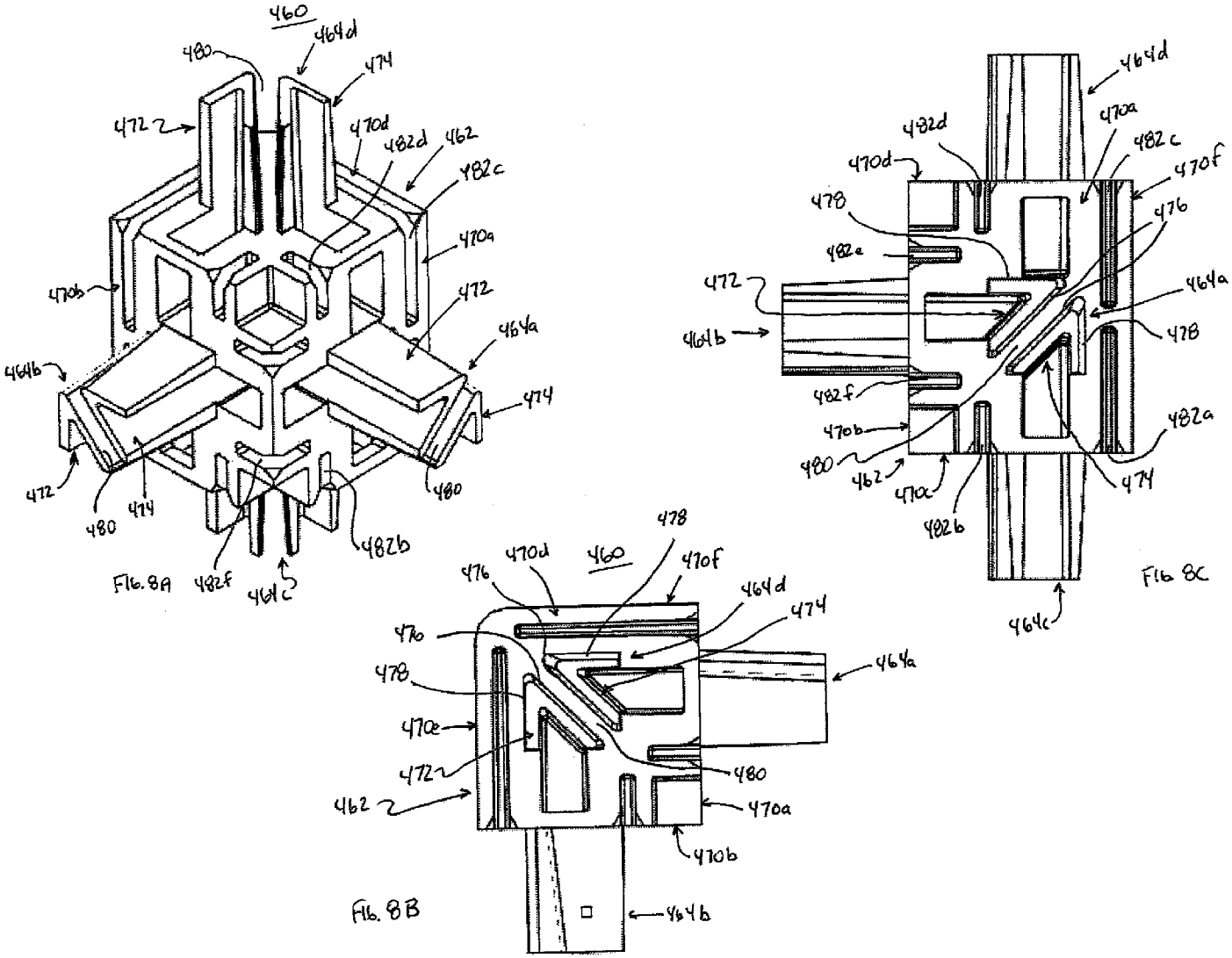
FIG. 8A is an interior perspective view of a four-way corner connector useful with some embodiments of the kit of FIG. 1A.
FIG. 8B is a top view of the connector of FIG. 8A.
FIG. 8C is a side view of the connector of FIG. 8A.

FIGS. 8A-8C illustrate one embodiment of a four-way corner connector 460 useful as some of the joint pieces 38 (FIG. 1A) provided with kits of the present disclosure. In many respects, the four-way corner connector 460 is identical to the three-way corner connector 400 (FIG. 7A-7C) described above, and includes a block core 462 and a plurality of plug assemblies 464*a*-464*d*. The block core 462 forms first-sixth faces 470*a*-470*f*, adjacent ones of which are substantially orthogonally arranged. The plug assemblies 464*a*-464*d* can be identical to the plug assemblies 404*a*-404*c* (FIGS. 7A-7C) described above, and each include opposing prong bodies 472, 474 having first and second engagement surfaces 476, 478 that combine to define a channel 480 as previously described. With the four-way corner connector 460 of FIGS. 8A-8C, however, four of the plug assemblies 464*a*-464*d* are provided, respective ones of which project from a corresponding one of the first-fourth faces 470*a*-470*d*. Thus, the first-fourth faces 470*a*-470*d* define interior surfaces of the block core 462, while the fifth and sixth faces 470*e*, 470*f* serve as exterior surfaces during use. With this construction, the first and second plug assemblies 464*a*, 464*b* extend in a substantially perpendicular fashion relative to the third and fourth plug assemblies 464*c*, 464*d*; the third and fourth plug assemblies 464*c*, 464*d* are aligned with one another, and are substantially perpendicular to the first and second plug assemblies 464*a*, 464*b*. Finally, the four-way corner connector 460 optionally forms various panel-receiving slots that are open at one or more of the interior faces 470*a*-470*d*. For example, in the view of FIG. 8C, first-sixth slots 482*a*-482*f* are identified. The first and second slots 482*a*, 482*b* are open to the first and third faces 470*a*, 470*c*; the third and fourth slots 482*c*, 482*d* are open to the first and fourth faces 470*a*, 470*d*; and the fifth and sixth slots 482*e*, 482*f* are open to the first and second faces 470*a*, 470*b* for reasons made clear below. Though not identified in the views, four additional slots are formed at the second face 470*b* as mirror images of the first-fourth slots 482*a*-482*d*.

Three-Way Tee Connector 500

Figure 9A:
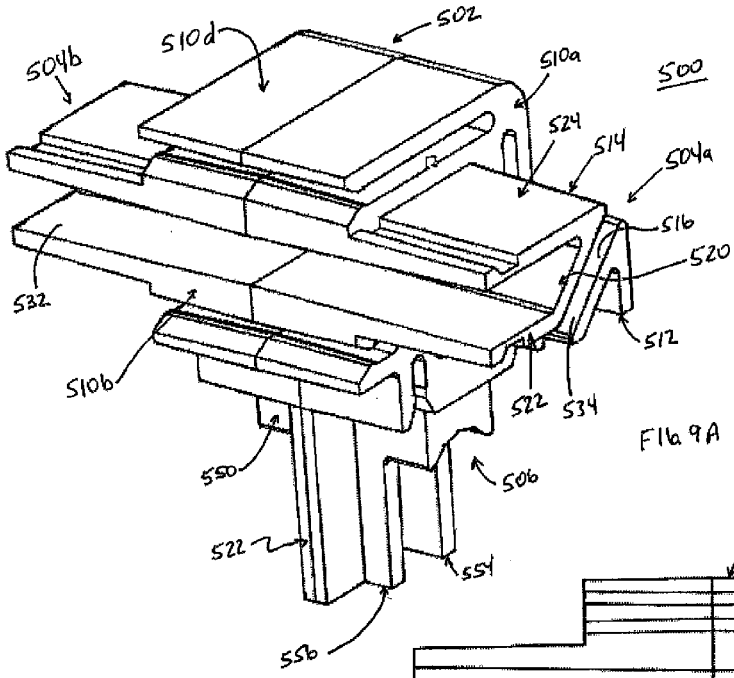
FIG. 9A is an interior perspective view of a three-way tee connector useful with some embodiments of the kit of FIG. 1A.
Figure 9B:
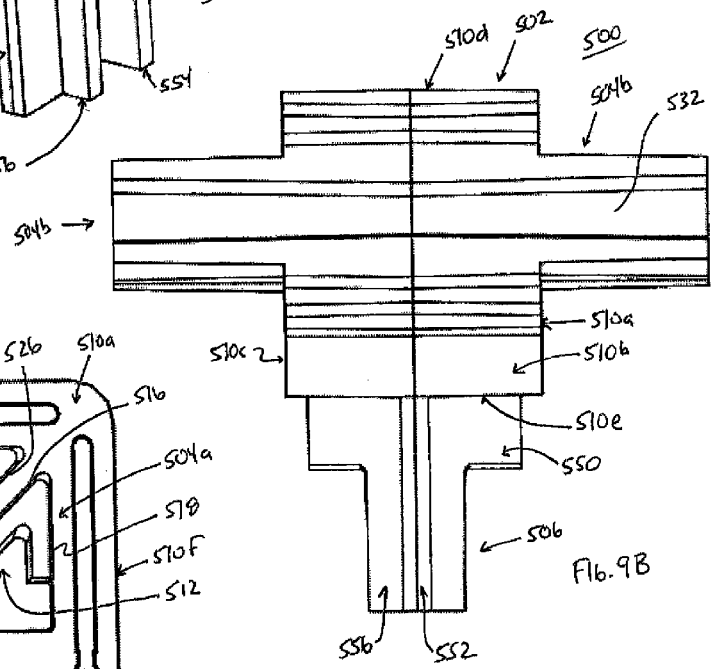
FIG. 9B is an interior end view of the tee connector of FIG. 9A.
Figure 9C:
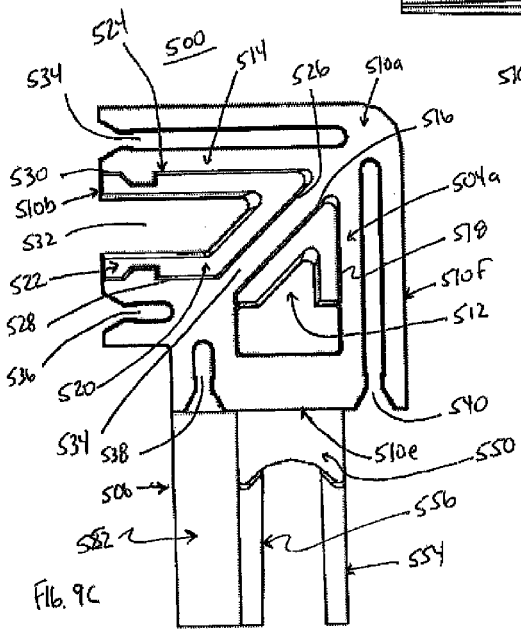
FIG. 9C is a side view of the tee connector of FIG. 9A.

As described below, the corner connectors 400, 460 facilitate formation of all the joints necessary to complete many desired merchandizing unit end configurations. In other embodiments, kits of the present disclosure can include additional joint piece formats. For example, FIGS. 9A-9C illustrates an optional three-way tee connector 500. The three-way tee connector 500 can be an injection molded plastic component, and in many respects is akin to the corner connectors 400 (FIG. 7A), 460 (FIG. 8A) described above. The three-way tee connector 500 includes a block core 502, first and second plug assemblies 504*a*, 504*b*, and a post assembly 506.

The block core 502 is a generally cube-shaped body, and defines first-sixth faces 510*a*-510*f* For reasons made clear below, the first-third and fifth faces 510*a*-510*c*, and 510*e* serve as interior surfaces during use, whereas the fourth and sixth faces 510*d*, 510*f* are exterior surfaces.

The first and second plug assemblies 504*a*, 504*b* can be identical to the plug assemblies previously described (e.g., the plug assembly 404*a* of FIGS. 7A-7C). The first plug assembly 504*a* projects from the first face 510*a*, whereas the second plug assembly 504*b* projects from the third face 510*c*. The plug assemblies 504*a*, 504*b* can be identical, with the following description of the first plug assembly 504*a* applying equally to the second plug assembly 504*b*. The first plug assembly 504*a* includes first and second prong bodies 512, 514 projecting from the first face 510*a*. The first prong body 512 can be identical to the prong bodies 420, 422 (FIG. 7A) described above, and defines first and second engagement surfaces 516, 518 commensurate with previous descriptions. The second prong body 514 includes first-third fingers 520-524 each defining an engagement surface 526-530. The second and third fingers 522, 524 extend in a spaced apart, substantially parallel fashion from opposite sides of the first finger 520 to form a trough 532. A terminal end of each of the second and third fingers 522, 524 can be co-planar with the second face 510*b*. As shown, the trough 532 is continuous through the block core 502 and the second plug assembly 504*b*, and is open at the second face 510*b*.

As best shown in FIG. 9B, the first and second engagement surfaces 516, 518 of the second prong body 514 are arranged relative to the block core 502 and the first prong body 512 commensurate with previous descriptions. Thus, a channel 534 is defined between the first engagement surfaces 516, 526. The third engagement surface 530 provides additional surface area for frictionally coupling to a frame member. The trough 532 promotes more intimate contact with foam insulation as described below.

Similar to previous embodiments, the block core 502 can form a series of slots arranged relative to the plug assemblies 504*a*, 504*b* for receiving panels carried by a frame member otherwise connected to a corresponding one of the plug assemblies 504*a*, 504*b*. For example, FIGS. 9A and 9C depict four slots 534-540 formed through a thickness of the block core 502. The first and second slots 534, 536 are arranged at opposite sides of the plug assemblies 504*a*, 504*b* and are open to the first-third faces 510*a*-510*c*. The third and fourth slots 538, 540 are substantially perpendicular to the first and second slots 534, 536, are located at opposite ends of the plug assemblies 504*a*, 504*b*, and are open to the first, third, and fourth faces 510*a*, 510*c*, 510*d*.

The post assembly 506 projects from the fifth face 510*e*, and is configured to mate with corresponding features of a selected one of the frame member 36, and in particular the vertical post frame member 320 (FIG. 6). The post assembly 506 includes a head 550, a rib 552, and opposing legs 554, 556. The head 550 and the rib 552 combine to define a T-like shape. The legs 554, 556 project from the head 550, with the rib 552 extending along the first leg 554. Thus, the T-like shape is maintained by the rib 552 and the first leg 554, and is sized and shaped for coupling with the vertical post frame member 320. For example, and with cross-reference between FIGS. 6, 9A, and 9B, the post assembly 506 is inserted within the joint capture regions 368, 388, with the head 550 nesting within the first capture region 568, and the rib 552 nesting within the second capture region 388.

Four-Way Tee Connector 560

Figure 10B:
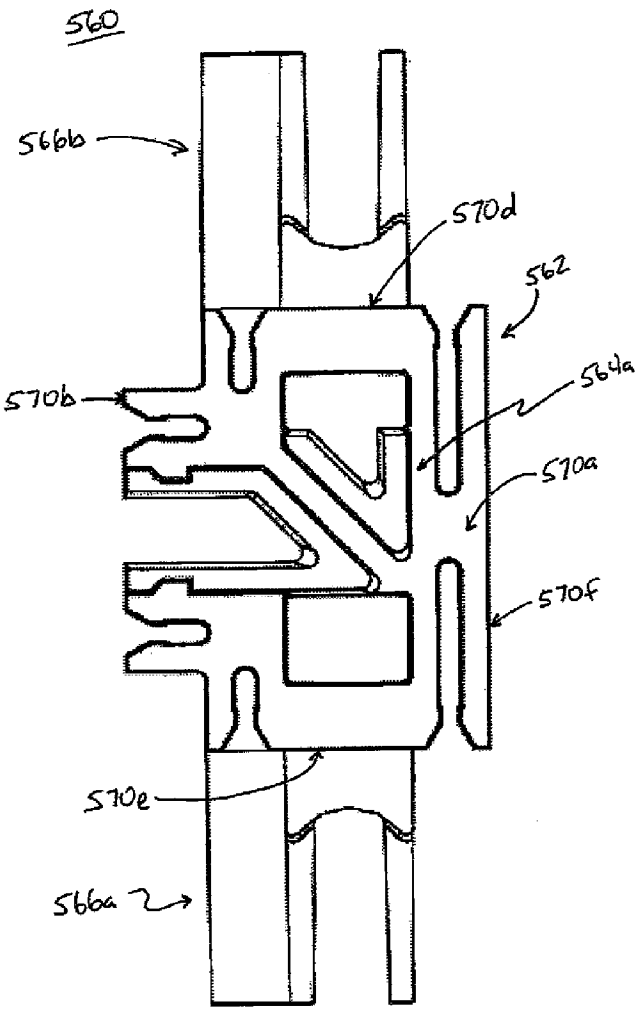
FIG. 10B is a side view of the tee connector of FIG. 10A.
Figure 10A:
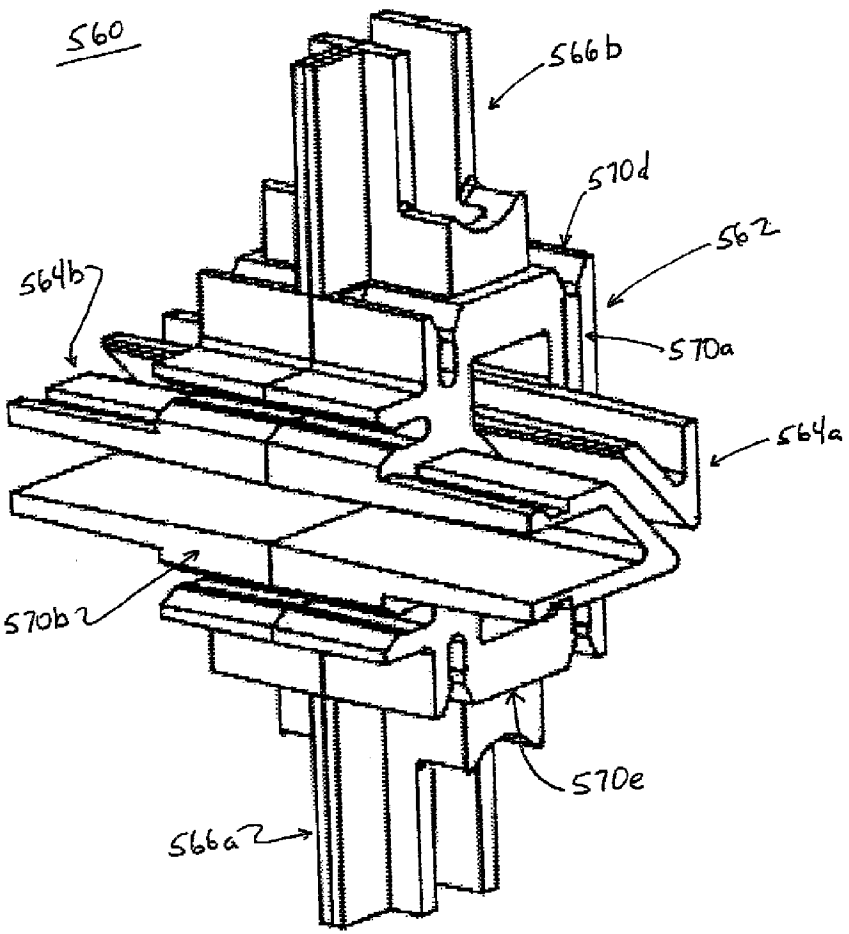
FIG. 10A is an interior perspective view of a four-way tee connector useful with some embodiments of the kit of FIG. 1A.

FIGS. 10A and 10B illustrate an optional four-way tee connector 560 useful as joint pieces with kits of the present disclosure. The four-way tee connector 560 is highly akin to the three-way tee connector 500 (FIGS. 9A-9C) described above, and includes a block core 562, plug assemblies 564*a*, 564*b*, and post assemblies 566*a*, 566*b*. The block core 562 defines first-sixth faces 570*a*-570*f*, with the plug assemblies 564*a*-564*b* extending from the first and third faces 570*a*, 570*c* and being identical to the plug assemblies 404*a*, 404*b* (FIGS. 9A-9C) described above.

The first post assembly 566*a* projects from the fifth face 570*e*, and can assume any of the forms described above with respect to the post assembly 506 (FIGS. 9A-9C). With the four-way tee connector 560, the second post assembly 566*b* is provided, and projects from the fourth face 570*d*. The second post assembly 566*b* can be identical to the first post assembly 566*a*, with the post assemblies 566*a*, 566*b* being longitudinally aligned. With this construction, then, the sixth face 560*f* serves as at the only exterior surface of the four-way tee connector 560 during use.

Modular Cooled Merchandizing Unit Assembly

Returning to FIG. 1A, the kits 30 of the present disclosure as provided to an end user can include one or more of the differently-formatted frame members and joint pieces. For example, the multiplicity of frame members 36 can include a plurality of each of the corner frame members 60 (FIG. 2), the clip frame members 160 (FIG. 4), the horizontal post frame members 210 (FIG. 5), and the vertical post frame members 320 (FIG. 6). Similarly, the multiplicity of joint pieces 38 can include a plurality of each of the three-way corner connectors 400 (FIG. 7A), the four-way corner connectors 460 (FIG. 8A), the three-way tee connectors 500 (FIG. 9A), and the four-way tee connectors 560 (FIG. 10A). In other embodiments, kits of the present disclosure include less than all of the described frame member and/or joint piece formats. For example, FIG. 1C can be viewed as representing an alternative kit 30' comprised of the corner frame members 60, the clip frame members 160, the horizontal post frame members 220, and the corner connectors 400, 460. In yet other embodiments, the kit includes only the corner frame members 60 and the three-way corner connectors 400.

Methods of constructing a cooled merchandizing unit with kits of the present disclosure include the user initially determining a style and size of the desired end unit. For example, the desired unit can have an upright style, a coffin style, etc. The styles and dimensions of the desired unit is virtually limitless with the kits 30 of the present disclosure. Once the style and size of the desired unit has been determined, various ones of the frame members 36 are selected. Where necessary, the selected frame members 36 are cut to lengths corresponding with the selected shape and size. The frame members 36 and the joint pieces 38 are assembled to define a cabinet frame that optionally defines at least one door opening. Contemporaneously with formation of the cabinet frame, the panels 34 are mounted at or along the various faces of the frame (except at the designated door opening), resulting in a completed cabinet. Selection of a particular format frame member 36 for a particular segment or region of the cabinet frame can be a function of the desired door opening location, as well as other desired features of the end merchandizing unit. Insulation is applied to the cabinet, and other components such as the cooling unit 40 and the door assembly 42 are then mounted to the cabinet.

For example, construction of the merchandizing unit 46 of FIG. 1B from the kit 30' of FIG. 1C is described below (alternatively, FIG. 1C can be viewed as the steps for assembling the unit 46 from the kit 30 of FIG. 1A). The unit 46 has been designed to be of an upright style, including a cabinet 600 that defines a door opening 602. Further, an interior shelf 604 is included, effectively separating the cabinet 600 into a base region 606 and a product or cooled region 608. As made clear below, the cabinet 600 is formed by a cabinet frame 610 (via the frame members 36 and the joint pieces 38) and side walls 612 (via pairs of the panels 34). Due to the modular nature of the merchandizing unit 46, the frame 610 and the sidewalls 612 are constructed in tandem as described below. To facilitate a better understanding of the assembly process, however, the cabinet frame 610 is shown in FIG. 11 with the side walls 612 (FIG. 1B) removed.

Figure 11:
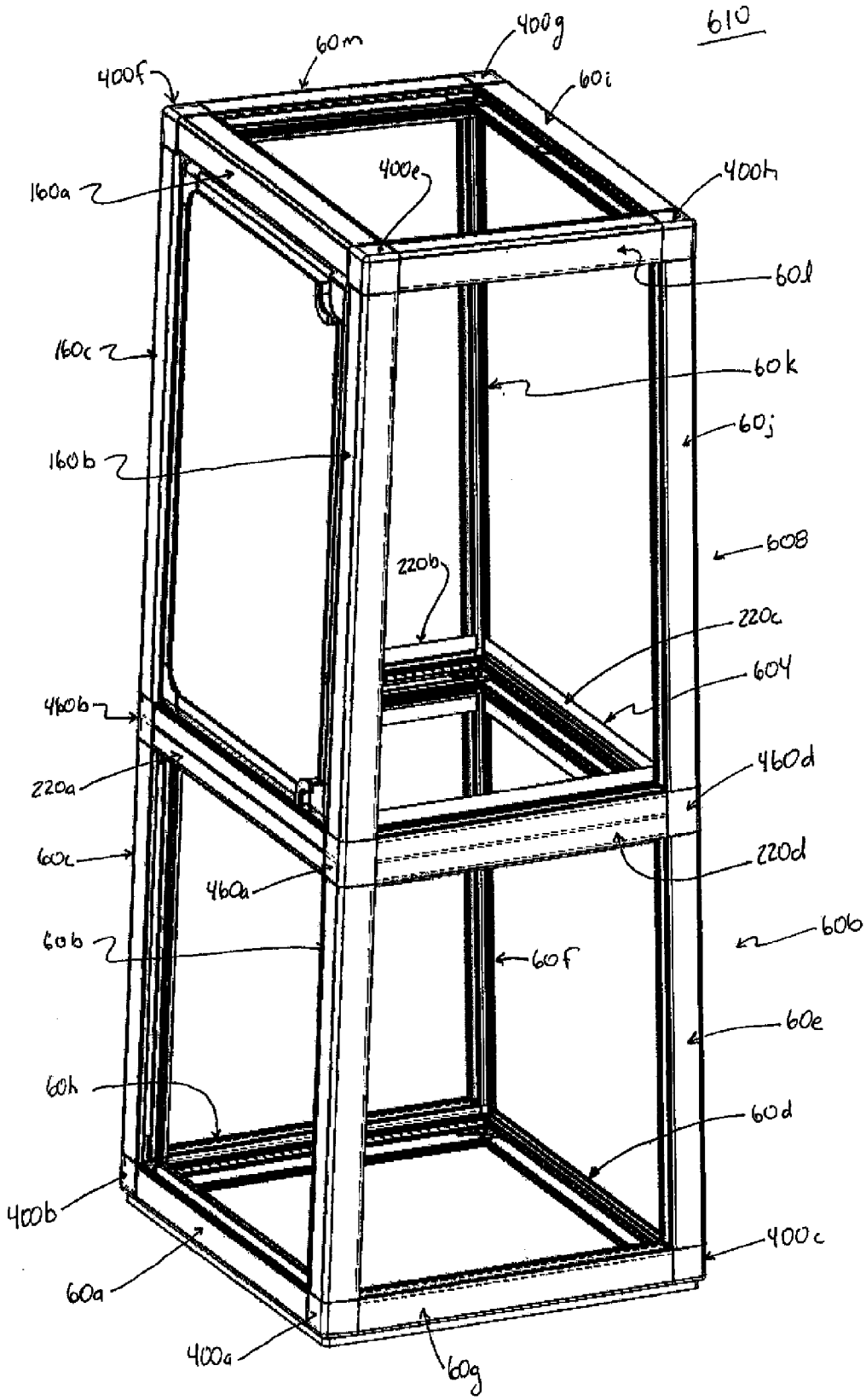
FIG. 11 is a perspective view of a cabinet frame portion of the modular unit of FIG. 1B and constructed from kits in accordance with principles of the present disclosure.
Figure 12A:
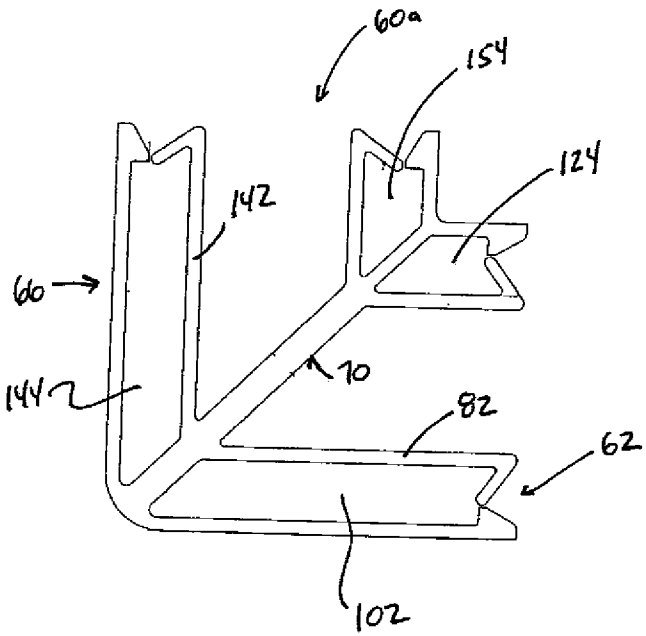
FIGS. 12A-12C illustrate coupling of the corner frame member of FIG. 2 with the three-way corner connector of FIG. 7A.
Figure 12A:
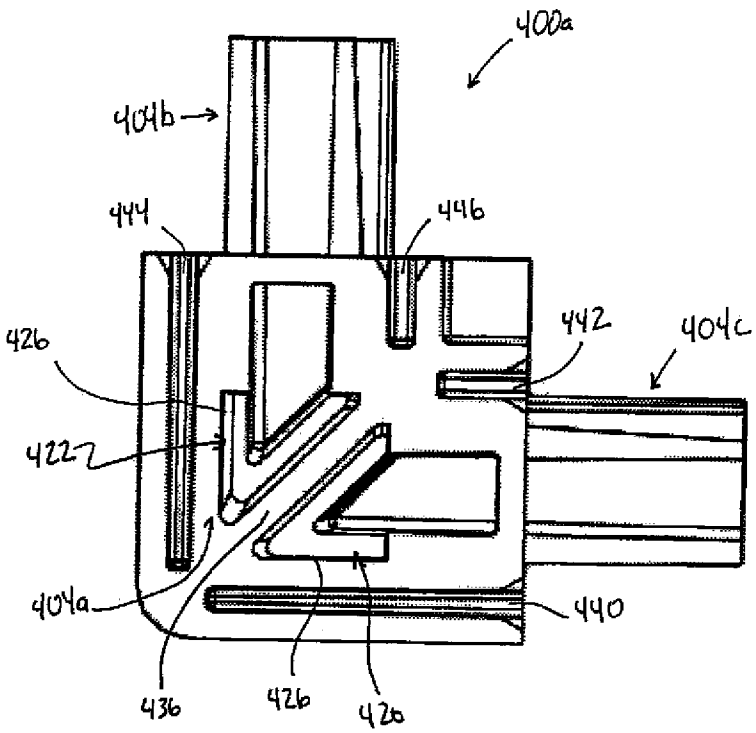
Figure 12B:
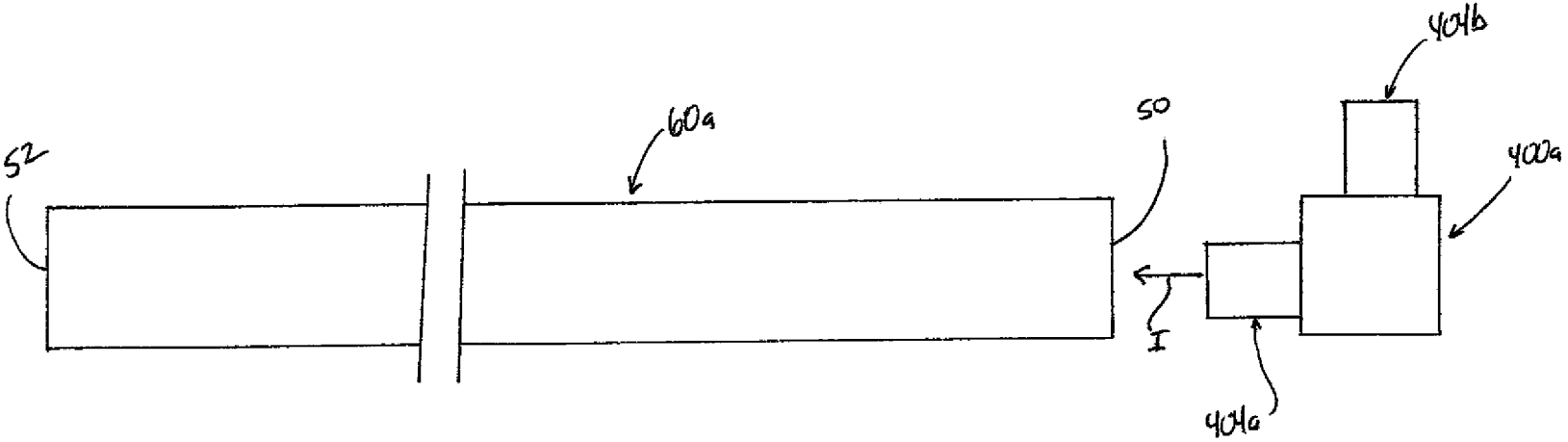

With the above design parameters in mind, and with cross-reference between FIGS. 1B, 1C, and 11, the base region 606 of the cabinet frame 610 is formed by interconnecting eight of the corner frame members 60*a*-60*h* with four of the three-way corner connectors 400*a*-400*c* (it being understood that the fourth three-way corner connector of the base region 606 is hidden in the views). Connection or mounting of one of the three-way corner pieces 400 to one of the corner frame members 60 is reflected in FIGS. 12A-12C. In particular, FIG. 12A illustrates an end view of the first three-way corner connector 400*a* and the first corner frame member 60*a* identified in FIG. 1C prior to assembly. Once again, the three-way corner connector 400 includes the three plug assemblies 404*a*-404*c*; the first plug assembly 404*a* is to be coupled with the guide shoulder 70 of the first corner frame member 60*a* (at the first end 50 thereof as identified in FIG. 1C). FIG. 12B provides a front view of the first corner frame member 60*a* and the first three-way corner connector 400*a* immediately prior to mounting of the components 60*a*, 400*a*. The first plug assembly 404*a* is aligned with the first end 50 of the corner frame member 60*a*, and coupling of the components 60*a*, 400*a* entails insertion of the plug assembly 404*a* into the end 50 (represented by the arrow I in FIG. 12B) of the corner frame member 60*a*.

Figure 12C:
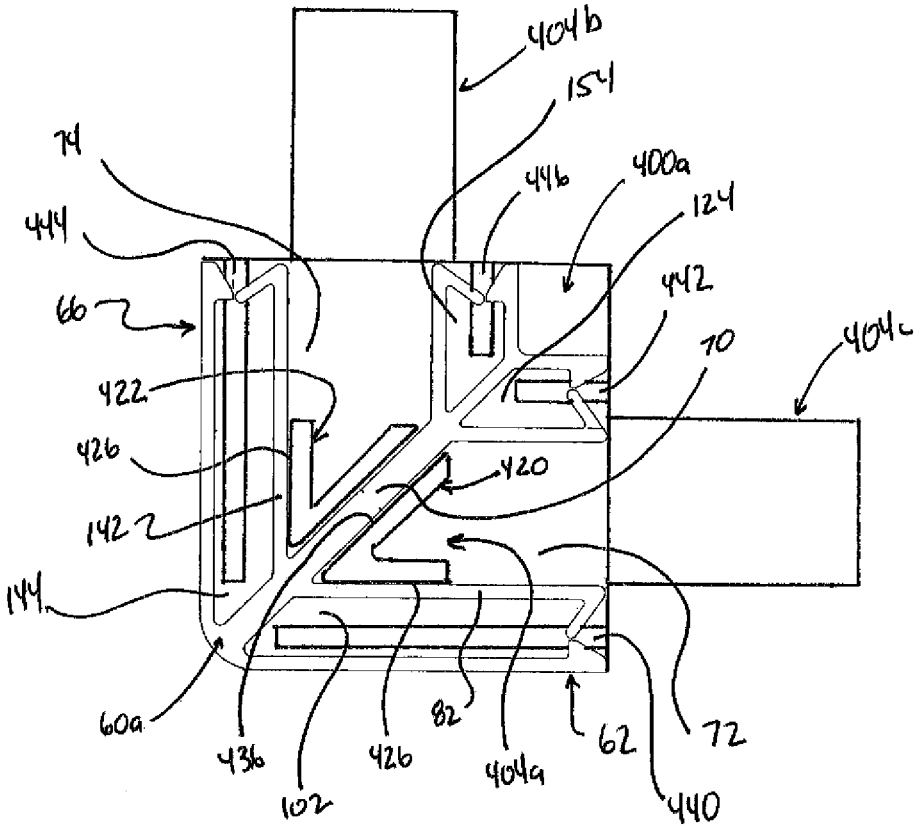

FIG. 12C illustrates connection of the corner connector 400*a* with the corner frame member 60*a* upon final assembly. The guide shoulder 70 of the frame member 60*a* is frictionally received within the channel 436 of the plug assembly 404*a*. Further, the plug assembly prong bodies 420, 422 nest within the joint capture regions 72, 74, respectively, of the frame member 60*a*. In this regard, the prong bodies 420, 422 are dimensioned and spatially arranged in accordance with corresponding attributes of the corner frame member 60*a* such that the second engagement surface 426 of the first prong body 420 bears against the interior leg 82 of the first outer panel mounting assembly 62, and the second engagement surface 426 of the second prong body 422 bears against the interior leg 142 of the second outer panel mounting assembly 66. These interfaces collectively lock the frame member 60*a* with the corner connector 400*a*. Further, FIG. 12C illustrates that upon final mounting, the panel slots 440-446 of the corner connector 400*a* are aligned with a corresponding one of the panel engagement regions 102, 124, 144, 154.

Figure 12D:
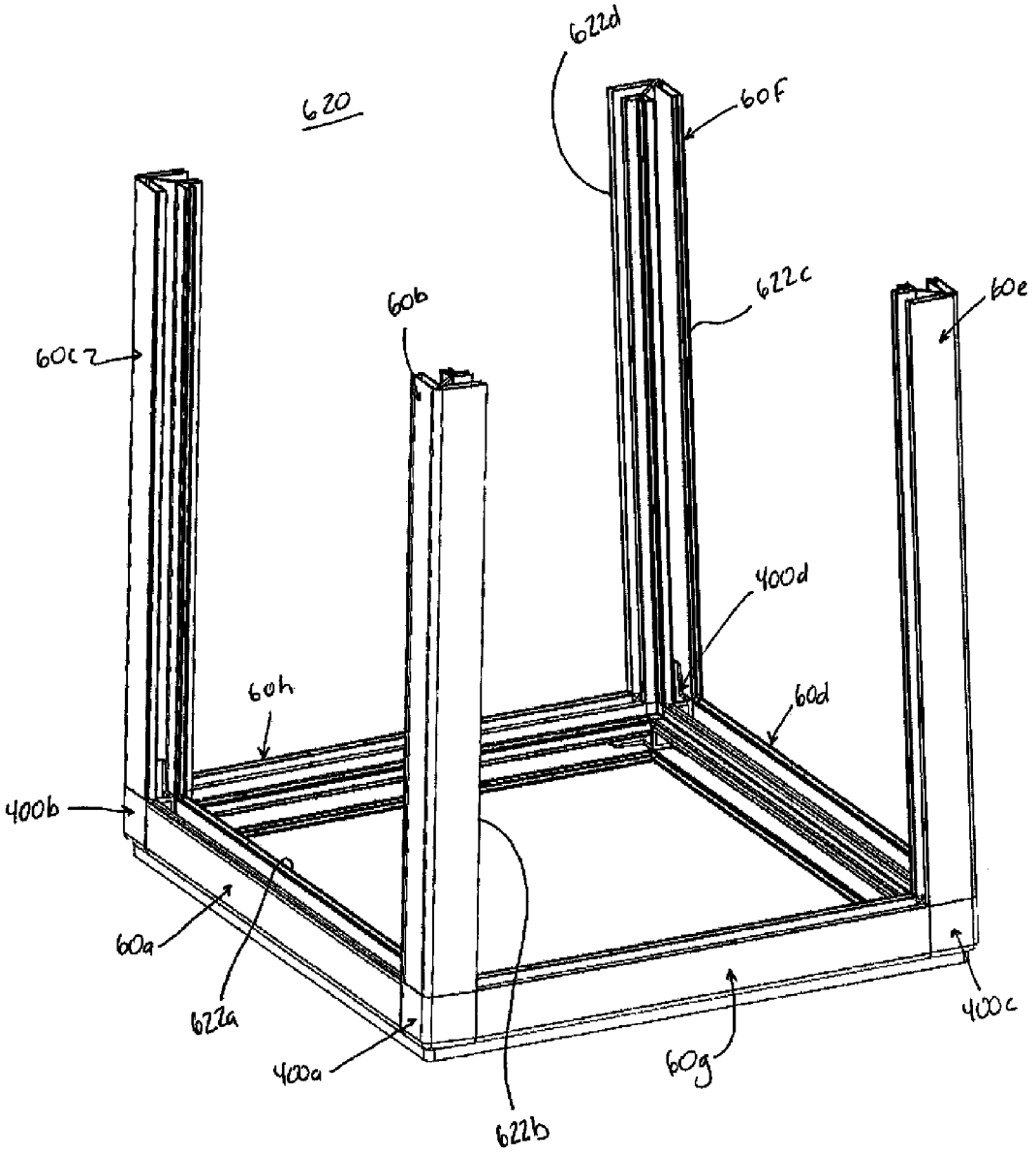
FIG. 12D is a perspective view of a base region frame formed during construction of the cabinet frame of FIG. 11 using kits in accordance with principles of the present disclosure.

Returning to FIG. 1C, the second and seventh corner frame members 60*b*, 60*g* are coupled to the second and third plug assemblies 404*b*, 404*c* of the first three-way corner connector 400*a* in a similar manner. The corner frame members 60*a*-60*h* are coupled with the remaining three-way corner connectors 400*b*, 400*c* as indicated, resulting in a base region frame 620 shown in FIG. 12D.

Figure 13A:
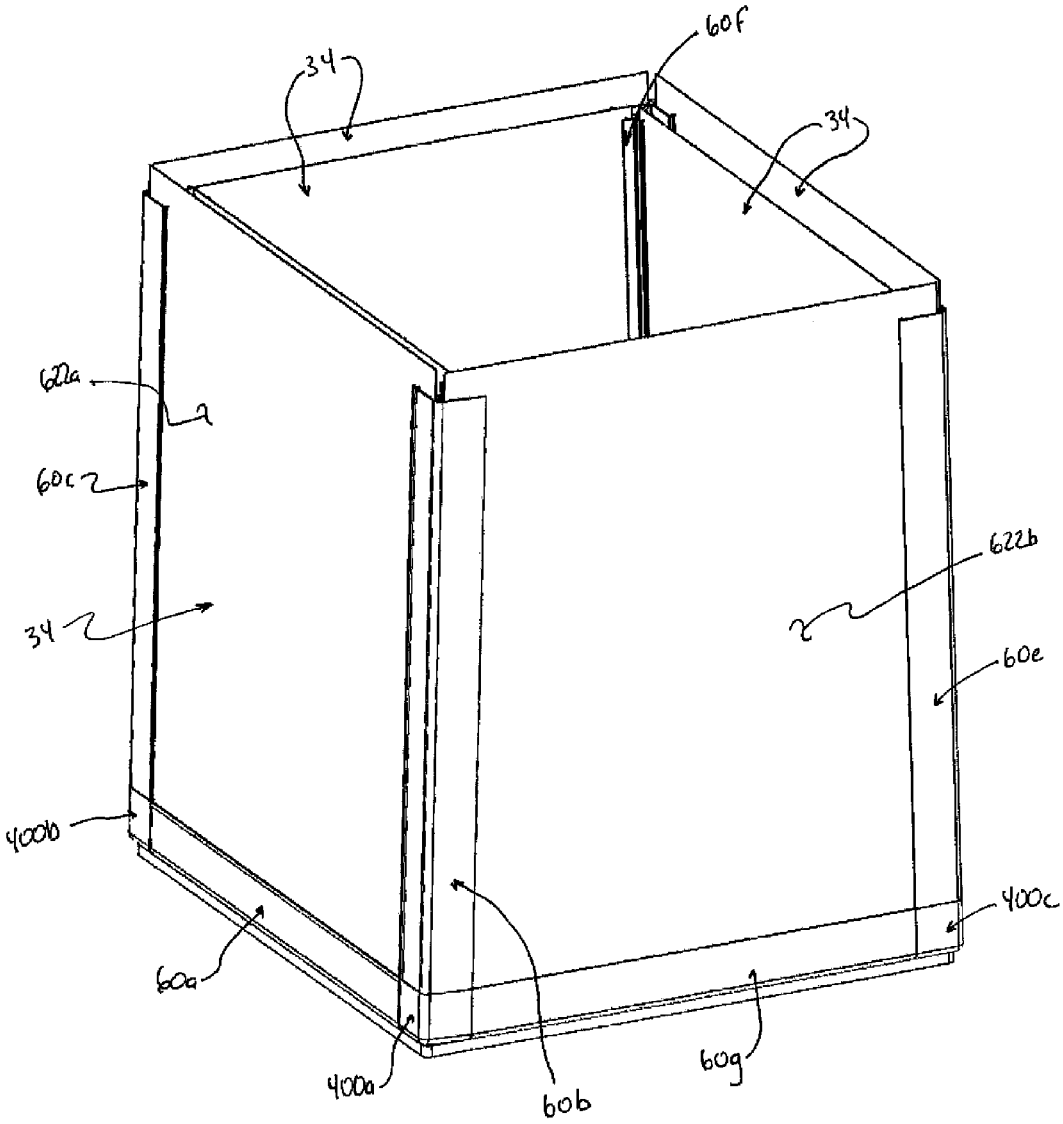
FIG. 13A is a perspective view of a base region of the cabinet frame of FIG. 11, including the frame of FIG. 12D and side walls assembled thereto.
Figure 13B:
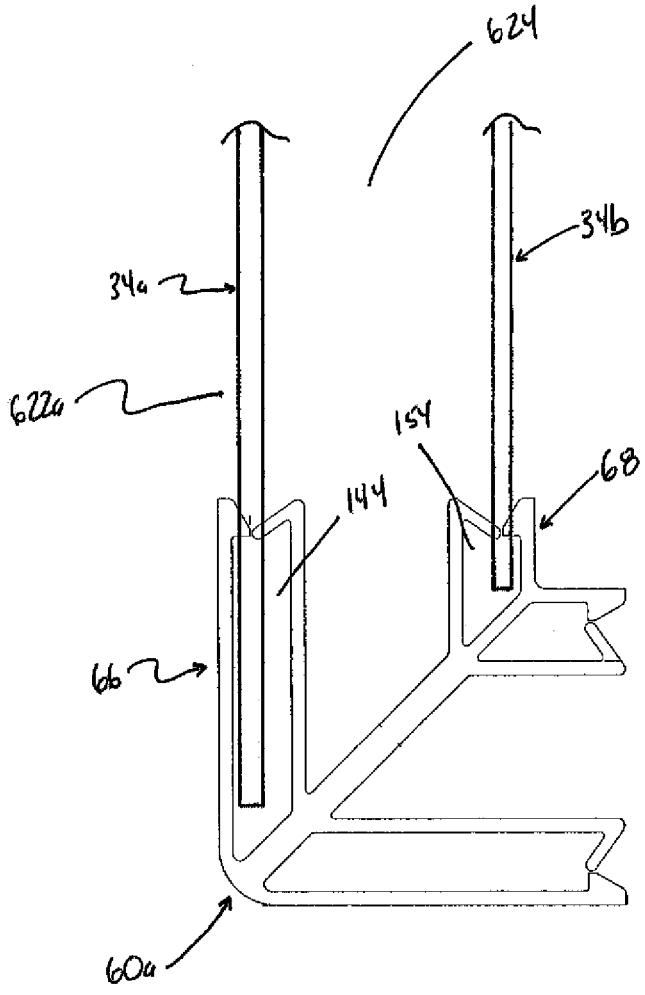
FIGS. 13B-13E illustrate assembly of panels, the corner frame member of FIG. 2, and the three-way corner connector of FIG. 7A in forming a segment of the base region of FIG. 13A.

Several of the panels 34 (FIG. 1C) are then assembled to the base region frame 620. The corner frame members 60*a*-60*h* of the base region frame 620 can be viewed as demarcating or dividing the frame 620 into four open faces 622*a*-622*d*. Pairs of the panels 34 are assembled to each of the frame open faces 622*a*-622*d* (referenced generally in FIG. 12D). The so-assembled panels 34 serve to close each of the faces 622*a*-622*d* as shown in FIG. 13A. In this regard, the pairs of panels 34 are retained by the corner frame members 60*a*-60*h* otherwise defining a perimeter of the corresponding faces 622*a*-622*d*. For example, FIG. 13B illustrates mounting of first and second panels 34*a*, 34*b* to the first corner frame member 60*a* at the first face 622*a*. The first panel 34*a* is secured within the panel engagement region 144 of the second outer panel mounting assembly 66, and the second panel 34*b* is retained within the panel engagement region 154 of the second inner panel mounting assembly 68. The first corner frame member 60*a* retains the panels 34*a*, 34*b* in a spaced apart, substantially parallel arrangement (either alone or in combination with the panel spacing dictated by engagement of the first and second panels 34*a*, 34*b* with the remaining angled frame members 60 (not shown) of the first face 622*a*). A substantially uniform gap 624 is established between the panels 34*a*, 34*b*.

Figure 13C:
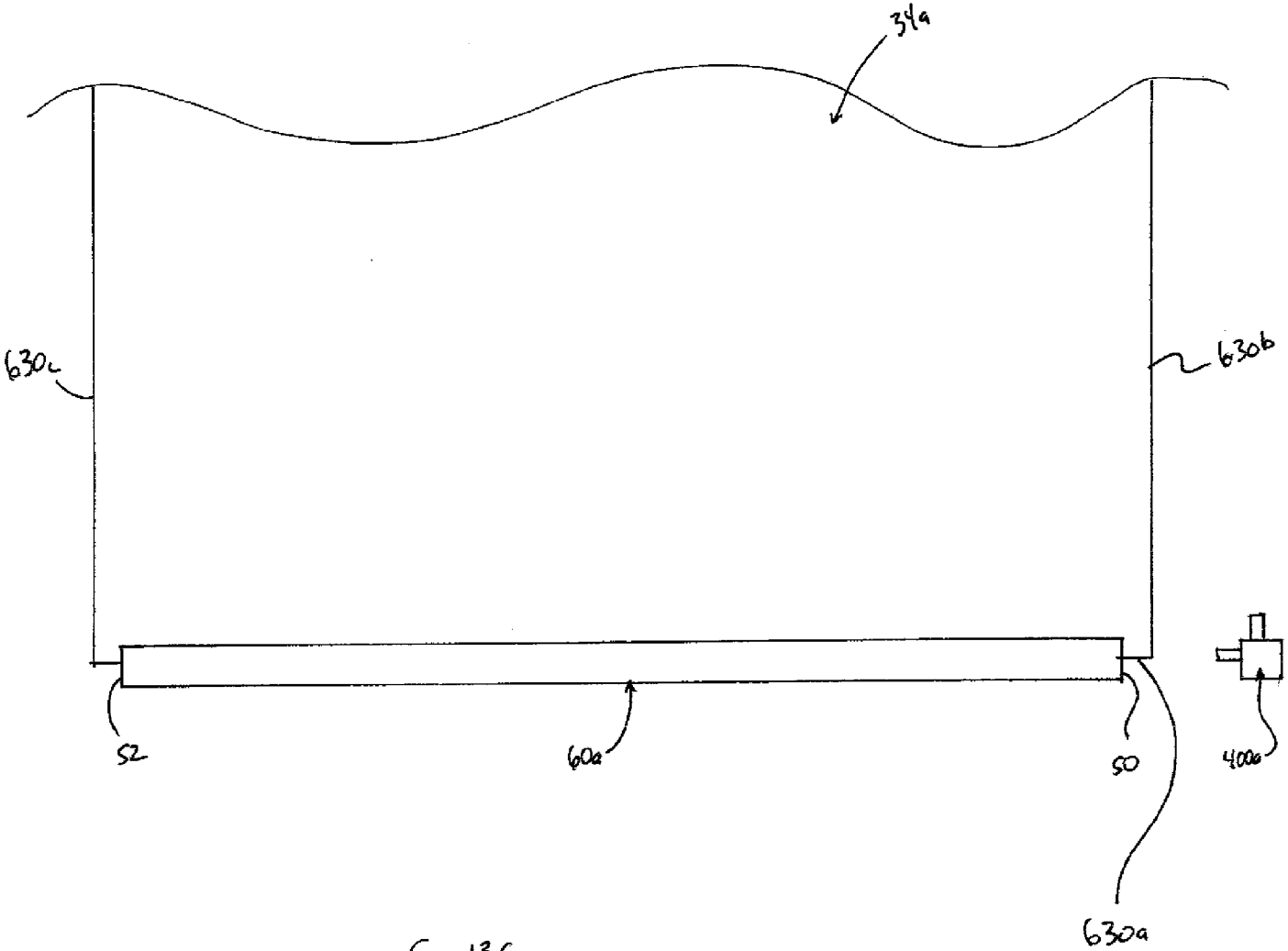
Figure 13D:
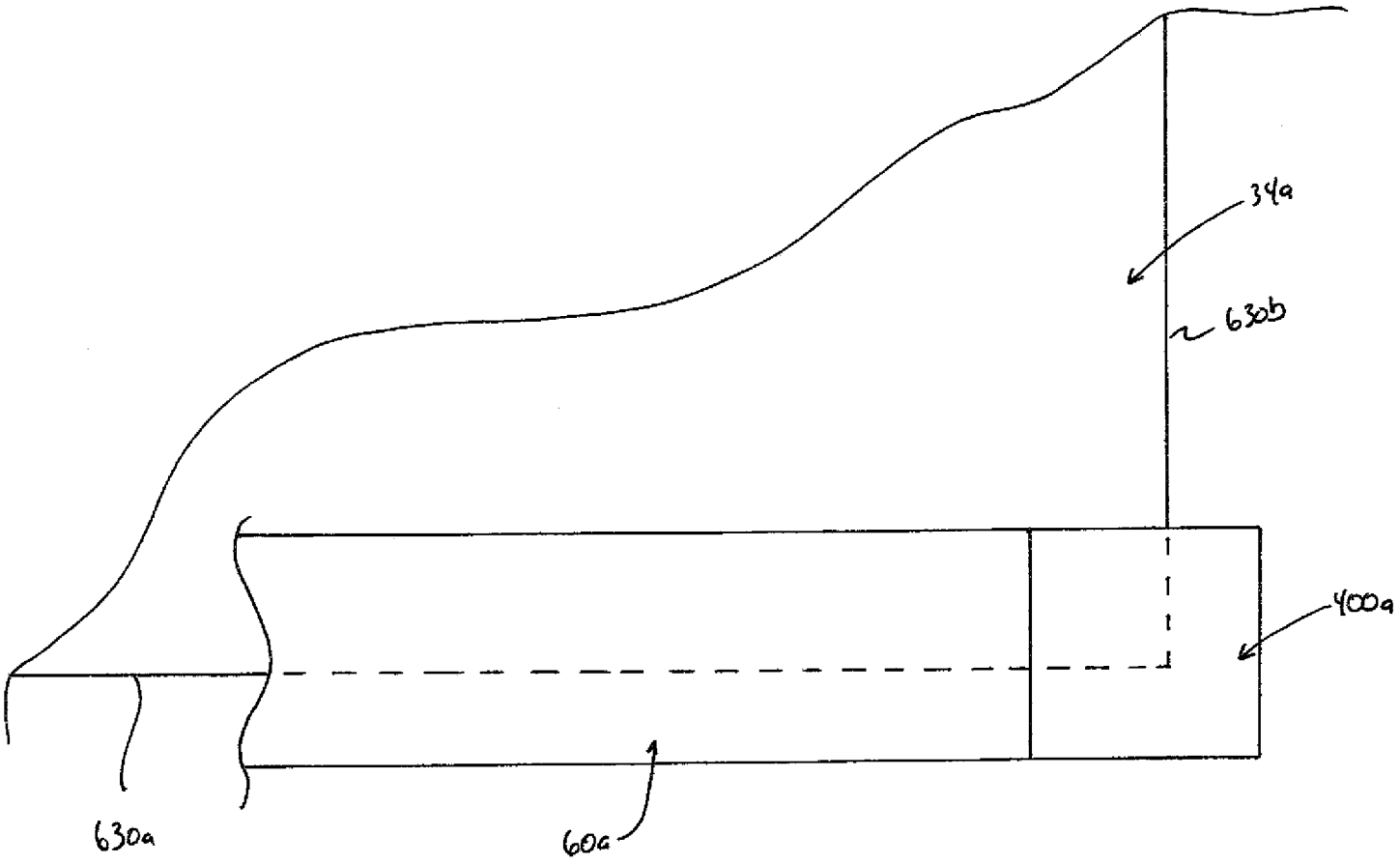
Figure 13E:
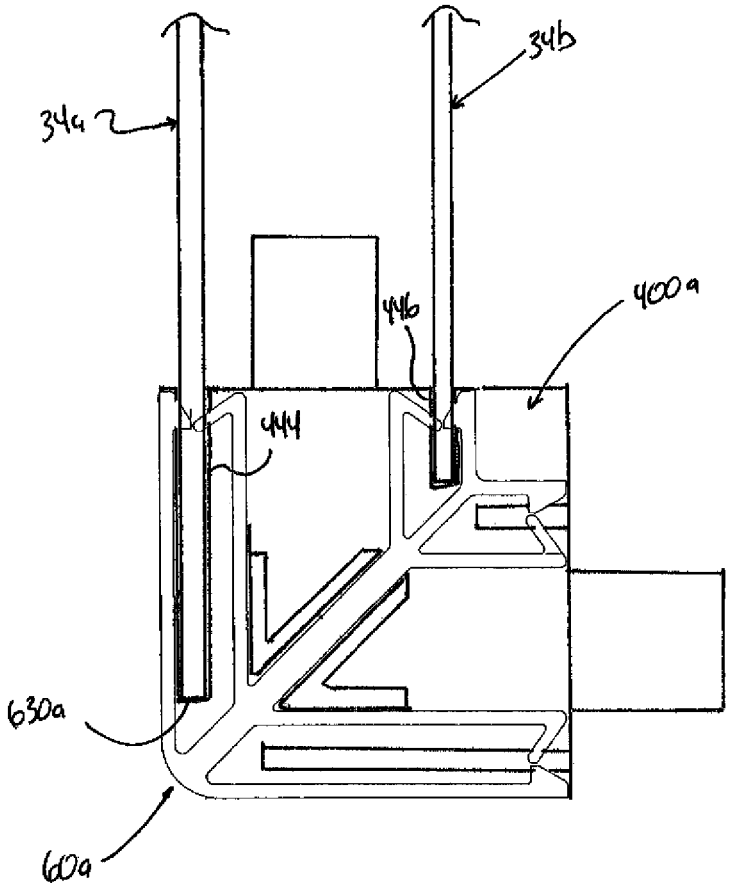

The corner connectors 400 (FIG. 1C) can additionally support the panels 34*a*, 34*b* in the spaced apart, substantially parallel arrangement. In the view of FIG. 1C, edges 630*a*-630*d* of the first panel 34*a* are identified; commensurate with the above descriptions, the first edge 630*a* is mounted to the first corner frame member 60*a* and the second edge 630*b* is mounted to the second corner frame member 60*b*. With this in mind, in the view of FIG. 13C, the first corner connector 400*a* is removed from the first corner frame member 60*a*, and reflects that upon final assembly, the first edge 630*a* of the first or outer panel 34*a* projects beyond the end 50 of the first corner frame member 60*a*, locating the second edge 630*b* beyond the first corner frame member 60*a*. Though hidden in the view of FIG. 13C, the second or inner panel 34*b* (FIG. 13B) similarly extends beyond the frame member end 50. As shown in FIGS. 13D and 13E, in the coupled state of the first corner frame member 60*a* with the first corner connector 400*a*, the second edge 630*b* of the first panel 34*a* is received and held within the third slot 444 of the corner connector 400*a*. The second panel 34*b* is similarly received within the fourth slot 446 of the corner connector 400*a*. Similar relationships are established between remaining ones of the panels 34 and corresponding three-way corner connectors 400 as generally reflected in FIG. 13A.

Figure 14B:
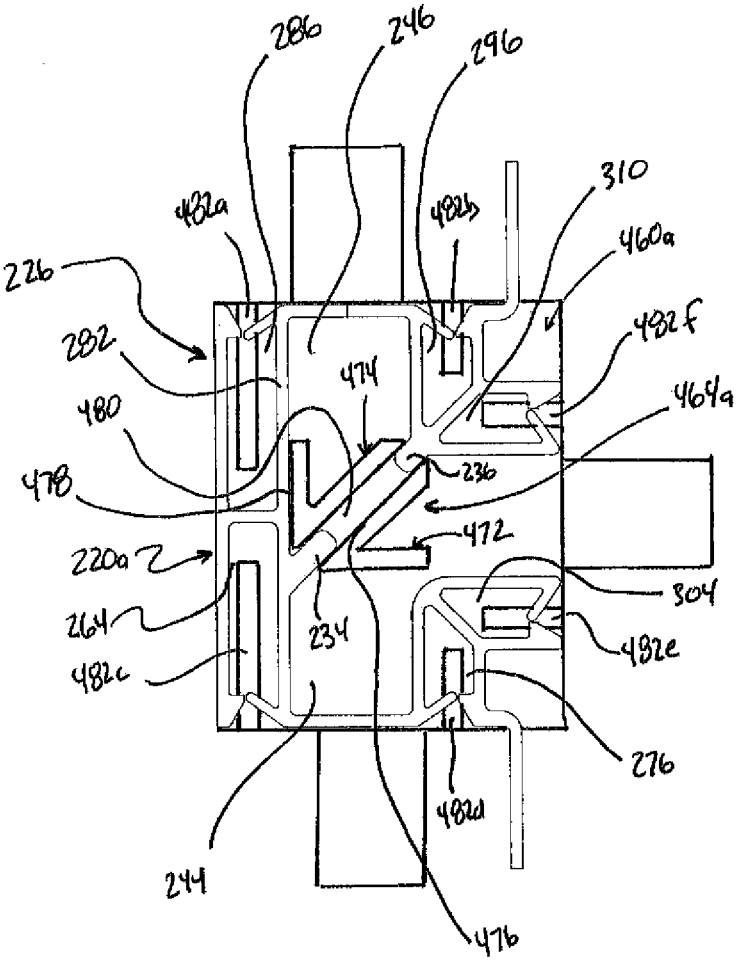

Returning to FIGS. 1B, 1C, and 11, the shelf 604 is then formed on the base region 606, and includes two of the panels 34*c*, 34*d*, four of the horizontal post frame members 220*a*-220*d*, and four of the four-way corner connectors 460*a*-460*d*. Coupling of the horizontal post frame members 220*a*-220*d* with the four-way corner connectors 460*a*-460*d* is akin to previous descriptions, and generally entails press fitting of one of the plug assemblies 464 (identified for the first four-way corner connector 460*a*) into a corresponding one of the horizontal post frame members 220*a*-220*d*. FIG. 14A illustrates an end view of the first horizontal post frame member 220*a* and an end view of the first four-way corner connector 460*a*, including the plug assembly 464*a*, prior to assembly. FIG. 14B depicts a relationship between the components 220*a*, 460*a* upon final assembly. As shown, coupling of the horizontal post frame member 220*a* with the four-way corner connector 460*a* includes the guide shoulders 234, 236 of the horizontal post frame member 220*a* being frictionally received and captured within the channel 480 of the plug assembly 464*a*. The plug assembly prong bodies 472, 474 are lodged within the joint capture regions 244, 246, and are dimensioned and arranged in accordance with corresponding dimensions of the horizontal post frame member 220*a* such that the first engagement surfaces 476 frictionally abut the guide shoulders 234, 236, and the second engagement surface 478 of the second prong body 474 bears against the interior leg 282 of the second outer panel mounting assembly 226. Further, the slots 482*a*-482*f* in the first face 470*a* are aligned with corresponding ones of the frame member panel engagement regions 264, 276, 286, 296, 304, 310. Returning to FIG. 1C, the remaining horizontal post frame members 220*b*-220*d* are coupled to the four-way corner connectors 460*a*-460*d* in a similar fashion.

Figure 14C:
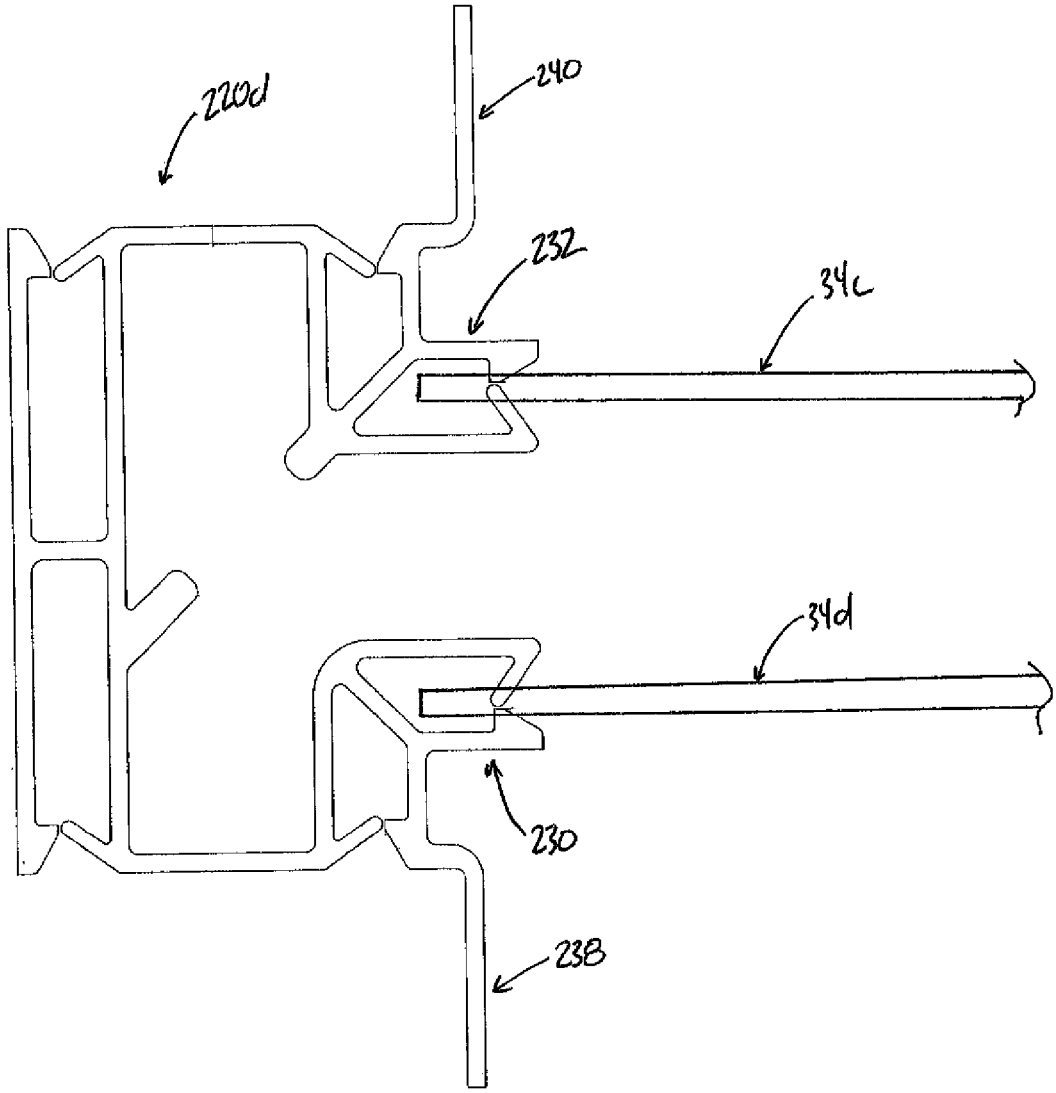
FIGS. 14C and 14D illustrate assembly between the horizontal post frame member of FIG. 5, the four-way corner connector of FIG. 8A, and panels in forming a shelf segment of the cabinet of FIG. 11 from kits in accordance with the principles of the present disclosure.

The panels 34*c*, 34*d* are assembled to one or more of the horizontal post frame members 220*a*-220*d* prior to final connection of all the frame members 220*a*-220*d* with all of the four-way corner connectors 460*a*-460*d*. For example, the first, second, and fourth horizontal post frame members 220*a*, 220*b*, 220*d* can be coupled with the first and second four-way corner connectors 460*a*, 460*b*, followed by insertion of the panels 34*c*, 34*d*, then mounting the third and fourth four-way corner connectors 460*c*, 460*d* to the second and fourth frame members 220*b*, 220*d*, and finally by coupling the third horizontal post frame member 220*c* to the third and fourth four-way corner connectors 460*c*, 460*d*. Regardless, FIG. 14C illustrates mounting of the panels 34*c*, 34*d* to the second and first platform mounting assemblies 232, 230, respectively, of the first horizontal post frame member 220*a*. As shown, the panels 34*c*, 34*d* are maintained in a spaced apart, substantially parallel arrangement. For reasons made clear below, the second flange 240 projects above the first or upper panel 34*c* (relative to the orientation of FIG. 14C), whereas the first flange 238 extends below the second or lower panel 34*d*.

Figure 14D:
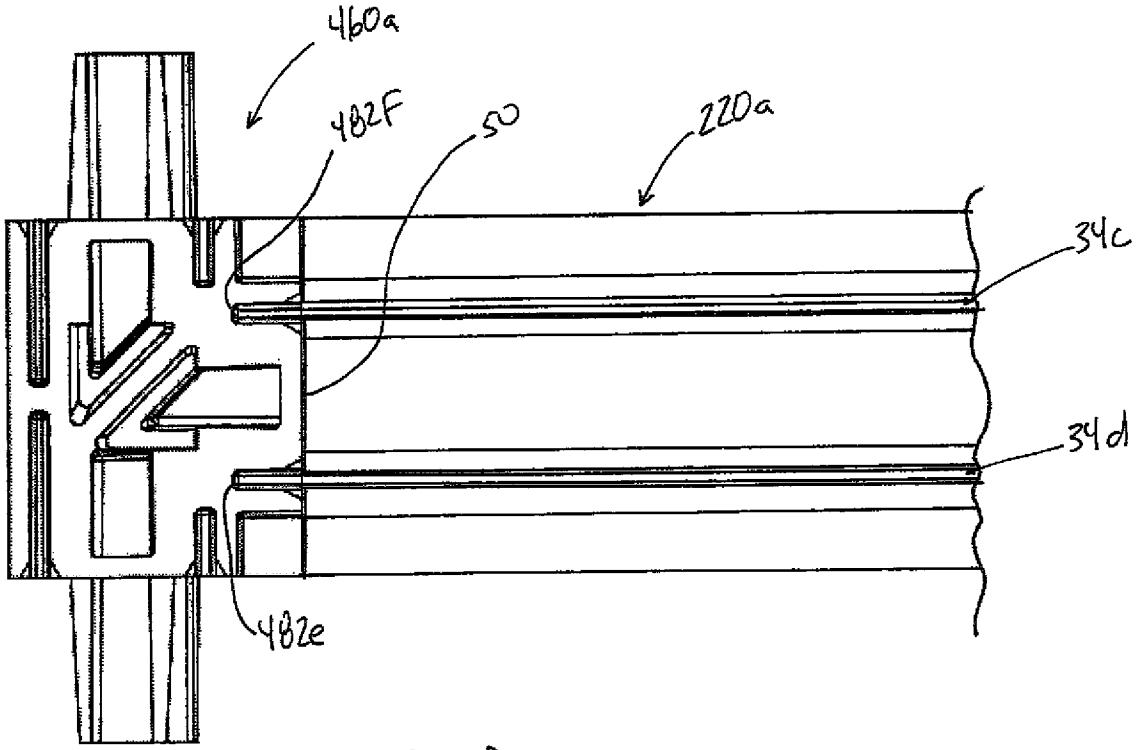

Returning to FIG. 1C, as with the three-way corner connectors 400 described above, the four-way corner connectors 460*a*-460*d* further support the substantially parallel arrangement of the panels 34*c*, 34*d* upon final assembly. As labeled in FIG. 1C, the third panel 34*c* defines four edges 640*a*-640*d*. A majority of the first edge 640*a* is coupled to the first horizontal post frame member 220*a*, the second edge 640*b* to the second frame member 220*b*, etc., However, the third panel 34*c* (as well as the fourth panel 34*d*) is dimensioned such that a length of each of the edges 640*a*-640*d* is greater than a length of the corresponding horizontal post frame member 220*a*-220*d* (e.g., the first edge 640*a* is longer than the first horizontal post frame member 220*a*, etc.). Thus, the edges 640*a*-640*d* project beyond the ends of the corresponding horizontal post frame members 220*a*-220*d* upon final assembly. The four-way corner connectors 460*a*-460*d* accommodate this excess material. For example, FIG. 14D illustrates an interior view of the first frame member 222*a* assembled to the first connector 460*a*. As a point of reference, the second plug assembly 464*b* visible in the view is coupled with the fourth frame member 220*d* (FIG. 1C); the plug assembly coupled to the first frame member 220*a* is hidden. Upon final assembly, the panels 34*c*, 34*d* extend beyond the first end 50 of the first horizontal post frame member 220*a* and into a corresponding one of the slots 482*e*, 482*f* of the first four-way corner connector 460*a*. Similar connections are made with the remaining corner connectors 460*b*-460*d*.

Figure 15A:
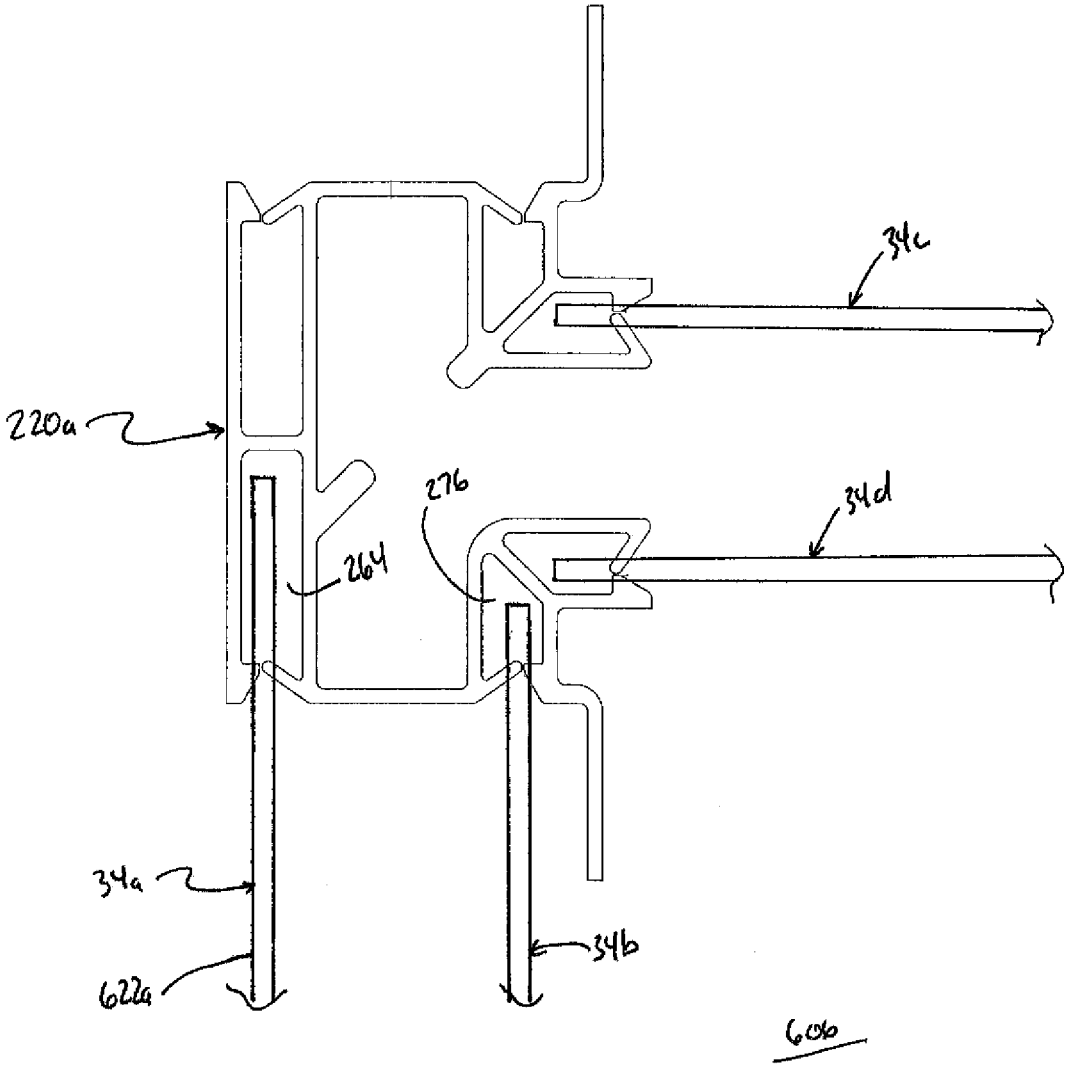
FIGS. 15A and 15B illustrate assembly of a portion of the shelf segment of the cabinet of FIG. 11 with panels included with the base region of the cabinet.
Figure 15B:
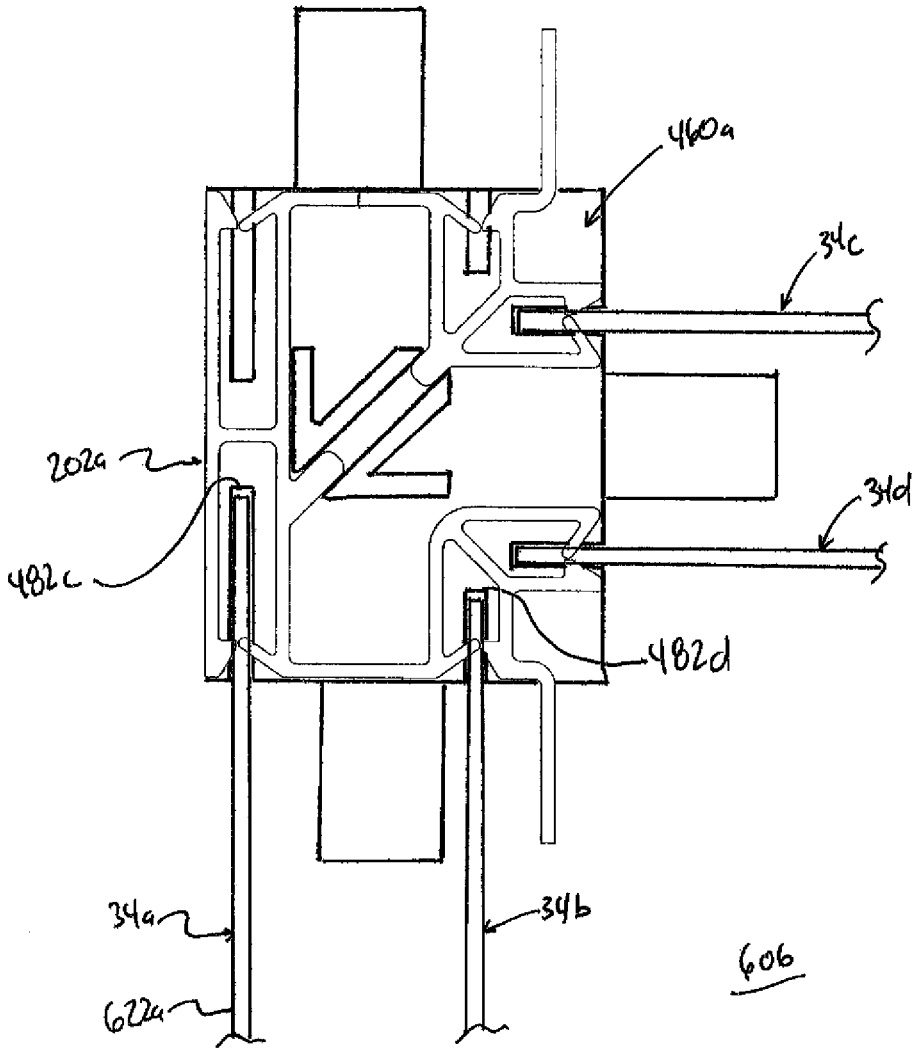

With reference between FIGS. 1B, 1C, and 11, the completed shelf 604 is then mounted onto the base region 606. In this regard, the four-way corner connectors 460*a*-460*d* facilitate a press-fit mounting with corresponding ones of the corner frame members 60*b*, 60*c*, 60*g*, 60*h*. For example, the plug assembly 464*c* identified for the first four-way corner connector 460*a* is coupled with the second end 52 of the second corner frame member 60*b*. Further, the horizontal post frame members 220*a*-220*d* of the shelf 604 are assembled to corresponding pairs of the base portion panels 34. FIG. 15A illustrates assembly of the first horizontal post frame member 220*a* (that otherwise retains the shelf panels 34*c*, 34*d* as previously described) to the panels 34*a*, 34*b* of the first face 622*a* of the base region 606. As shown, the base region panels 34*a*, 34*b* are received within corresponding ones of the panel engagement regions 264, 276. FIG. 15B illustrates a similar arrangement of the base region panels 34*a*, 34*b* within the slots 482*c*, 482*d* of the first four-way corner connector 460*a*.

Returning to FIGS. 1B, 1C, and 11, the product region 608 is formed by three of the clip frame members 160*a*-160*c*, five of the corner frame members 60*i*-60*m*, and four of the three-way corner connectors 400*e*-400*h*. The clip frame members 160*a*-160*c* are selected and sized to define the desired door opening 602 location, and arranged such that the corresponding flange 174 is positioned along a perimeter of the desired door opening 602. Mounting of the corner frame members 60*i*-60*m* with the three-way corner connectors 400*e*-400*h* is achieved pursuant to the descriptions above with respect to construction of the base region frame 620. Mounting of the clip frame members 160*a*-160*c* to the fifth and sixth three-way corner connectors 400*e*, 400*f* is accomplished in a similar manner, with one of the plug assemblies 404 of each of the three-corner connectors 400*e*, 400*f* being coupled to an end of a corresponding one of the clip frame members 160*a*-160*c*.

Figure 16A:
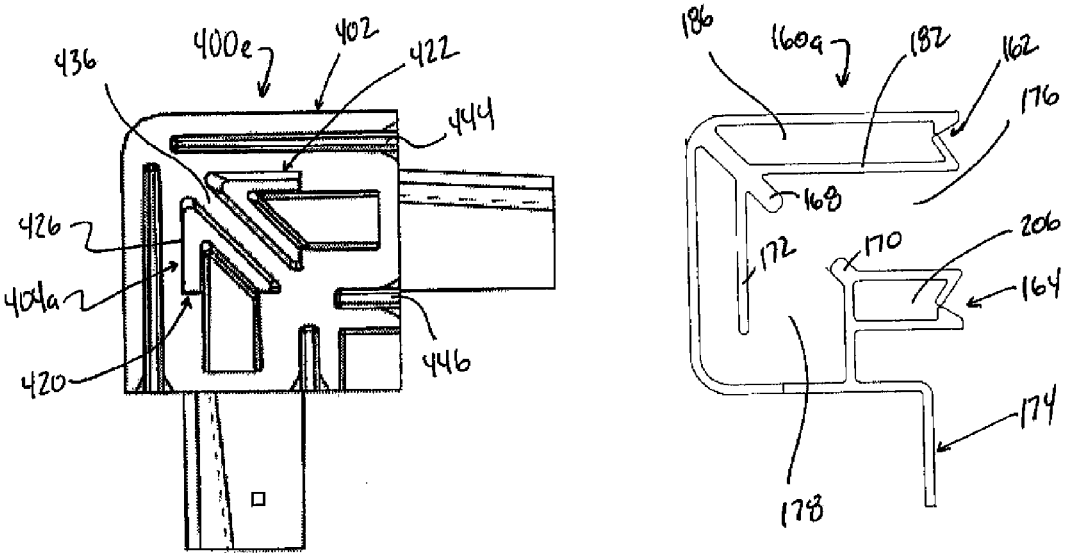
FIGS. 16A and 16B illustrate coupling between the clip frame member of FIG. 4 with the three-way corner connector of FIG. 7A in forming a portion of a product region of the cabinet frame of FIG. 11 from kits in accordance with the principles of the present disclosure.
Figure 16B:
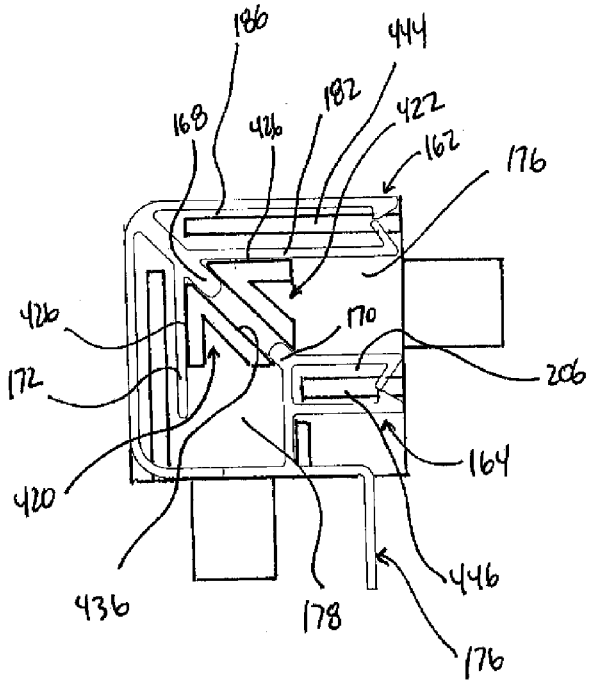
Figure 16C:
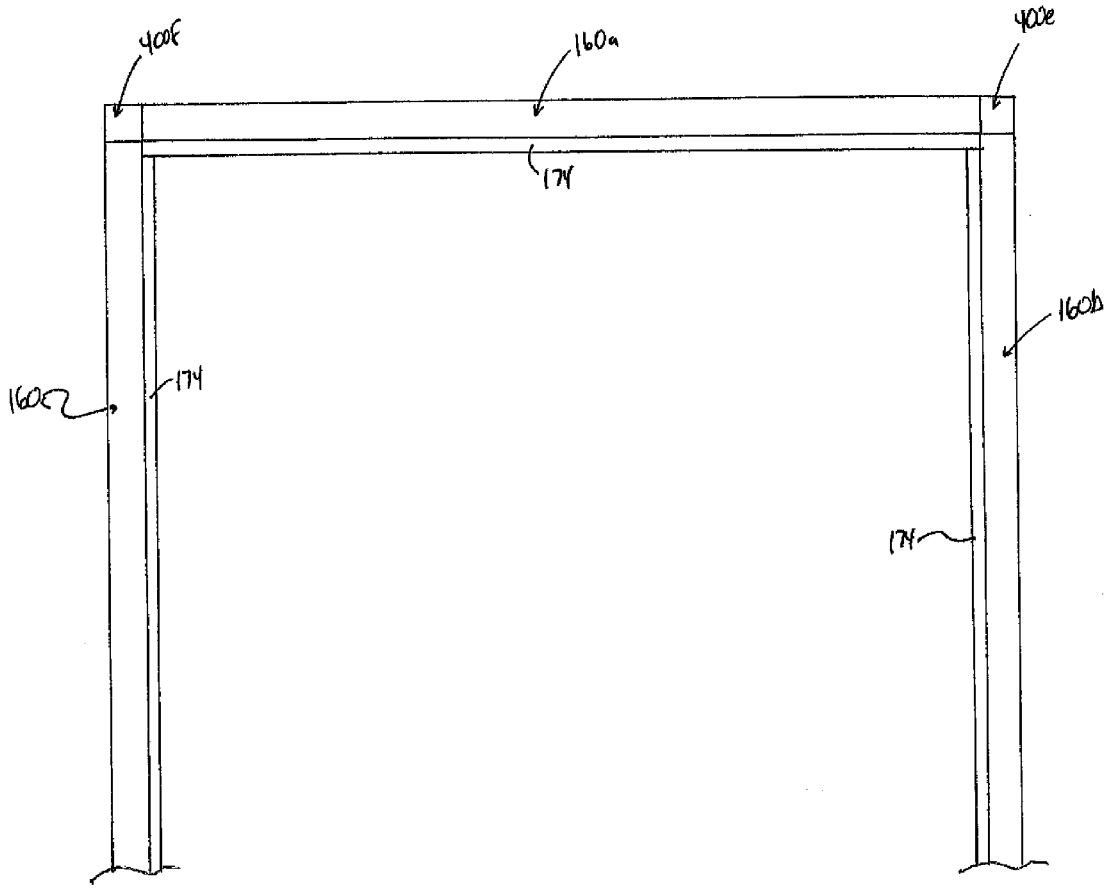
FIG. 16C is a front view of a portion of the product region of the cabinet frame of FIG. 11, illustrating three of the clip frame members of FIG. 4 coupled to two of the three-way corner connectors of FIG. 7A.

For example, FIG. 16A is an end view of the three-way corner connector 400*e* and the first clip frame member 160*a* prior to assembly, and FIG. 16B illustrates the components 160*a*, 400*e* coupled to one another. As shown, the frame member guide shoulders 168, 170 are frictionally captured within the channel 436 of the plug assembly 404*a*. The corner connector prong bodies 420, 422 are lodged within the joint capture regions 176, 178, and are dimensioned and arranged such that the second engagement surface 426 of the second prong body 422 frictionally abuts the interior leg 182 of the outer panel mounting assembly 162, and the second engagement surface 426 of the first prong body 420 frictionally abuts the support web 172. Further, the panel engagement regions 186, 206 of the panel mounting assemblies 162, 164 are aligned with the corner connector slots 444, 446, respectively. The flange 174 projects away from the block core 402. As generally reflected in FIG. 16C, the second and third clip frame members 160*b*, 160*c* are assembled to the fifth and sixth three-way corner connectors 400*e*, 400*f* in a similar manner. The clip frame members 160*a*-160*c* are arranged such that the corresponding flange 174 extends inwardly relative to an outer perimeter of the assembled clip frame members 160*a*-160*c* (e.g., the flange 174 of the second clip frame member 160*b* faces the third clip frame member 160*c*, etc.). At points of intersection between the clip frame members 160*a*-160*c*, the flanges 174 can overlap one another. In the view of FIG. 16C, the flange 174 of the first clip frame member 160*a* is disposed over the flange 174 of the second and third clip frame members 160*b*, 160*c*.

With reference between FIGS. 1B, 1C, and 11, pairs of the panels 34 are mounted to the frame members 160*a*-160*c*, 60*i*-60*m* at various stages of frame member/corner connector assembly. For example, the panels 34 of the product region 608 can include fifth-twelfth panels 34*e*-34*l* generally identified in FIG. 1C, with the fifth and sixth panels 34*e*, 34*f* combining to form a top of the product region 608. In this regard, the fifth and sixth panels 34*e*, 34*f* can be assembled to the corner frame members 60*i*, 601, 60*m* (and the seventh and eighth three-way corner connectors 400*g*, 400*h*) prior to mounting of the fifth and sixth three-way corner connector 400*e*, 400*f* (and thus the first clip frame member 160*a*) thereto. Coupling of the panels 34*c*-34*l*, the frame members 60*i*-60*m*, 160*a*-160*c*, and the corner connectors 400*e*-400*h* can be performed consistent with previous explanations.

Figure 17A:
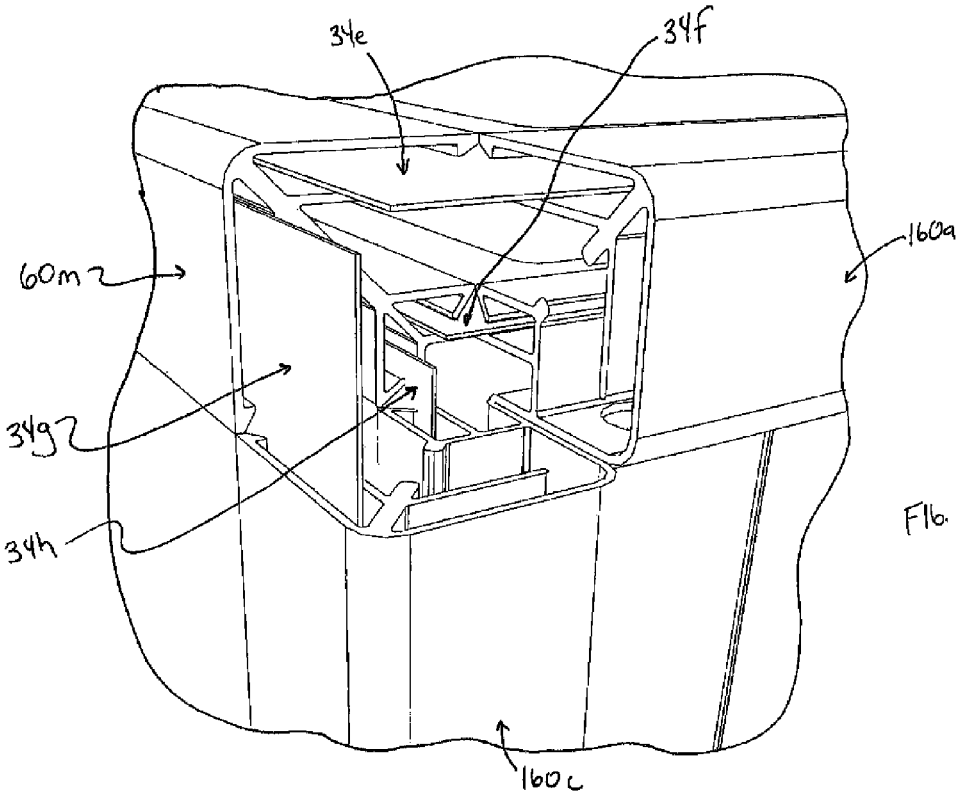
FIGS. 17A and 17B are perspective views illustrating a three-way joint formed by the cabinet frame of FIG. 11.
Figure 17B:
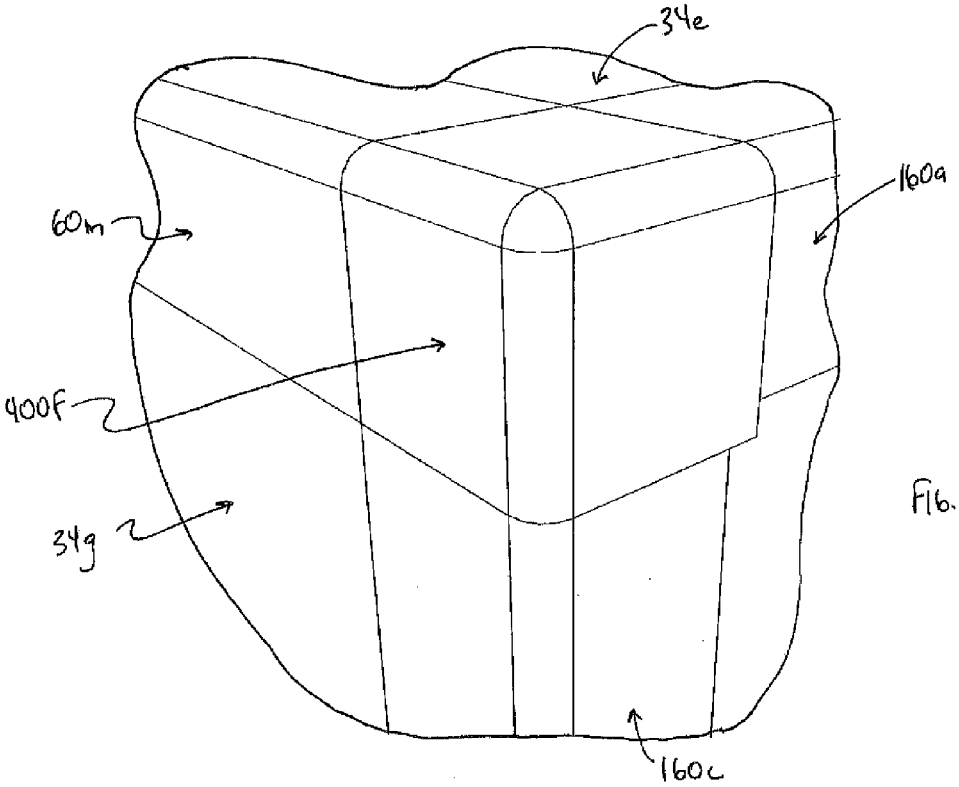

Upon final assembly, corner joints are formed at each of the three-way corner connectors 400*e*-400*h*. FIG. 17A illustrates the corner joint formed at an intersection of the first clip frame member 160*a*, the third clip frame member 160*c*, and the thirteenth corner frame member 60*m*. For ease of illustration, the sixth three-way corner connectors 400*f* (FIG. 1C) is removed from the view. The panels 34*e*, 34*f* are retained and supported in a spaced apart, substantially parallel manner by the first clip frame member 160*a* and the thirteenth corner frame member 60*m* (as well as the sixth three-way corner connector 400*f* when coupled thereto). The panels 34*g*, 34*h* are similarly retained and supported in a spaced apart, substantially parallel fashion by the third clip frame member 160*c* and the thirteenth corner frame member 60*m* (as well as the sixth three-way corner connector 400*f* when attached thereto). The panels 34*e*-34*h* project beyond the corresponding end of each of the frame members 160*a*, 160*c*, 60*m*, and are frictionally engaged by the sixth three-way corner piece 400*f* as described above. FIG. 17B illustrates the corner joint with the sixth three-way corner piece 400*f* coupled to the frame members 60*m*, 160*a*, 160*c*.

Figure 18A:
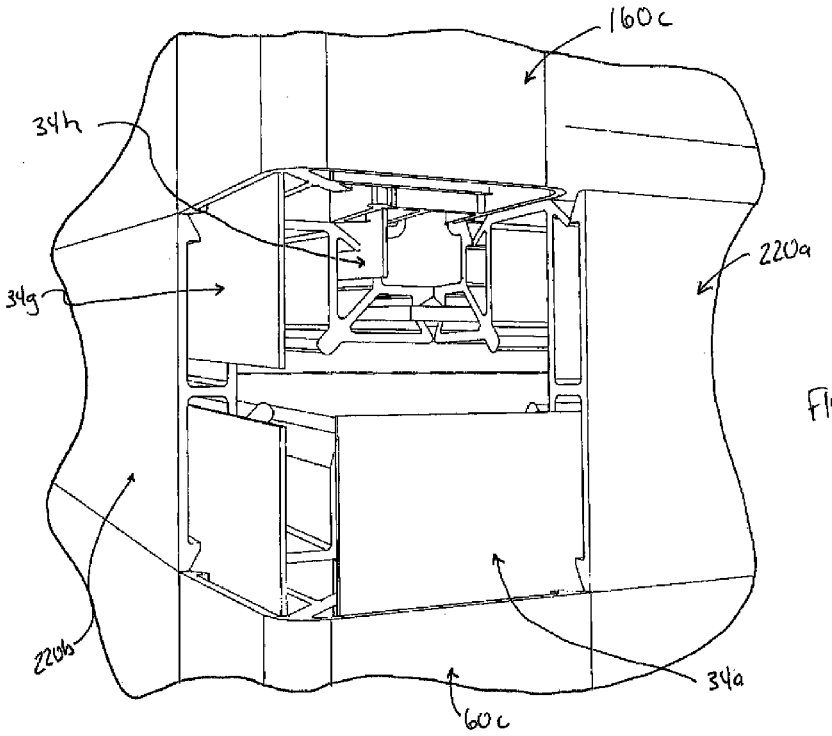
FIGS. 18A and 18B are perspective views illustrating a four-way joint formed by the cabinet frame of FIG. 11.
Figure 18B:
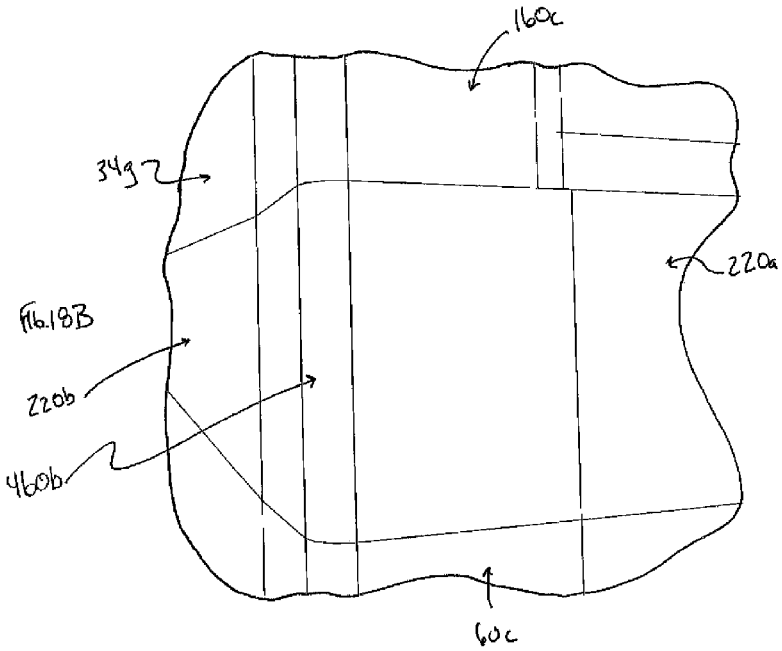

Returning to FIGS. 1B, 1C, and 11, the product portion 608 is then assembled to the shelf 604 by coupling the frame members 160*b*, 160*c*, 60*j*, 60*k* of the product portion 608 with the four-way corner connectors 460*a*-460*d* of the shelf 604. For example, the second clip frame member 160*b* is coupled to the plug assembly 464*a* of the first four-way corner connector 460*a* as previously described, etc. With this mounting, a mid-level joint is formed at each of the four-way corner connectors 460*a*-460*d*. FIG. 18A illustrates the mid-level joint formed at the second four-way corner connector 460*b* (with the four-way corner connector 460*b* removed from the view for ease of explanation). As shown, the seventh and eighth panels 34*g*, 34*h* (otherwise retained by the third clip frame member 160*c*) are received and engaged by the second horizontal post frame member 220*b*. FIG. 18B illustrate the mid-level joint with the second four-way corner connector 460*b* assembled thereto.

Figure 19:
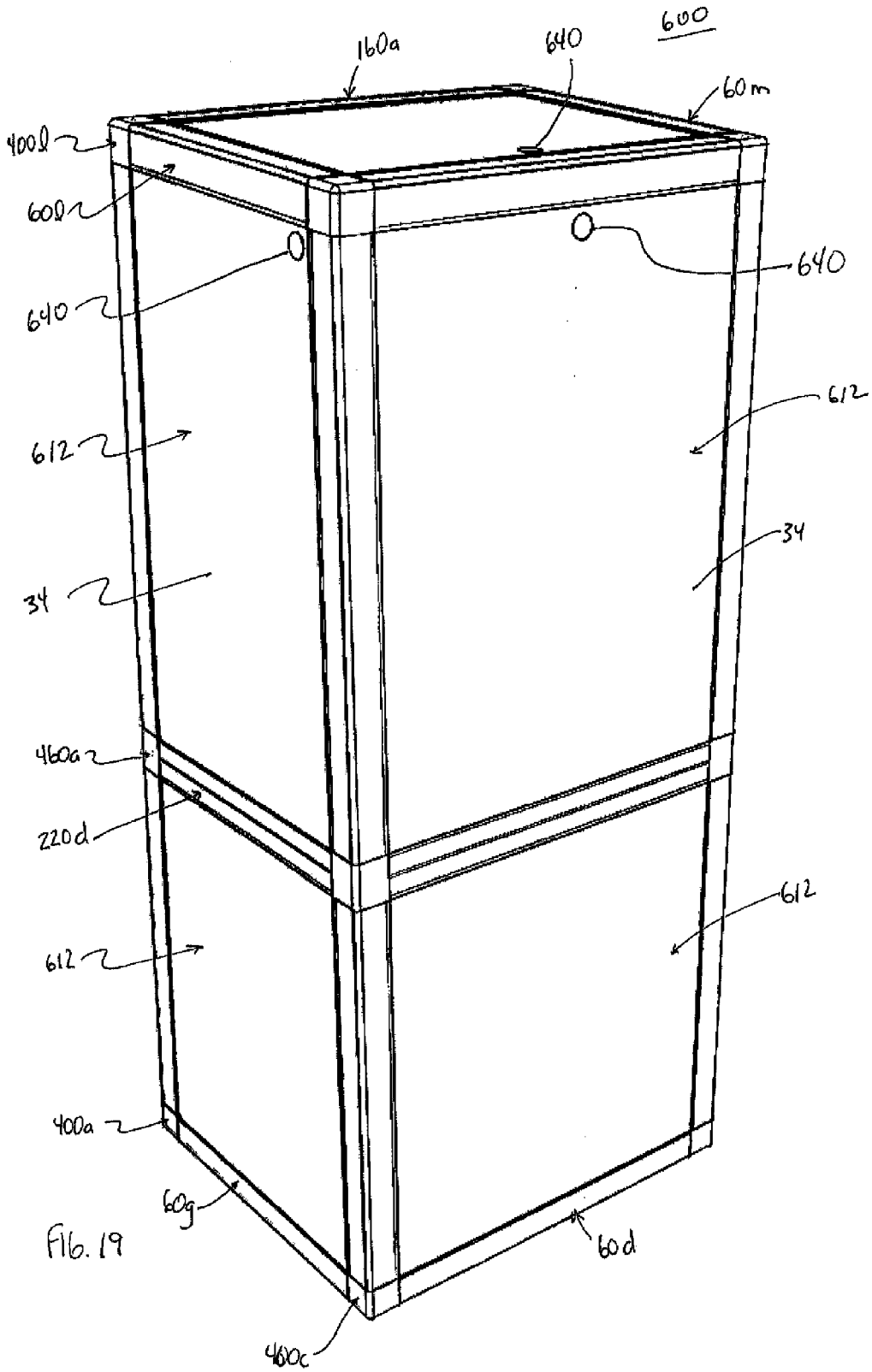
FIG. 19 is a rear perspective view of the cabinet frame of FIG. 11.
Figure 20A:
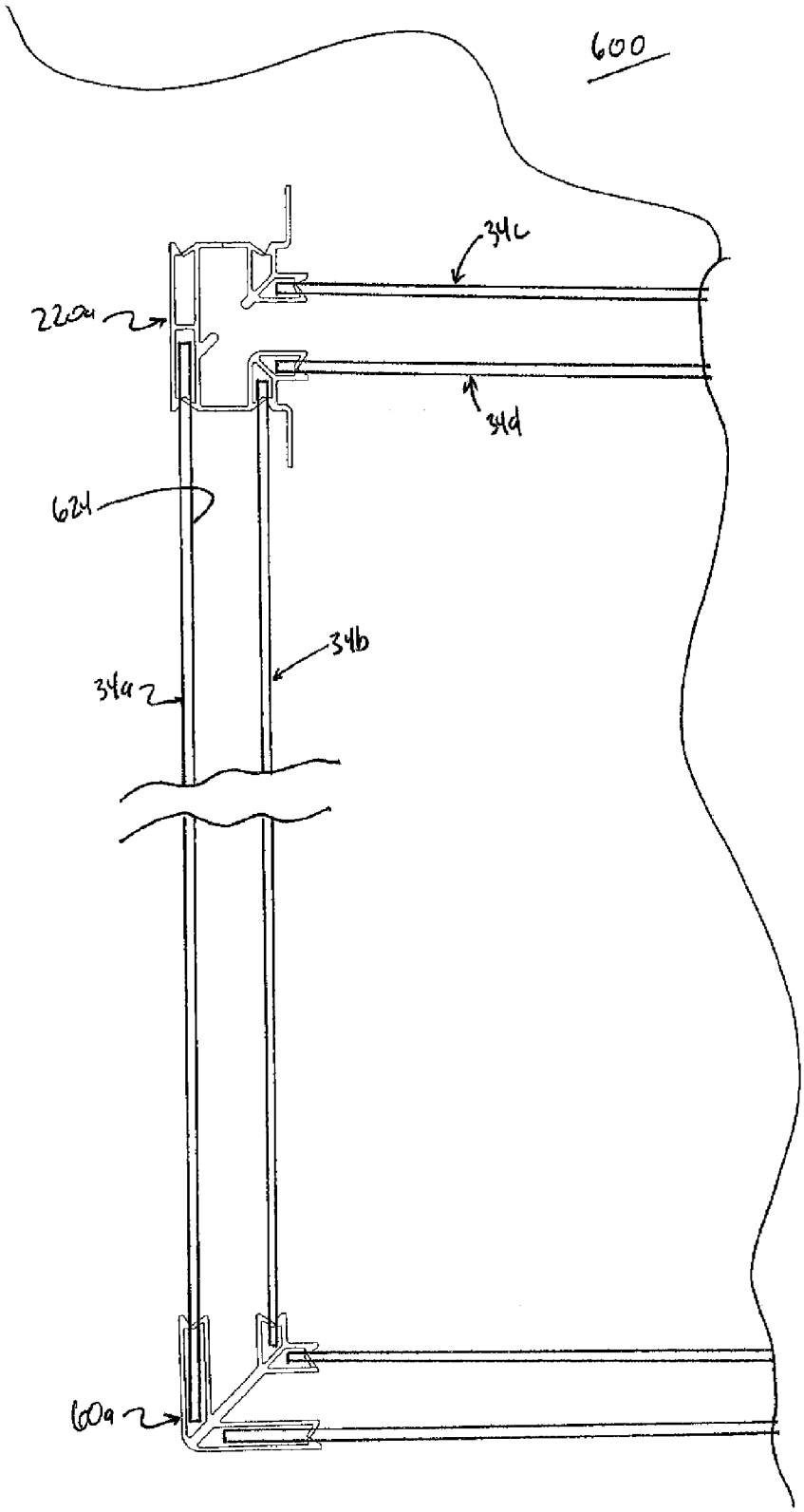
FIGS. 20A and 20B are transverse, cross-sectional views of a portion of the unit of FIG. 1B, illustrating foam insulation dispensed between a pair of panels.
Figure 20B:
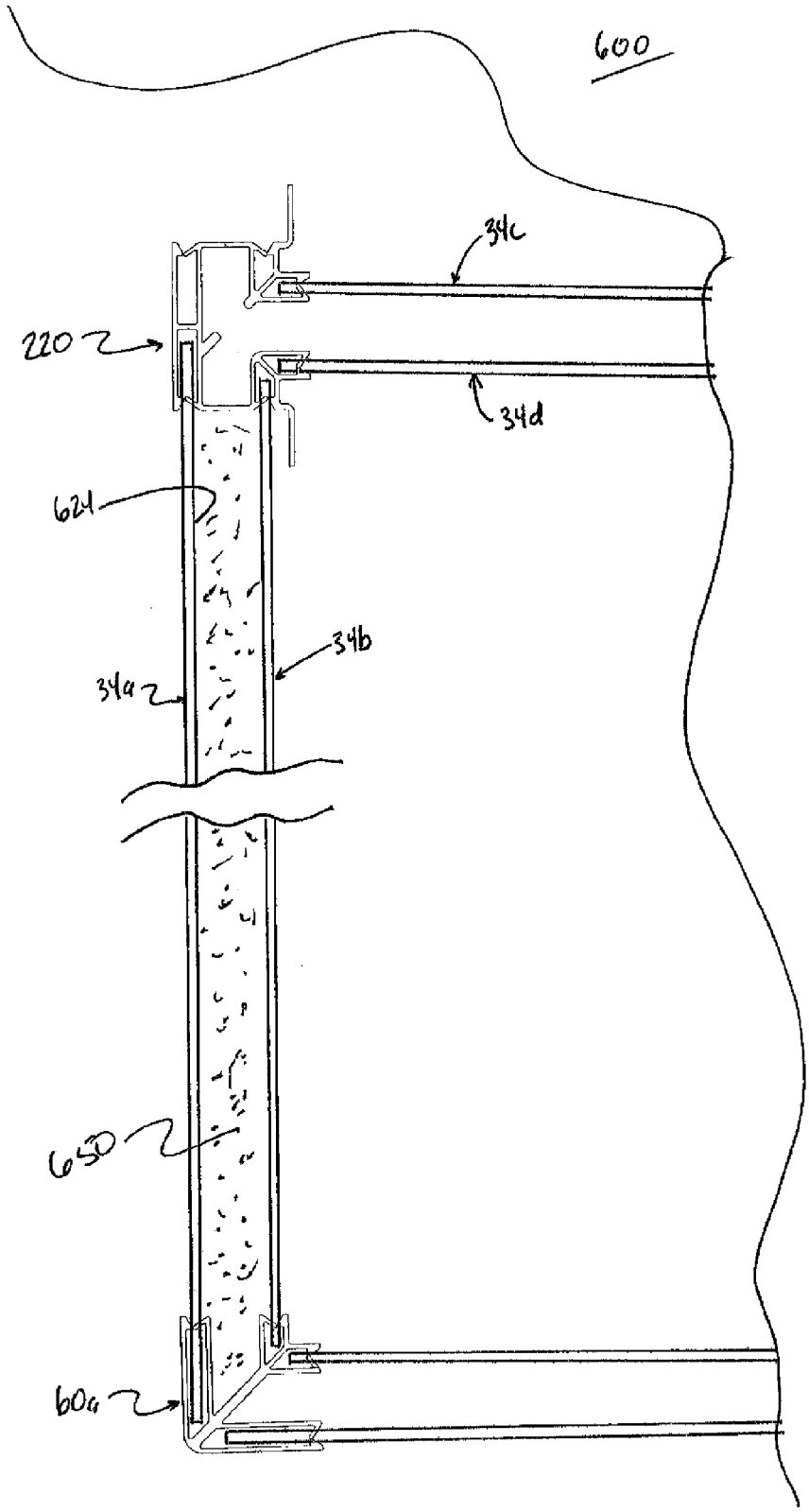

Final construction of the cabinet 600 is shown in FIG. 19. Except for the door opening 602 (hidden in FIG. 19 but shown, for example, in FIG. 11) each of the exterior faces are closed or encompassed by the side walls 612, with each of the side walls 612 being formed by a pair of spaced apart, substantially parallel panels 34. With some kits and methods of the present disclosure, insulation is added to the cabinet 600. For example, a source of foaming insulation 44 (FIG. 1A) is provided and is employed to dispense the foaming insulation between corresponding pairs of the panels 34. FIG. 19 indicates various ports 640 formed in selected ones of the panels 34 to facilitate dispensement of the foaming insulation. Notably, the gap between the opposing pair of panels 34 is effectively sealed by the frame members surrounding a perimeter of the panel pairs. For example, FIG. 20A illustrates a portion of the cabinet 600, including the first and second panels 34*a*, 34*b* as retained by the first corner frame member 60*a* and the first horizontal post frame member 220*a* (it being understood from reference to FIGS. 1C and 11 that the panels 34*a*, 34*b* are further held by the second and third corner frame members 60*b*, 60*c*, and the connectors 400*a*, 400*b*, 460*a*, 460*b*). The frame members 60*a*-60*c*, 220*a* exteriorly close the gap 624 between the panels 34*a*, 34*b*. In the view of FIG. 20B, a foam insulation 650 has been dispensed into and fills the gap 624, expanding into the frame members 60*d*, 60*h*, 220*a*. Though not shown in FIG. 20B, the insulation 250 further spreads into the various corner connectors 400*a*, 400*b*, 460*a*, 460*b* (FIG. 1C) coupled to the frame members 60*a*-60*c*, 220*a*. Once solidified, the insulation 650 binds the panels, frame members, and joint pieces together. A thickness of the resultant wall formed by the solidified insulation 650 and panel pairs (e.g., the panels 34*a*, 34*b*) can be in the range of 0.875-1.5 inches in some embodiments, depending upon the volume of insulation provided. In this regard, while a wall thickness at the joint pieces is relatively constant (e.g., on the order of 0.875 inch), an elevated volume of the insulation 650 can be delivered of disposed between the panel pairs (at locations apart from the corresponding frame members and joint pieces), causing the panels to slightly bow and assume a "pillow" shape. Other dimensions and shapes are also available.

Figure 21B:
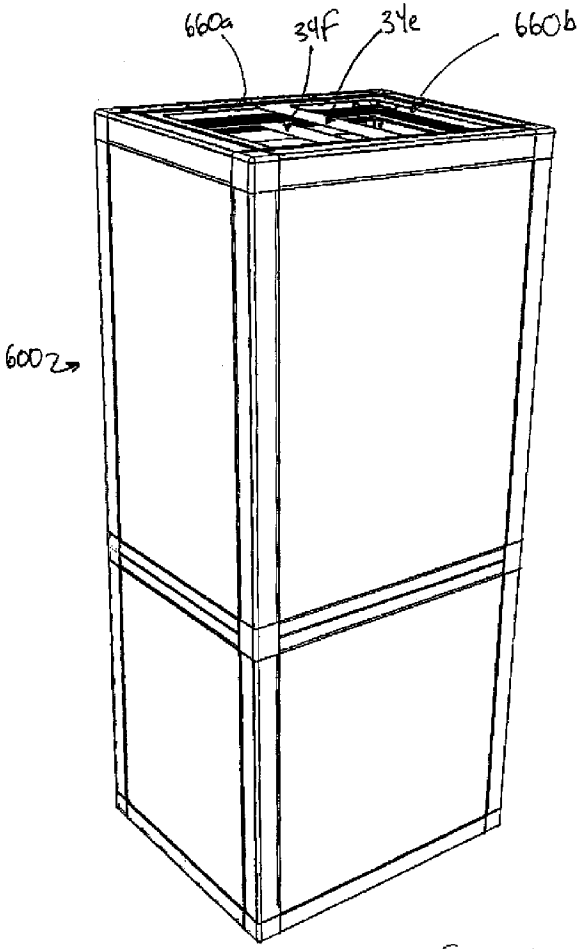
FIGS. 21A and 21B are perspective views illustrating assembly of a cooling unit to the cabinet frame of FIG. 11.
Figure 21A:
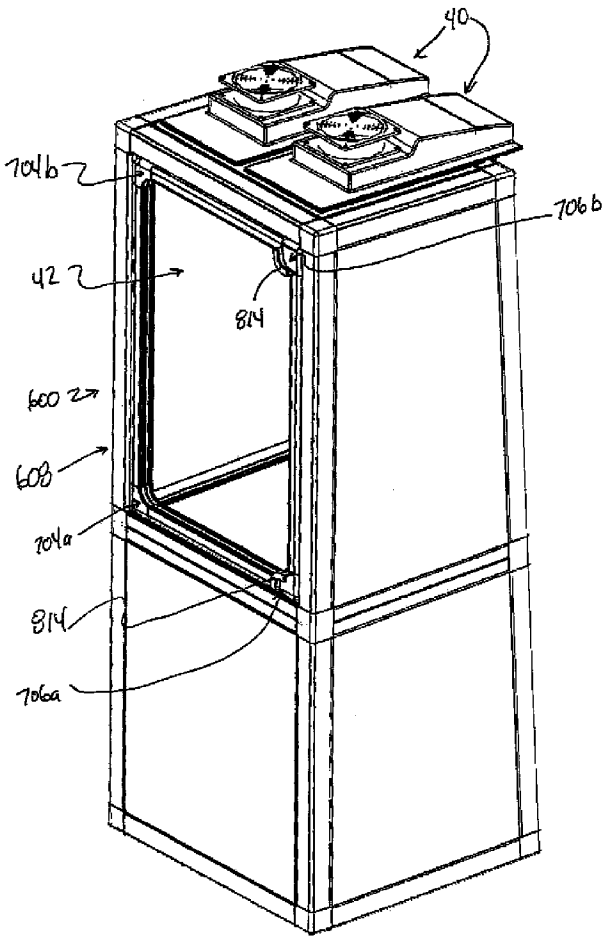

With reference to FIGS. 21A and 21B, the cooling unit 40 is then assembled to the cabinet frame. The cooling unit 40 can assume a variety of forms and in some embodiments is a thermoelectric-based device, such as described in U.S. Publication No. 2007/0193280 entitled "Portable Cooled Merchandizing Unit with Customer Enticement Features"; the entire teachings of which are incorporated herein by reference. Other available cooling unit formats can also be employed within the scope of the present disclosure, such as vapor compression (compressor based), ice packs, dry ice, etc. Further, the cooling unit 40 can consist of two (or more) discrete devices. Mounting of the cooling unit 40 can be accomplished in various manners. In one construction, for example, passages 660*a*, 660*b* are cut in the top panels 34*e*, 34*f* to establish an open passageway into the product portion 608. The passages 660*a*, 660*b* are sized in accordance with the selected cooling unit 40. With the but one embodiment of FIGS. 21A and 21B, the cooling unit 40 includes two thermoelectric devices, with the passages 660*a*, 660*b* being sized in accordance with a respective one of the devices. Alternatively, the cooling unit 40 can be assembled to any other face of the cabinet 600 (e.g., back, front, side, etc.).

Finally, the door assembly 42 is assembled to the door opening 602. In some embodiments, the door assembly 42 is provided as a completed structure with kits of the present disclosure. Under these circumstances, the cabinet 600 is constructed such that the door opening 602 corresponds in size and shape with the provided door assembly 42. In other embodiments, a size and shape of the door assembly 42 can be selected and assembled by the user using additional components provided with the kit described below.

Door Assembly 42

As shown in FIG. 1C, the door assembly 42 components optionally provided with the kit 30 can include one or more panes 700, a plurality of door frame members 702, a plurality of hinge connectors 704, and a plurality of handle connectors 706. Additional components, such as a plurality of caps 708, can also be included.

The panes 700 are rigid planar bodies formed of a transparent or substantially transparent material having insulative properties. For example, the panes 700 can be a polyethylene terephthalate Plexiglas material (PETG). The panes 700 have a substantially uniform thickness, for example on the order of 0.080 inch.

The door frame members 702 are, in many respects, akin to the frame members 36, formed as elongated plastic extrusions and configured to retain two of the panes 700 in a spaced apart, substantially parallel arrangement. The door frame members 702 have a substantially uniform shape along an entire length thereof, one example of which is shown by the end view of FIG. 22. The door frame member 702 includes or forms first and second pane mounting assemblies 720*a*, 720*b*, and a connection web 722, and guide shoulders 724*a*, 724*b*. The connection web 722 interconnects the mounting assemblies 720*a*, 720*b*, and combines with the shoulders 724*a*, 724*b* to form a joint capture region 726.

The pane mounting assemblies 720*a*, 720*b* are identical in some embodiments, with the following description of the first pane mounting assembly 720*a* applying equally to the second pane mounting assembly 720*b*. The pane mounting assembly 720*a* includes an opposing pair of legs 728*a*, 730*a* and a pane base web 732*a*. The legs 728*a*, 730*a* extend from the base web 732*a* in a substantially parallel fashion (e.g., within 5 degrees from a truly parallel relationship) in the normal or undeflected state of FIG. 22, each terminating at a free end 734*a*, 736*a* that optionally forms an inwardly projecting tab 738*a*, 740*a*. A transverse spacing between the legs 728*a*, 730*a* defines a pane engagement region 742*a*, with a gap 744*a* between the tabs 738*a*, 740*a* having a reduced transverse dimension as compared to a remainder of the pane engagement region 742*a*. More particularly, a width of the gap 744*a* is less than a thickness of the panes 700 (FIG. 1C) such that upon insertion of one of the panes 700 into the pane engagement region 742*a*, the tabs 738*a*, 740*a* frictionally engage the pane 700.

The pane base webs 732*a*, 732*b* extend from opposites sides of the connection web 722. For reasons made clear below, in some constructions, the pane base webs 732*a*, 732*b* can have an exteriorly curved shape.

The connection web 722 arranges the pane mounting assemblies 720*a*, 720*b* such that the legs 728*a*, 728*b*, 730*a*, 730*b* are substantially parallel (e.g., within 5° of a truly parallel relationship) in the normal or undeflected state. Thus, when two of the panes 700 (FIG. 1C) are coupled within respective ones of the pane engagement regions 742*a*, 742*b*, the two panes 700 are maintained in spaced apart, substantially parallel arrangement (either by door frame member 702 alone, or in combination with other components such as the connectors 704, 706 (FIG. 1C)).

The first guide shoulder 724*a* projects from the interior leg 730*a* of the first pane mounting assembly 720*a* toward the second pane mounting assembly 720*b*. The second guide shoulder 724*b* is aligned with the first guide shoulder 724*a*, extending from the second pane mounting assembly interior leg 730*b*. In some configurations, the guide shoulders 724*a*, 724*b* are discretely spaced from one another so as to not impede deflection of the interior legs 730*a*, 730*b* when receiving the panes 700 (FIG. 1C) and/or permit insertion of a third pane therebetween. Alternatively, the guide shoulders 724*a*, 724*b* can be formed as a single, homogenous web. Regardless, a lateral distance between the guide shoulders 724*a*, 724*b* and an inner surface 746 of the connection web 722 corresponds with a common mounting feature of the connectors 704, 706 (FIG. 1C) to promote coupling within the joint capture region 726.

Returning to FIG. 1C, the connectors 704, 706 are akin to the joint pieces 36, provided in either a hinge or handle format. One embodiment of the hinge connector 704 is shown in greater detail in FIGS. 23A-23C, and generally includes a core 760, first and second prong bodies 762*a*, 762*b*, and a pin 764. The hinge connector 704 can be a homogenous injection molded plastic part having a rigid, structurally robust construction.

The core 760 defines an exterior surface 770 (referenced generally) and an interior surface 772. The interior surface 772 provides or forms first and second faces 774, 776, and an intermediate face 778. The first and second faces 774, 776 are generally planar, arranged substantially perpendicular to one another. While the first and second faces 774, 776 are planar, the intermediate face 778 can have the concave curvature as shown. Other shapes are also acceptable. Regardless, first and second slots 780, 782 are formed into a thickness of the core 760 at opposite sides of the plug bodies 762*a*, 762*b*. The slots 780, 782 are open to the interior surface 772, and are substantially parallel with one another, and are generally sized to receive one of the panes 700 (FIG. 1C). In some constructions, the slots 780, 782 are formed to have a uniformly increasing width from the first face 774 to the second face 776. That is to say, a width of the slots 780, 782 at the first face 774 is less than a width of the slots 780, 782 at the second face 776. Optionally, the core 760 can form an additional third slot 784 into the interior surface 772, located between, and substantially parallel to, the first and second slots 780, 782. Where provided, the third slot 784 has the tapered width characteristics described above with respect to the first and second slots 780, 782, and intersects the prong bodies 762*a*, 762*b*.

The first prong body 762*a* projects from the first face 774; the second prong body 762*b* projects from the second face 776. Consistent with the above explanations then, a direction of extension of the first prong body 762*a* is substantially orthogonal to a direction of extension of the second prong body 762*b* (e.g., within 5° of a truly perpendicular relationship).

Figure 22:
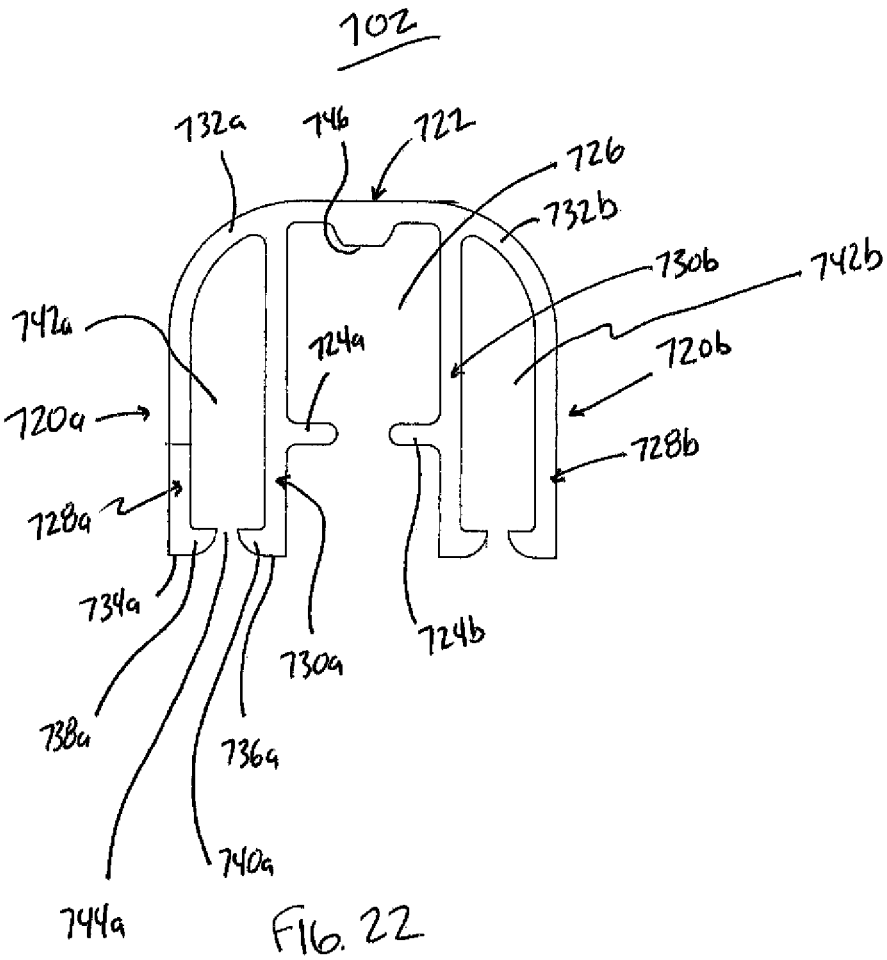
FIG. 22 is an end view of a door frame member useful with some embodiments of the kit of FIG. 1A.

The prong bodies 762*a*, 762*b* are sized and shaped to frictionally interface with the joint capture region 726 (FIG. 22) provided with the door frame members 702 (FIG. 22). For example, the first prong body 762*a* has a generally rectangular or square shape in transverse cross-section, defining first-fourth sides 790*a*-796*a* (best identified in FIG. 23C). With embodiments in which the hinge connector 704 includes the third slot 784, a secondary slot 798*a* is formed through the fourth side 796*a* of the first prong body 762*a* and is aligned with (and open to) the third slot 784. The second prong body 762*b* can be essentially identical to the first plug body 762*a*, defining four sides 790*b*-796*b*. Further, a secondary slot 798*b* is formed through the fourth side 796*b*, and is aligned with (and open to) the third slot 784 (where provided). In accordance with previous descriptions with respect to the tapered width of the third slot 784, the secondary slot 798*b* in the second prong body 762*b* is wider than the secondary slot 798*a* in the first prong body 762*a*.

The pin 764 can assume various shapes and sizes, and is generally configured to facilitate a rotatable mounting of the hinge connector 704 with a separate bushing. Thus, the pin 764 can have the cylindrical shape shown. Regardless, the pin 764 projects from the exterior surface 770 in a direction generally aligned with, but opposite of, the second prong body 762*b*.

Figure 23A:
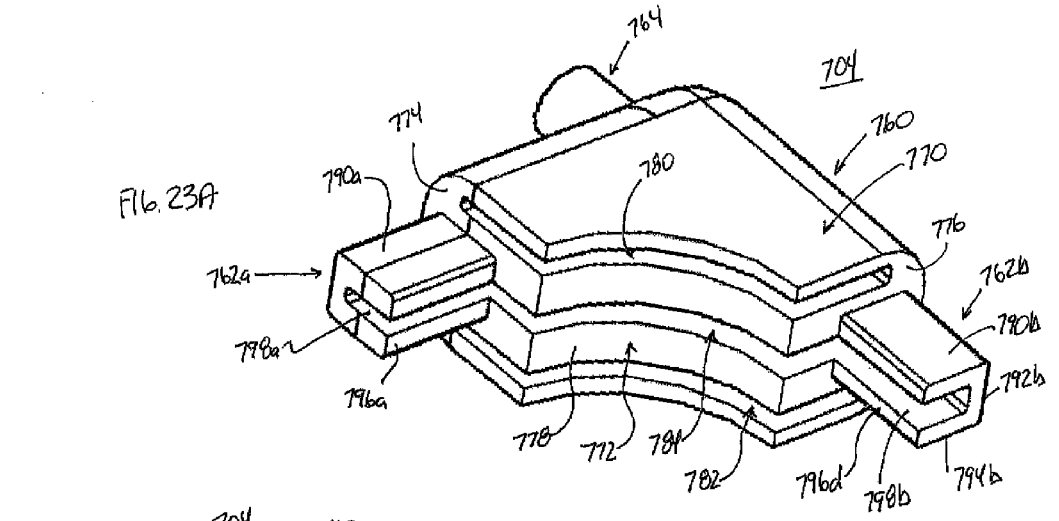
FIG. 23A is a perspective view of a hinge connector useful with some embodiments of the kit of FIG. 1A.
Figure 23B:
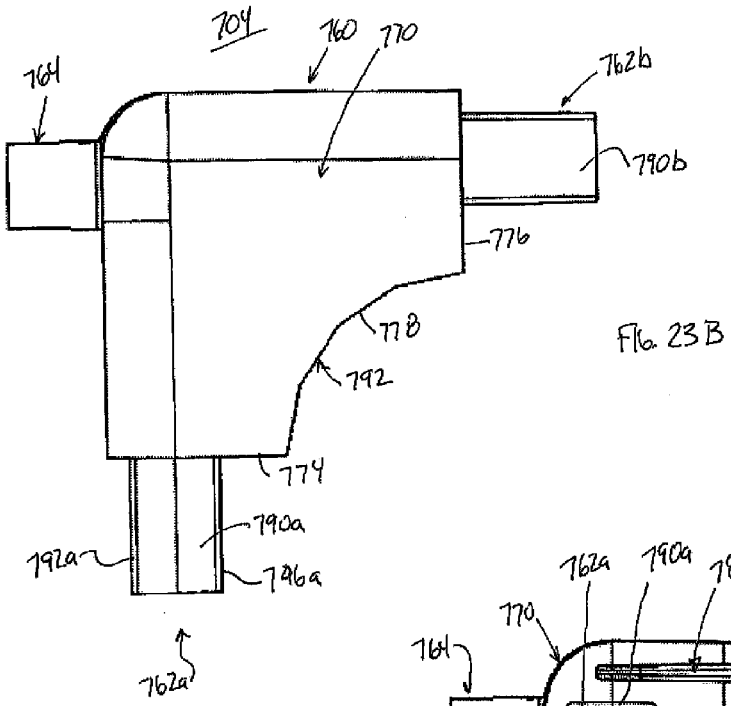
FIG. 23B is a top view of the hinge connector of FIG. 23A.
Figure 23C:
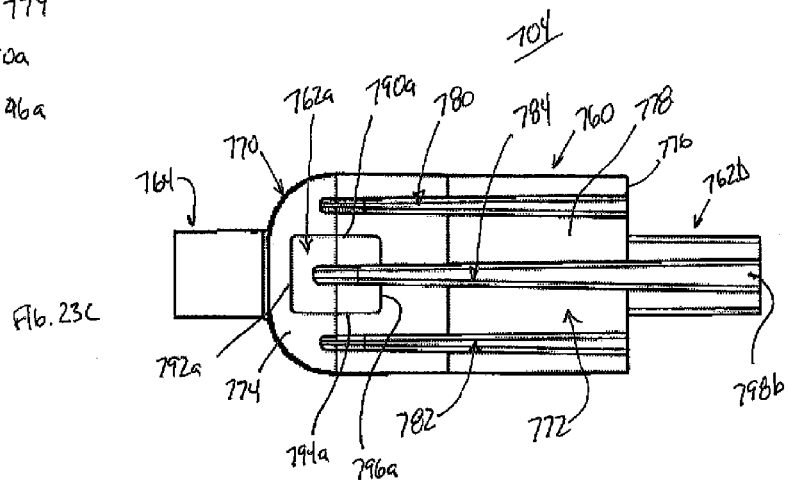
FIG. 23C is an interior side view of the hinge connector of FIG. 23A.
Figure 24A:
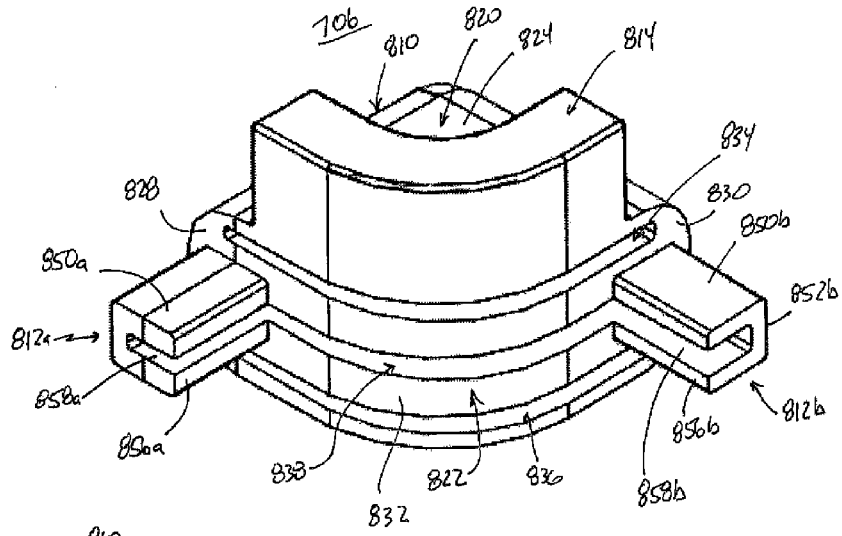
FIG. 24A is an interior perspective view of a handle connector useful with some embodiments of the kit of FIG. 1A.
Figure 24B:
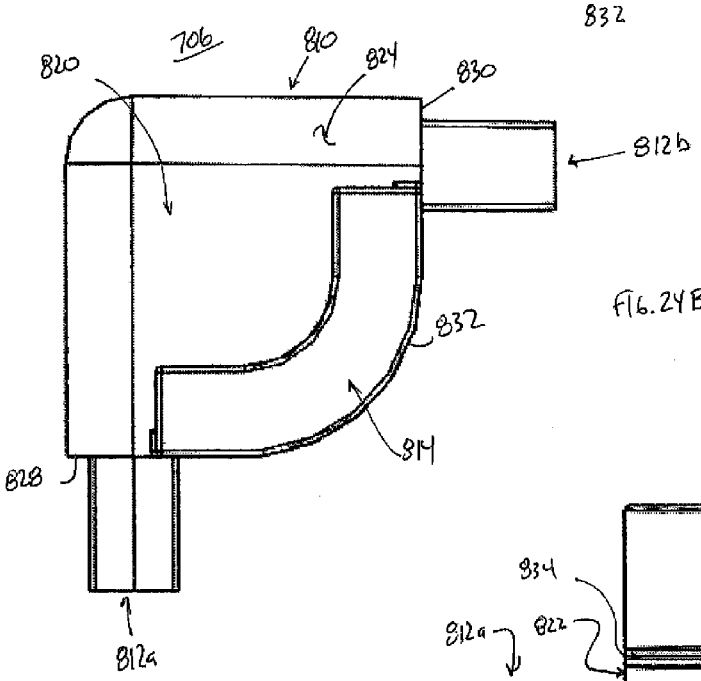
FIG. 24B is a top view of the handle connector of FIG. 24A.
Figure 24C:
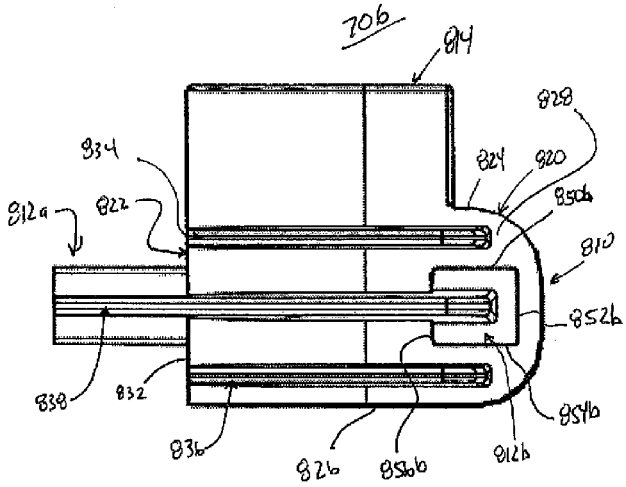
FIG. 24C is an interior side view of the handle connector of FIG. 24A.

FIGS. 24A-24C illustrate one embodiment of the handle connector 706. In many respects the handle connector 706 is akin to the hinge connector 704 (FIGS. 23A-23C), and includes a core 810, first and second prong bodies 812*a*, 812*b*, and a handle body 814. The core 810 defines an exterior surface 820 (referenced generally) and an interior surface 822. The exterior surface 820 has opposing major faces 824, 826. The interior surface 822 is defined by a first face 828, a second face 830, and an intermediate face 832. The first and second faces 828, 830 are substantially planar, and are arranged in a substantially perpendicular fashion relative to one another. The intermediate face 832 can have the convex curvature shown in extension between the first and second faces 828, 830, although other shapes are also envisioned. First and second slots 834, 836 are formed in a thickness of the core 810, extending in a substantially parallel fashion at opposite sides of the prong bodies 812*a*, 812*b*. The slots 834, 836 are open to the interior surface 822, and are sized to receive one of the panes 700 (FIG. 1C). In some constructions, the slots 834, 836 exhibit an expanding width in extension from the first face 828 to the second face 830. Optionally, a third slot 838 can be formed between the first and second slots 834, 836 as shown.

The prong bodies 812*a*, 812*b* can be identical to the prong bodies 762*a*, 762*b* (FIGS. 23A-23C) described above. The first prong body 812*a* projects from the first face 828, whereas the second prong body 812*b* projects from the second face 830. Thus, the prong bodies 812*a*, 812*b* are substantially perpendicular to one another. The first prong body 812*a* defines four sides 850*a*-856*a*; the second prong body 812*b* defines four sides 850*b*-856*b*. The prong bodies 812*a*, 812*b* can further form a secondary slot 858*a*, 858*b* that is aligned with, and open to, the third slot 838 (where provided).

The handle body 814 projects from the first major face 824, and can be contiguous with the intermediate face 832 of the interior surface 772. Alternatively, the handle body 814 can assume other shapes, and can be located at other locations relative to the first major face 824. Regardless, the handle body 814 provides a convenient surface for grasping by a user as part of a door opening operation described below.

Figure 25A:
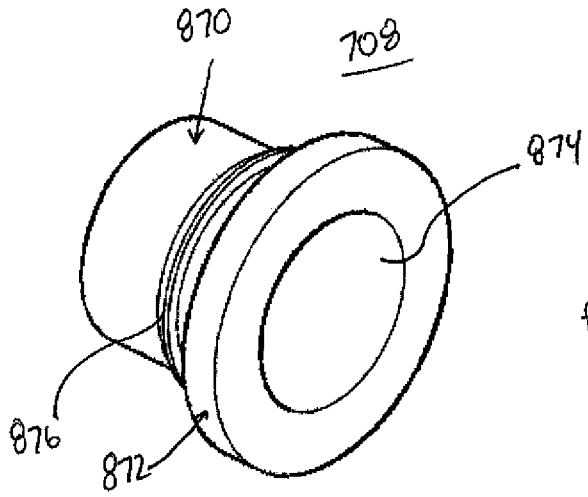
FIG. 25A is a perspective view of a cap useful with some embodiments of the kit of FIG. 1A.
Figure 25B:
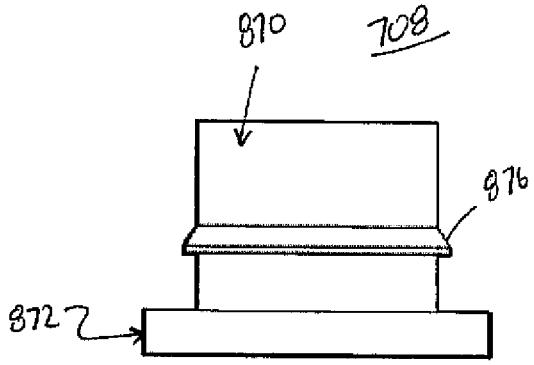
FIG. 25B is a side view of the cap of FIG. 25A.

The optional cap 708 is shown in greater detail in FIGS. 25A and 25B. The cap 708 is an injection molded plastic component, and includes a hub 870 and a flange 872. The hub 870 and the flange 872 have a cylindrical shape, with an outer diameter of the flange 872 being greater than that of the hub 870. A bore 874 extends longitudinally through the cap 708. A diameter of the bore 874 is sized to rotatably receive the hinge connector pin 764 (FIG. 23A). Finally, an annular barb 876 is optionally provided along the hub 870. The cap 708 can have a variety of other forms capable of promoting rotatable mounting of the hinge connector pin 764 relative to a cabinet frame.

Figure 26:
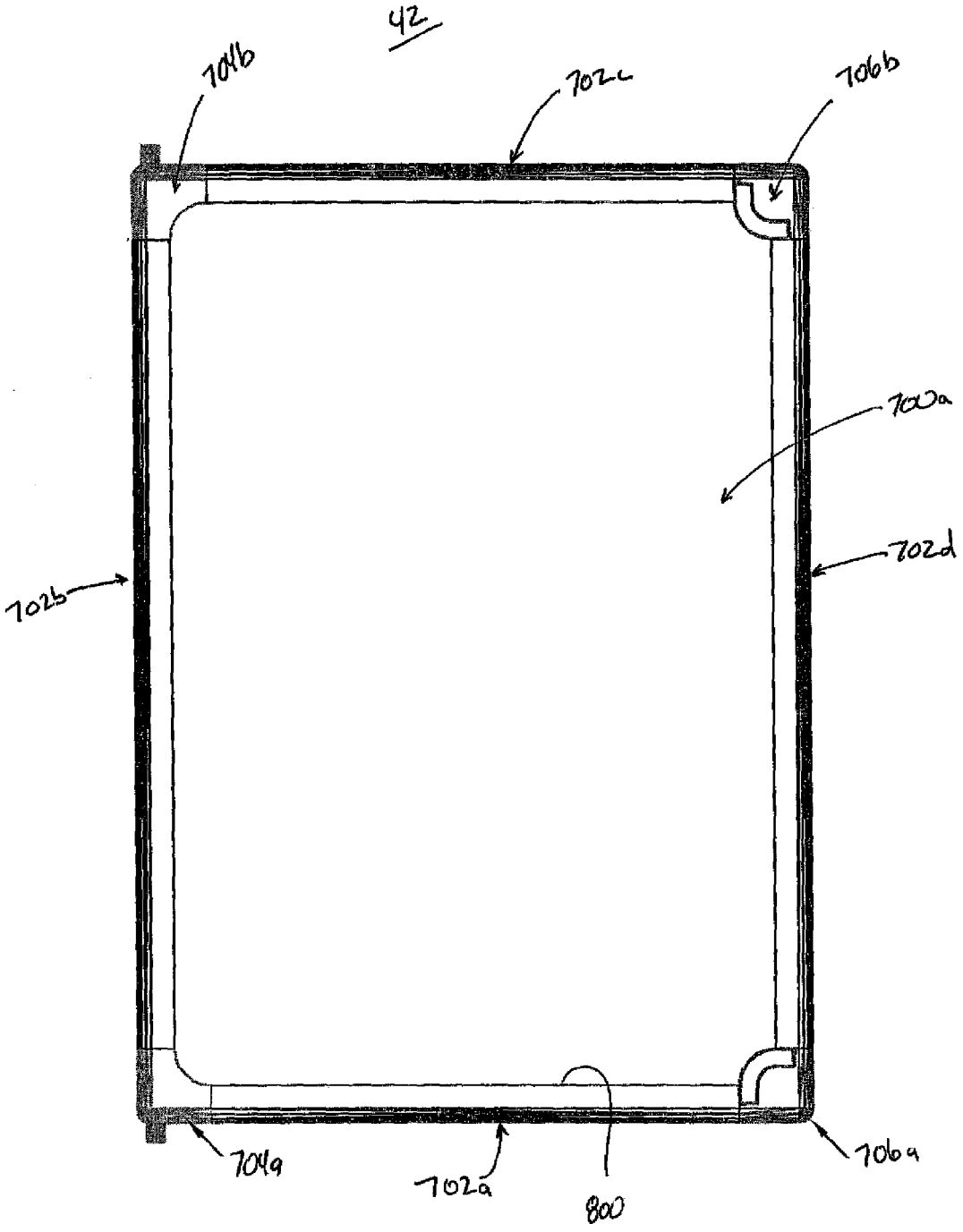
FIG. 26 is a front view of a door assembly useful with some embodiments of the kit of FIG. 1A.

With reference to FIG. 26, construction of the door assembly 42 includes mounting the door frame members 702 and the connectors 704, 706 about the panes 700 (one of which is identified in the view of FIG. 26) and to one another. With embodiments in which the kit 30 (FIG. 1A) is configured to allow a user to select dimensions of the door assembly 42, the user first determines a desired size of the door assembly 42 and then prepares (e.g., cuts to size) the panes 700 and the door frame members 702. Mounting of the door frame members 702 to two of the panes 700*a*, 700*b* is shown in FIG. 27A, and entails a side edge of each of the panes 700*a*, 700*b* being frictionally captured within the pane engagement region 742*a*, 742*b* of a corresponding one of the pane mounting assemblies 720*a*, 720*b*. Thus, the door frame member 702 can maintain the panes 700*a*, 700*b* in a spaced apart, substantially parallel arrangement.

Returning to FIG. 26, the connectors 704, 706 not only interconnect the door frame members 702, but assist in maintaining the spaced apart arrangement of the panes 700*a*, 700*b* (one of which is visible in FIG. 26). As a point of reference, the outer pane 700*a* is dimensioned to be slightly larger than a length of the corresponding frame members 702. For example, a length of first side edge 880 (referenced generally) of the pane 700*a* is longer than a length of the first door frame member 702*a*. Thus, the first side edge 880 projects beyond the first door frame member 702*a* and is coupled to the first hinge connector 704*a* and the first handle connector 706*a*.

Figure 27B:
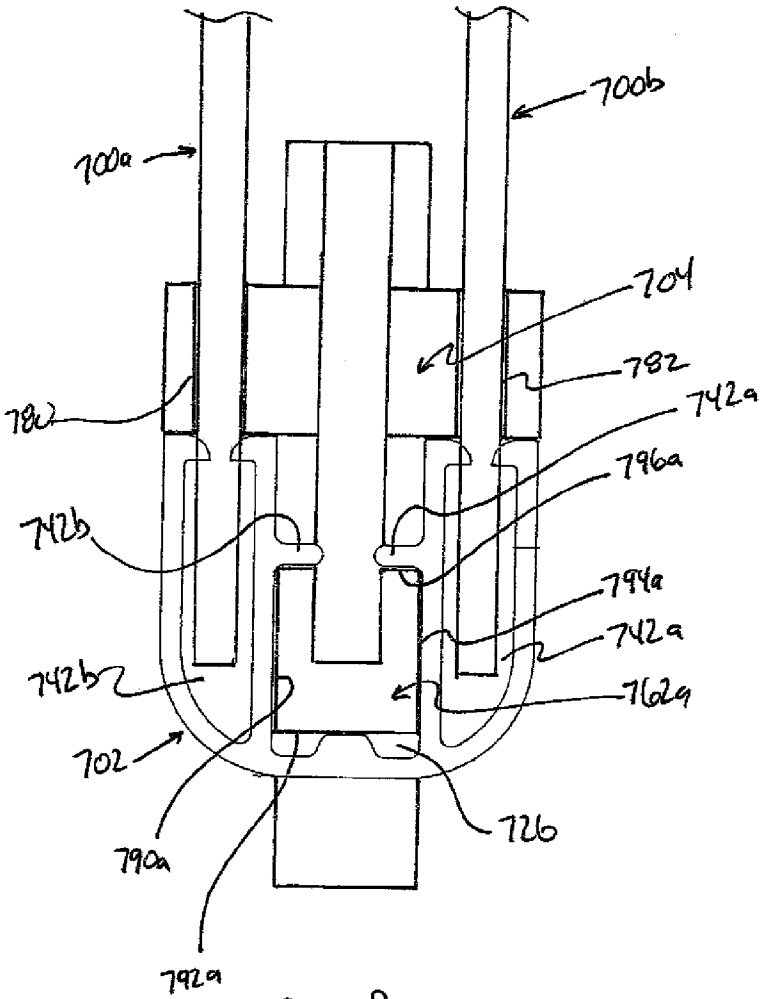
FIGS. 27A and 27B illustrate coupling of the door frame member of FIG. 22, the hinge connector of FIG. 23A and two panes in forming a portion of the door assembly of FIG. 26.
Figure 27A:
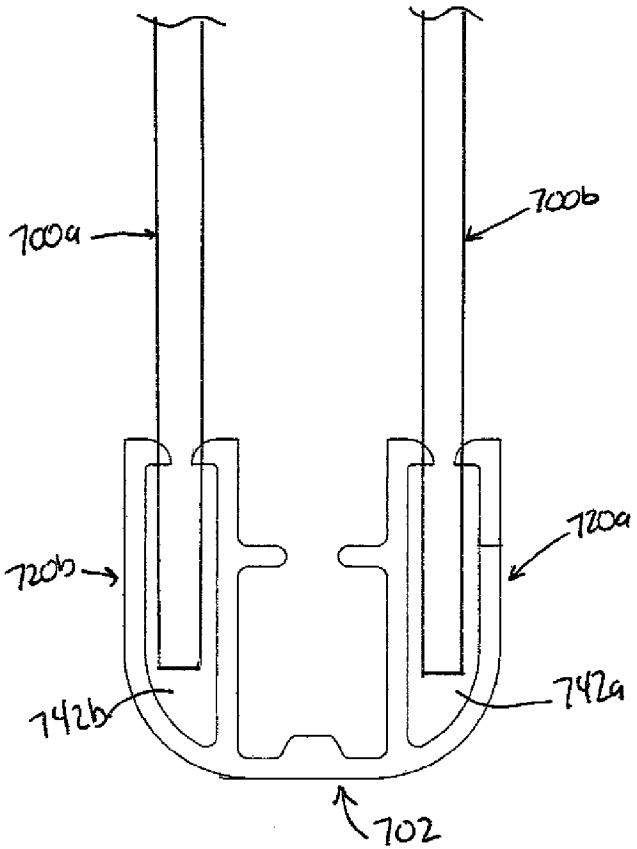

Mounting of one of the hinge connector 704 to one of the door frame members 702 is reflected in FIG. 27B, and includes insertion of the prong body 762*a* into the frame member joint capture region 726. In this regard, the door frame member 702 and the prong body 762*a* are frictionally engaged or locked to one another, with the sides 790*a*-796*a* of the prong body 762*a* bearing or abutting against surfaces of the door frame member 702. Further, the first and second slots 780, 782 of the hinge connector 704 are aligned with the pane engagement regions 742*a*, 742*b* of the door frame member 702 such that the panes 700*a*, 700*ba* are physically connected to the hinge connector 704. Assembly of the handle connectors 706 (FIG. 26) with the corresponding door frame members 702 and the panes 700*a*, 700*b* is achieved in a similar manner. In some embodiments, a third pane (not shown) can be included with the door assembly 42, and is inserted between the guide shoulders 724*a*, 724*b* for assembly within the third slot 784 of the hinge connector 704.

FIG. 26 illustrates that upon final assembly, the first and second hinge corner pieces 704*a*, 704*b* are located at one side of the door assembly 42, whereas the handle corner pieces 706*a*, 706*b* are located at the opposite side.

Figure 27C:
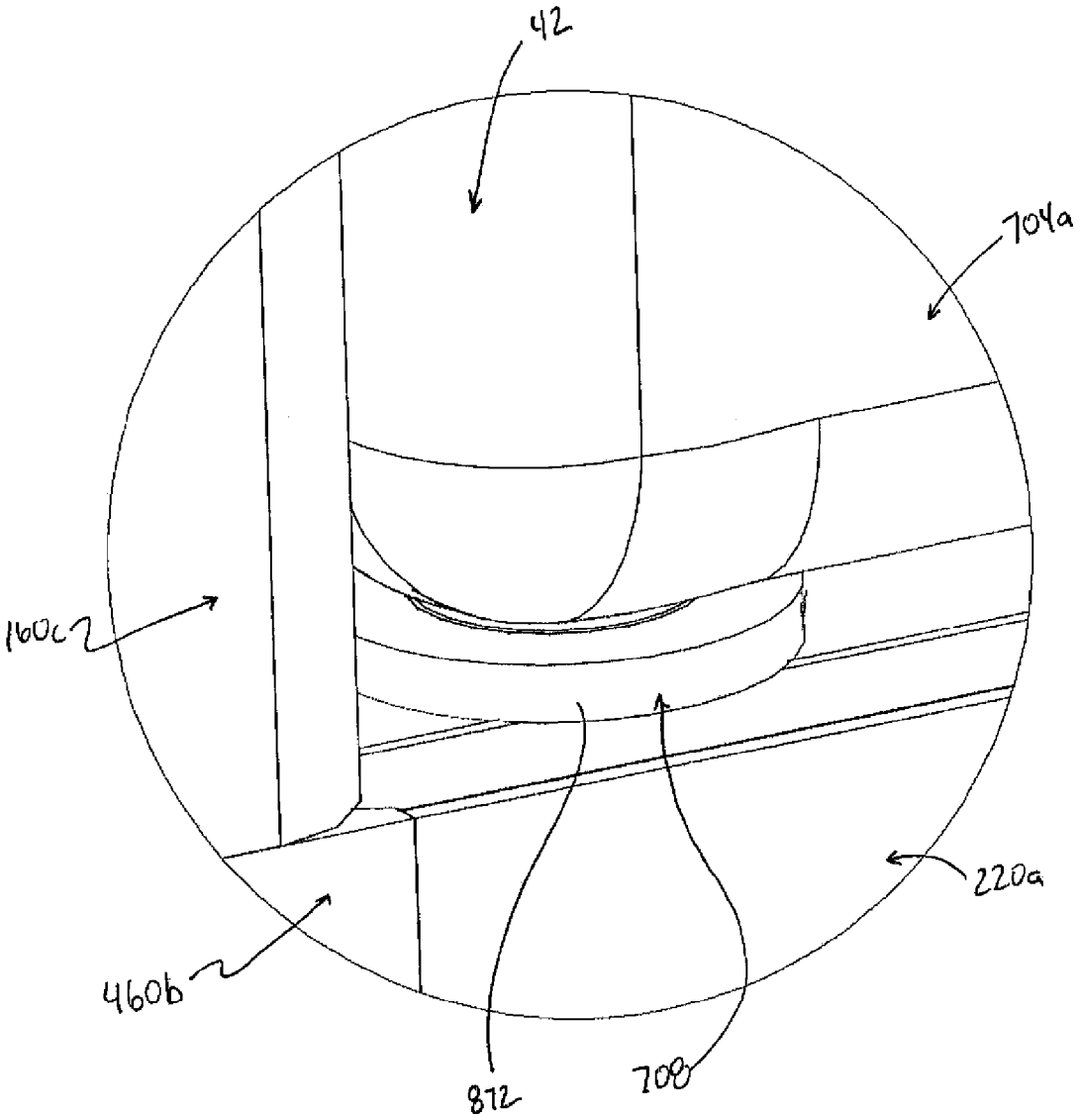
FIG. 27C is an enlarged, perspective view of a portion of the unit of FIG. 1B, illustrating coupling of the door assembly with a portion of the cabinet frame.

Referring to FIG. 21A, the door assembly 42 can be pivotably mounted to the door opening 602 of the cabinet 600 in various manners. In some embodiments, holes are formed in the cabinet 600 at locations corresponding with desired arrangement of the pin 764 (hidden in FIG. 21A, but shown in FIG. 23A) of each of the hinge connectors 704*a*, 704*b*. In some embodiments, one of the caps 708 (FIG. 25A) is inserted into the so-formed hole, followed by insertion of the pin 764 into the cap 708. FIG. 27C illustrates the cap 708 press fitted into the first horizontal post frame member 220*a*. The flange 872 rests on the frame member 220*a*, and establishes a slight spacing between the hinge connector 704*a* exterior and the frame member 220*a*. As a result, the frame member 220*a* does not impede pivoting movement of the door assembly 42.

Returning to FIG. 21A, the door assembly 42 is readily transitioned to an open position, for example by a user grasping the handle body 814 of one or both of the handle connectors 706*a*, 706*b*, and causing the door assembly 42 to rotate about the pins 764.

Figure 28:
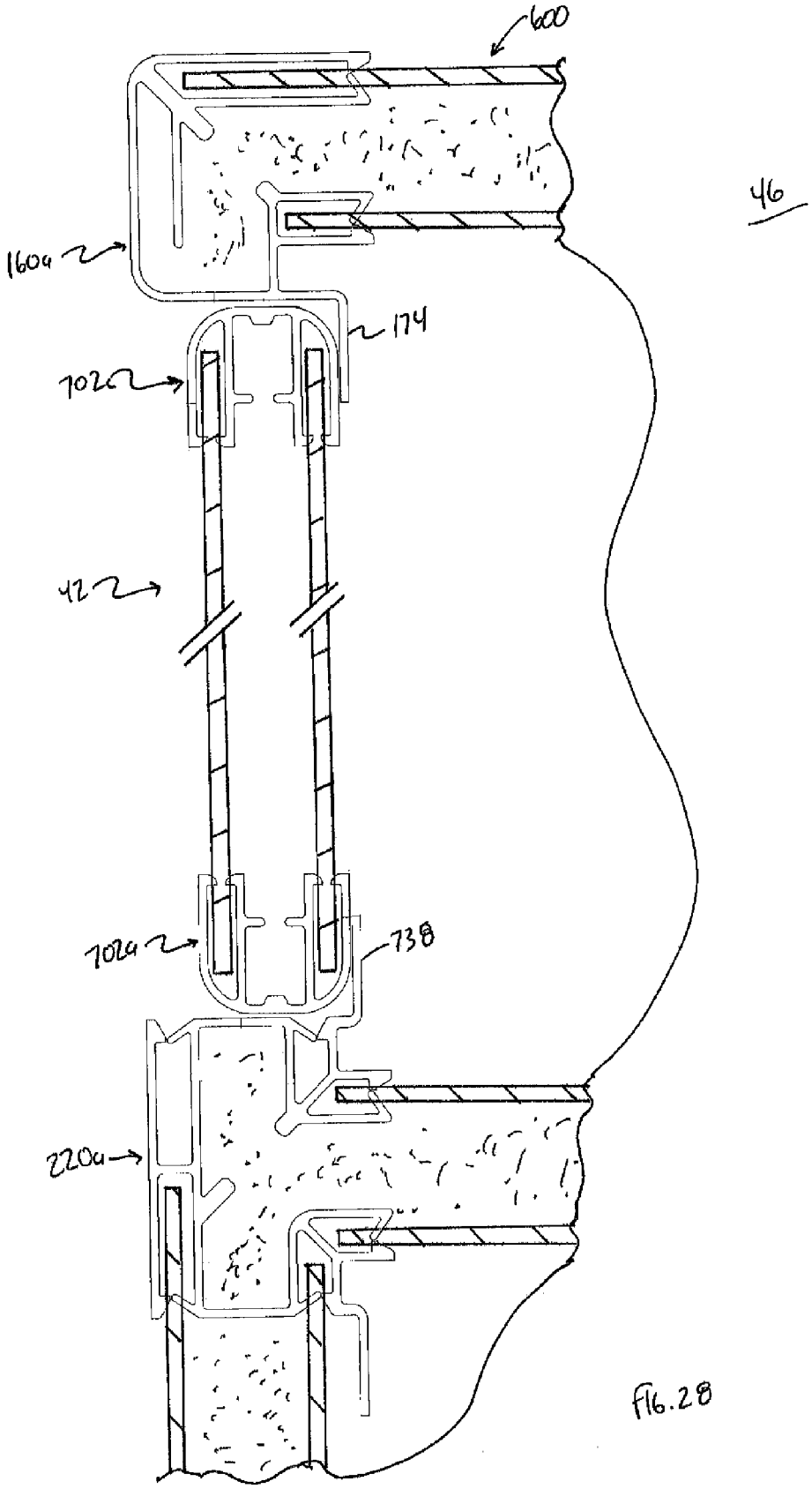
FIG. 28 is a simplified cross-sectional view of a portion of the unit of FIG. 1B, illustrating a relationship of the door assembly with various cabinet frame members.

With constructions in which the door opening 602 is defined by frame members otherwise incorporating a flange, a relatively sealed arrangement is effectuated between the door assembly 42 and the cabinet 600 in a closed position of the door assembly 42. More particularly, FIG. 28 illustrates the door assembly 42 mounted to the cabinet 600 and in a closed position. The upper door frame member 702*c* rests against the flange 174 of the first clip frame member 160, whereas the bottom door frame member 702*a* rests against the flange 738 provided with the first horizontal post frame member 220*a*. A similar abutting relationship is established between the side door frame members 702*b*, 702*d* (FIG. 26) and the flange 174 provided with the second and third clip frame members 160*b*, 160*c* (FIG. 1C).

Other Modular Unit Constructions

It will be recognized that the cooled modular product merchandizing unit 46 shown in FIG. 1B is but one example of an end design available to a user with kits of the present disclosure. Other modular cooled merchandizing units constructed from kits of the present disclosure can have additional shelves 608, or no shelves. Further, the shelves 608 can divide the resultant merchandizing unit into sections each having a cooling device for affecting a temperature thereof. For example, the resultant merchandizing unit can serve as a multi-temperature display, having a refrigerated section, a frozen section, a heated section and/or a room temperature section. Each section can optionally be provided with its own door.

Where a desired size of the modular cooling unit has one or more dimensions exceeding a length of the available frame members 36 and/or implicating a need for one or more intermediate support columns, the optional vertical post frame member 320 (FIG. 6) can be employed, along with the three-way tee connector 500 (FIG. 9A) and/or the four-way tee connector 560 (FIG. 10A).

Figure 29A:
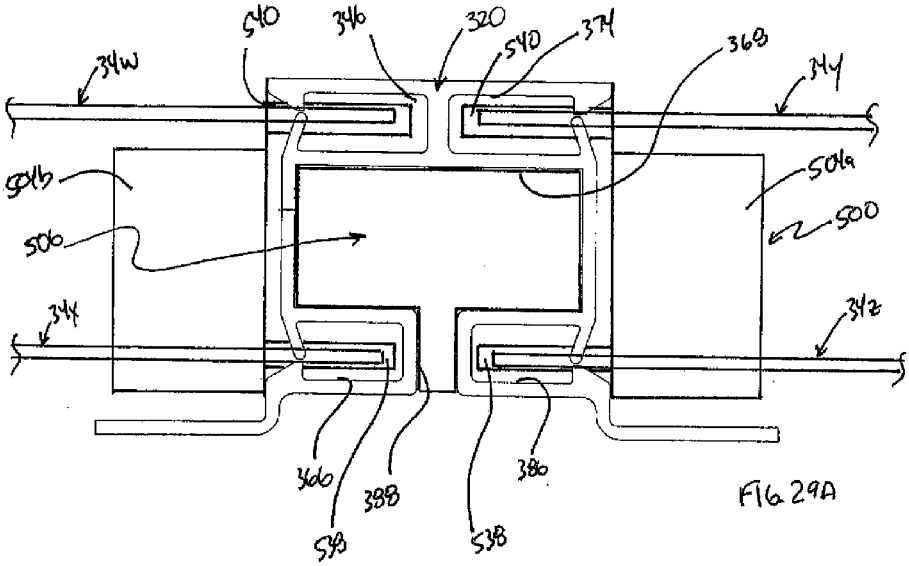
FIG. 29A illustrates coupling of the vertical post frame member of FIG. 6 with the three-way tee connector of FIG. 9A.
Figure 29B:
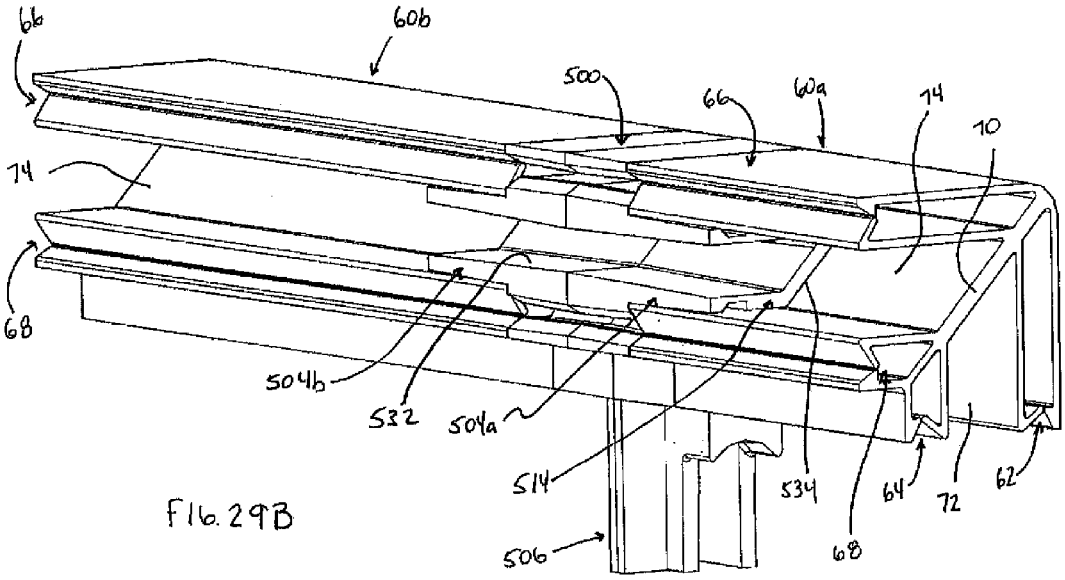
FIG. 29B illustrates coupling of the three-way tee connector of FIG. 9A with two of the corner frame members of FIG. 2.

Coupling between the three-way tee connector 500 and the vertical post frame member 320 is generally reflected in FIG. 29A, and entails press fitting the post assembly 506 of the tee connector 500 within the joint capture regions 368, 388 of the vertical post frame member 320. Panels 34*w*-34*z* are maintained within the panel mounting regions 346, 366, 374, 386 of the frame member 320 and coupled to the slots 538, 540 of the tee connector 500. Conversely, FIG. 29B illustrates coupling of two of the corner frame members 60*a*, 60*b* with the three-way tee connector 500. For ease of explanation, the vertical post frame member 320 (otherwise coupled to the post assembly 506) is omitted from the view, as are the panels 34*w*-34*z* (it being understood that the panels 34*y*, 34*z* are mounted to the first inner and outer panel mounting assemblies 62, 64 of the first corner frame member 60*a*, and the panels 34*x*, 34*w* are mounted to the second corner frame member 60*b*). The first plug assembly 504*a* of the tee connector 500 is frictionally mounted to the second joint capture regions 72, 74 of the first frame member 60*a* (i.e., the second prong body 514 is frictionally coupled to the second joint capture region 74; the first prong body 512 (FIG. 9A) being hidden in the view). Though partially obstructed in the view, the guide shoulder 70 is received within the channel 534. The second plug assembly 504*b* is similarly fractionally coupled to the second corner frame member 60*b*. Notably, the trough 532 of the tee connector 500 is open to the second joint capture region 74 of each of the corner frame members 60*a*, 60*b*. With this construction, foam insulation dispensed between spaced apart panels (not shown) otherwise coupled to the second outer and inner panel mounting assemblies 66, 68 of the frame members 60*a*, 60*b* will flow or spread into the trough 532, thereby binding the panels, the frame members 60*a*, 60*b* and the tee connector 500 together upon hardening. Similarly assemblies are achieved with the four-way tee connector 560 (FIG. 10A).

Figure 30A:
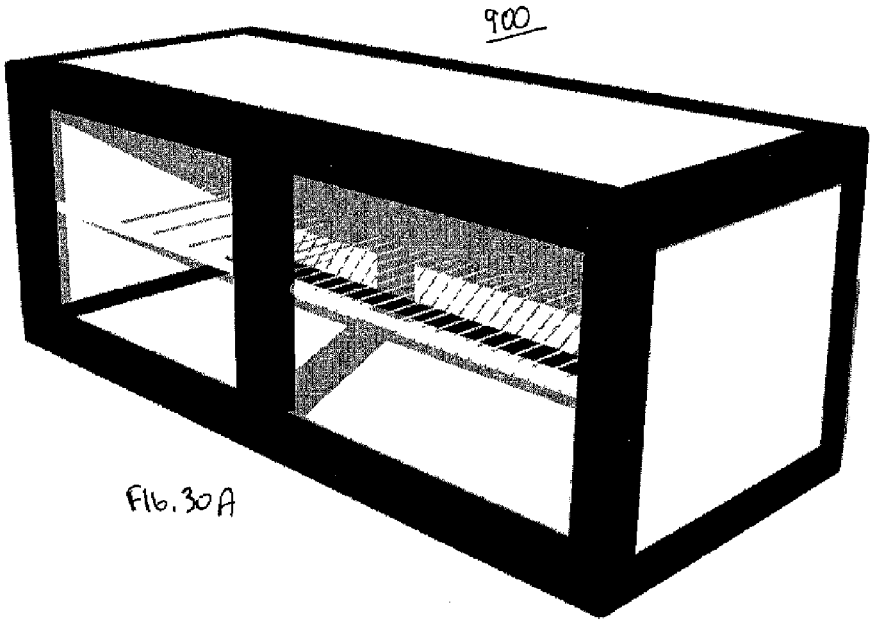
FIG. 30A is a perspective view of another modular cooled product merchandizing unit in accordance with the principles of the present disclosure and constructed from the kit of FIG. 1A.
Figure 30B:
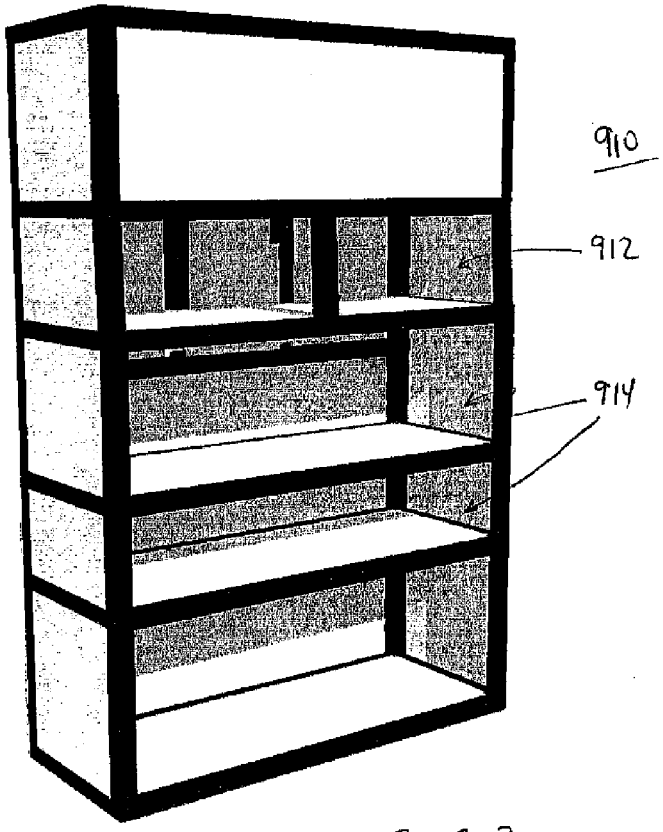
FIG. 30B is a perspective view of another modular cooled product merchandizing unit in accordance with the principles of the present disclosure and constructed from the kit of FIG. 1A.

In addition to providing for a plethora of differently dimensioned modular coolers, the kit 30 (FIG. 1A) can be assembled to form a modular cooled merchandizing unit having a style other than the upright style of FIG. 1B. For example, FIG. 30A shows another modular cooled merchandizing unit 900 constructed from kits of the present disclosure and having a coffin style. FIG. 30B is another modular cooled merchandizing unit 910 constructed from kits of the present disclosure and having an enclosed, cooled section 912 and open, room temperature sections 914.

The kits, methods, and modular units of the present disclosure provide a marked improvement over previous designs. A cooled product merchandizing unit having virtually any style, shape, or size can be constructed. Manufacturers are no longer required to invest in expensive tooling to generate a "new" merchandizing unit. Instead, any desired merchandizing unit can be quickly designed and assembled using the kits and methods of the present disclosure. Further, following use of the constructed modular cooling unit, some of the individual components can be disassembled and reused. For example, one or more of the frame members, joint pieces, or cooling unit used for a first cooling unit can later be reused with a second cooling unit.

Although the present disclosure has been described with reference to preferred embodiments, workers skilled in the art will recognize that changes can be made in form and detail without departing from the spirit and scope of the present disclosure. For example, kits, methods and modular units of the present disclosure can incorporate lighting, such as LED lights. The lighting can be provided with the kit for subsequent assembly (e.g., adhesive, friction fit, etc.) to the resultant modular unit. In related embodiments, a power control system provided with the cooling unit is adapted to deliver converted power to the lighting from a standard in-store power supply.

What is claimed is:

1. A kit for constructing a modular cooled product merchandizing unit, the kit comprising:

a plurality of panels;

a multiplicity of extruded frame members each having a length between opposing ends and a continuous shape along the length, the shape defining:

a first outer panel mounting assembly, a first inner panel mounting assembly, wherein the mounting assemblies each include opposing legs extending from a base web to define a panel engagement region, a first joint capture region at least partially defined between the mounting assemblies, wherein the first outer and inner panel mounting assemblies are arranged to retain two of the panels in a spaced apart, substantially parallel fashion;

a multiplicity of molded joint pieces each including:

a block core forming first-sixth faces, first-third plug assemblies projecting from a respective one of the faces and configured to frictionally mate with the joint capture region; and a cooling unit;

wherein the kit is configured such that the frame members each retain respective ones of the panels as paired inner and outer panels within the corresponding panel engagement regions, the joint pieces are assembled to interconnect the frame members and the corresponding paired panels to form a merchandizing cabinet, and the cooling unit is mountable to a face of the cabinet to form a modular cooled product merchandizing unit.

2. The kit of claim 1, wherein the panels are formed of cardboard.

3. The kit of claim 1, wherein the frame members are configured to maintain a gap between the panels of each pair of the inner and outer panels, the kit further comprising:

a source of expandable foam insulation for a dispensement into the gap.

4. The kit of claim 1, wherein the cooling unit includes a thermoelectric component.

5. The kit of claim 1, wherein the outer panel mounting assembly is configured such that the opposing legs extend in a substantially parallel manner relative to one another from the corresponding base web.

6. The kit of claim 1, wherein the multiplicity of frame members includes a plurality of corner frame members the shape of which further includes:

a second outer panel mounting assembly; and a second inner panel mounting assembly;

wherein the second and outer and inner panel mounting assemblies each include opposing legs and are arranged to retain another two of the panels in a spaced apart, substantially parallel fashion;

and further wherein the legs of the first panel mounting assemblies are substantially perpendicular with the legs of the second mounting assemblies.

7. The kit of claim 6, wherein the legs of the second outer panel mounting assembly extend from the base web of the first outer panel mounting assembly, and the legs of the second inner panel mounting assembly extend from the base web of the first inner panel mounting assembly.

8. The kit of claim 7, wherein the shape further defines a guide shoulder interconnecting the base webs, the guide shoulder configured for mounting to one of the joint piece plug assemblies.

9. The kit of claim 1, wherein the multiplicity of frame members includes a plurality of clip frame members each further including:

a connection web projecting from and interconnecting the base webs of the panel mounting assemblies;

a first guide shoulder projecting inwardly from the base web of the outer panel mounting assembly toward the inner panel mounting assembly, the first guide shoulder configured for mounting to one of the joint piece plug assemblies; and a second guide shoulder projecting outwardly from the base web of the inner panel mounting assembly toward the outer panel mounting assembly, the second guide shoulder configured for mounting to one of the joint piece plug assemblies.

10. The kit of claim 9, wherein each of the clip frame members further include:

a flange projecting from the connection web in a direction opposite the panel mounting assemblies.

11. The kit of claim 1, wherein the multiplicity of frame members includes a plurality of horizontal post frame members each further including:

a second outer panel mounting assembly;

a second inner panel mounting assembly;

wherein the second outer and inner panel mounting assemblies each include opposing legs and are arranged to retain another two of the panels in a spaced apart, substantially parallel fashion, and further wherein the legs of the first and second outer panel mounting assemblies are substantially parallel with one another;

a first platform mounting assembly; and a second platform mounting assembly;

wherein the first and second platform mounting assemblies are configured and arranged to retain another two of the panels in a spaced apart, substantially parallel fashion.

12. The kit of claim 11, wherein the platform mounting assemblies each include opposing legs defining a panel engagement region, and further wherein the legs of the platform mounting assemblies are substantially perpendicular to the legs of the inner panel mounting assemblies.

13. The kit of claim 1, wherein the multiplicity of frame members includes:

a plurality of corner frame members each further defining:

a second outer panel mounting assembly including opposing legs, a second inner panel mounting assembly including opposing legs, wherein the legs of the second mounting assemblies are substantially perpendicular with the legs of the first mounting assemblies;

a plurality of clip frame members each further defining:

a connection web interconnecting the base webs of the corresponding first panel mounting assemblies, a guide shoulder projecting from the base web of the corresponding first outer panel mounting assembly;

a plurality of horizontal post frame members each further defining:

a second outer panel mounting assembly including opposing legs, a second inner panel mounting assembly including opposing legs, wherein the legs of the horizontal post frame member mounting assemblies are substantially parallel with one another, a first platform mounting assembly, a second platform mounting assembly; and a plurality of vertical post frame members each further defining:

a second outer panel mounting assembly including opposing legs, a second inner panel mounting assembly including opposing legs, wherein the legs of the first and second outer panel mounting assemblies of the corresponding vertical post frame member are aligned, and the legs of the first and second inner panel mounting assemblies of the corresponding vertical post frame member are aligned.

14. The kit of claim 1, wherein each plug assembly includes:

a first prong body; and a second prong body;

wherein the first prong body is spaced from the second prong body to define a channel sized to frictionally capture a guide shoulder formed at the ends of each of the frame members.

15. The kit of claim 1, wherein the first plug assembly projects from the first face of the block core, the fourth face of the block core is arranged perpendicular to the first face and forms an exterior surface of the corresponding joint piece, and further wherein a first outer panel slot is formed in the first face spatially between the first plug assembly and the fourth face, the outer panel slot sized to receive an edge of one of the panels.

16. The kit of claim 15, wherein the fifth face of the block core is orthogonal to the first and fourth faces and forms another exterior surface of the corresponding joint piece, and further wherein a second outer panel slot is formed between the first plug assembly and the fifth face, the second outer panel slot sized to receive an edge of another one of the panels.

17. The kit of claim 15, wherein an inner panel slot is formed in the first face spaced from the first plug assembly opposite the outer panel slot, the inner panel slot sized to receive an edge of another one of the panels, and further wherein the kit is configured such that upon assembly of:

a first panel to the outer panel mounting assembly of a first frame member, a second panel to the inner panel mounting assembly of the first frame member, and the first plug assembly to the first end of the first frame member, the first panel nests within the outer panel slot and the second panel nests within the inner panel slot.

18. The kit of claim 1, wherein the multiplicity of joint pieces includes:

a plurality of three-way corner connectors including the first-third plug assemblies projecting from the first-third faces of the corresponding three-way corner connector core such that the fourth-sixth faces of the corresponding three-way corner connector define exterior surfaces; and a plurality of four-way corner connectors including the first-third plug assemblies and a fourth plug assembly projecting from a respective one of the first-fourth faces of the corresponding four-way corner connector such that the fifth and sixth faces of the corresponding four-way corner connector define exterior surfaces.

19. The kit of claim 1, further comprising:
a door assembly including:
first and second panes,
a plurality of extruded door frame members each having a length between opposing ends and a continuous shape along the length, the shape defining:
a first pane mounting assembly,
a second pane mounting assembly,
wherein the pane mounting assemblies each include opposing legs extending from a base web to define a pane engagement region,
a joint capture region defined between the pane mounting assemblies,
wherein the pane mounting assemblies are arranged to retain the first and second panes in a spaced apart, substantially parallel fashion;
a plurality of molded door joint pieces each including:
a core defining an interior surface,
first and second prong bodies projecting from the interior surface, wherein a direction of projection of the first prong body is substantially perpendicular to a direction of projection of the second prong body,
wherein the prong bodies are each configured to frictionally mate within the joint capture region at one of the end of one of the door frame members;
wherein the kit is configured such that four of the door frame members retain the first and second door panes and four of the joint pieces interconnect the four door frame members to form a completed door assembly that is mountable to the merchandizing cabinet.

20. A method of constructing a modular cooled product merchandizing unit, the method comprising:
receiving a multiplicity of extruded frame members each defining opposing ends and a continuous shape along the length, the shape defining:
a first outer panel mounting assembly,
a first inner panel mounting assembly,
wherein each of the mounting assemblies includes opposing legs combining to define a panel engagement region,
a first joint capture region between the mounting assemblies;
determining a desired size and shape of a cabinet of the merchandizing unit;
selecting ones of the frame members at lengths based upon the determined size and shape of the cabinet;
assembling the selected frame members to one another with joint pieces, the joint pieces including:
a block core forming first-sixth faces,
first-third plug assemblies projecting from respective ones of the faces and configured to frictionally mate with the joint capture region at the end of a respective one of the frame members;
wherein the frame members and the joint pieces combine to define a cabinet frame demarcated into a plurality of frame face regions;
assembling panels to each of the inner and outer panel mounting assemblies of each of the frame members associated with at least some of the frame face regions to define closed face regions each having a pair of the panels maintained in a spaced apart, substantially parallel fashion;
mounting a door assembly to the cabinet frame; and
mounting a cooling unit to the cabinet frame to create a completed modular unit.

21. The method of claim 20, further comprising:
dispensing a foaming insulation material between the pair of panels at each of the closed face regions.

22. The method of claim 20, further comprising:
determining a desired location of a door opening in the cabinet;
forming the door opening at one of the frame face regions, including assembling four of the frame members to define a perimeter of the door opening;
wherein the four frame members each further include a flange, the flanges being substantially co-planar upon final assembly of the cabinet frame; and
mounting the door assembly to the door opening, wherein a perimeter of the door assembly selectively abuts the flanges in a closed position.

23. The method of claim 22:
wherein three of the four frame members are clip frame members each further defining:
a connection web interconnecting the corresponding panel mounting assemblies,
a flange web projecting from the connection web in a direction substantially perpendicular the legs of the corresponding inner panel mounting assembly; and
wherein the fourth frame member is a horizontal post frame member further defining:
a second outer panel mounting assembly,
a second inner panel mounting assembly,
wherein legs of the first and second outer and inner panel mounting assemblies are substantially parallel with one another,
a first platform mounting assembly,
a second platform mounting assembly,
wherein legs of the platform mounting assemblies are substantially perpendicular with the legs of the corresponding outer and inner panel mounting assemblies.

24. The method of claim 23, further comprising:
assembling first and second panels to the first and second pairs of platform mounting assemblies, respectively, to form a shelf in the cabinet frame.

25. The method of claim 20, further comprising:
constructing a door assembly for mounting to the cabinet, including:
receiving a plurality of extruded door frame members each having a length between opposing ends and a continuous shape along the length, the shape defining:
a first pane mounting assembly,
a second pane mounting assembly,
a joint capture region between the pane mounting assemblies, determining a desired size and shape of the door assembly,
selecting ones of the door frame members at lengths based upon the determined size and shape,
assembling the selected door frame members to one another a with door joint pieces including:
a base defining an interior surface,
first and second door prong bodies projecting from the interior surface and configured to mate with the joint capture region, wherein a direction of projection of the first prong body is substantially perpendicular to a direction of projection of the second prong body,
assembling first and second panes to the first and second pane mounting assemblies, respectively, of the door frame members; and
mounting the door assembly to the cabinet.

* * * * *